US007055949B2

(12) United States Patent
Ohashi

(10) Patent No.: US 7,055,949 B2
(45) Date of Patent: Jun. 6, 2006

(54) BOTH-SIDE RECORDING APPARATUS

(75) Inventor: Tetsuyo Ohashi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/887,955

(22) Filed: Jul. 12, 2004

(65) Prior Publication Data

US 2005/0012800 A1 Jan. 20, 2005

(30) Foreign Application Priority Data

Jul. 14, 2003 (JP) ..... 2003-196519

(51) Int. Cl.
*B65H 9/00* (2006.01)

(52) U.S. Cl. ..... 347/104; 271/186; 271/225; 271/274

(58) Field of Classification Search ..... None
See application file for complete search history.

(56) References Cited

U.S. PATENT DOCUMENTS 4,214,740 A * 7/1980 Acquaviva ..... 271/3.2
4,270,856 A * 6/1981 Goida ..... 399/107
5,836,706 A * 11/1998 Ruhe ..... 400/636
6,047,959 A * 4/2000 Baba et al. ..... 271/3.01
6,332,068 B1 12/2001 Blackman et al. ..... 399/364
6,651,980 B1 * 11/2003 Isemura et al. ..... 271/259
2003/0143011 A1 7/2003 Yoshikawa et al. ..... 400/578

FOREIGN PATENT DOCUMENTS

JP 2002-67407 3/2002

* cited by examiner

*Primary Examiner*—Andrew H. Hirshfeld
*Assistant Examiner*—Jill E. Culler
(74) *Attorney, Agent, or Firm*—Fitzpatrick, Cella, Harper & Scinto

(57) ABSTRACT

Driving sources of a reversing section roller and a sheet feeding roller are made common, a drive transmission mechanism to the reversing section roller is provided with clutch means for starting and stopping synchronous rotation after a predetermined rotation, and a degree of freedom in control is enhanced by properly bringing the reversing section roller into a halted state as necessary, thereby realizing reduction in load on the driving source, reduction in noises, and reduction in the size of the apparatus and cost. The apparatus is provided with clutch means, which starts synchronous rotation of the reversing section roller with the sheet feeding roller is started in a period of time from a start of a drive of the sheet feeding roller until nipping of a recording medium by the reversing section roller, after recording is performed onto a front surface, and stops the synchronous rotation of the reversing section roller with the sheet feeding roller in a period of time from release from the reversing section roller until finishing of a sheet discharge operation, after the recording medium from a sheet reversing section is nipped by the sheet feeding roller again.

21 Claims, 25 Drawing Sheets

| |
|---|
| FIG. 20A |
| FIG. 20B |

BOTH-SIDE RECORDING APPARATUS

This application claims priority from Japanese Patent Application No. 2003-196519 filed Jul. 14, 2003, which is hereby incorporated by reference.

BACKGROUND OF THE INVENTION

1. Field of the Invention

The present invention relates to a both-side recording apparatus including a sheet reversing section for automatically recording onto both of front and reverse surfaces of a recording medium.

2. Related Background Art

Various methods have been conventionally carried out or proposed as constructions for performing automatic both-side recording in recording apparatuses such as an ink jet recording apparatus and the like. In each of them, after recording onto a front surface (front side) of a recording sheet as a recording medium is finished, the conveying direction up to this time is reversed to feed (convey) the recording sheet into a sheet reversing section (a front and back reversing device), then, after the reversing operation is finished, the recording sheet is conveyed in the same sheet conveying section again, and recording is performed onto the back surface of the recording sheet in the same recording section, as the invention disclosed in Japanese Patent Application Laid-Open No. 2002-067407, for example.

Among these methods, as in the invention disclosed in U.S. Pat. No. 6,332,068, there is a recording apparatus in which a common driving source is used for a sheet feeding roller and a sheet reversing section, and the sheet reversing section is always driven when the sheet feeding roller is rotated. This is the type of recording apparatus in which a planetary gear mechanism provided at an oscillating arm (oscillating lever) is placed in a drive transmitting path extending from the driving source to the sheet reversing section, and even when the driving source of the sheet feeding roller is rotated in either direction, a roller (reversing section roller) in the sheet reversing section is always rotated in the same direction by changing over the planetary gear train with the oscillating arm. This type of recording apparatus has the advantage that it is possible to completely synchronize a circumferential speed of each roller when the recording medium (recording sheet) is conveyed by cooperation of the reversing section roller and a sheet feeding roller, and is widely used. As another construction, there is the recording apparatus in which an exclusive driving source for driving the reversing section roller inside the sheet reversing section and thereby the roller can be driven in an optional timing.

However, there are several restrictions in the above described prior art examples. Namely, in the mechanism directly connected with the driving source of the sheet feeding roller through the planetary gear mechanism, the roller inside the sheet reversing section is always rotated in synchronism with the sheet feeding roller, for example, even when only one side recording is performed, which has nothing to do with the both-side recording operation. Therefore, the driving source of the sheet feeding roller needs to rotate while excess load is exerted on the driving source, and therefore it is necessary to allow for the excess load and prepare the driving source capable of generating large torque, which causes the technical problems such as an increase in size, a rise in const, and further an increase in driving electric power.

Since the roller (reversing section roller) inside the sheet reversing section always rotates, the durability of the roller itself, such as the shaft, bearing and a rubber portion is required, and it is necessary to select the material having a favorable slidability, the material with allowance for deterioration and the like, which causes the problem of a rise in cost and the like. Further, the driving gear train and the like to the reversing section roller always rotate, and therefore there arises the problem of increasing the noise occurring to the rotating portion. In the type of the recording apparatus having the independent driving source inside the sheet reversing section, it becomes difficult to completely synchronize the circumferential speeds of the both rollers in the situation in which it is necessary to convey the recording sheet in cooperation of the sheet feeding roller and the reversing section roller, and there arises the problem that when a small dethroughtion between the circumferential speeds occurs, recording medium conveying accuracy is reduced due to occurrence of a slack of the sheet between both the rollers or an unnecessary tension. As a result that the independent driving source is included, there arise the problems of an increase in the apparatus size, a rise in cost and the like.

SUMMARY OF THE INVENTION

The present invention is to solve the technical problems as described above, and an object of the present invention is to provide a both-side recording apparatus, which is capable of enhancing the degree of freedom in control by bringing a reversing section roller into a state in which it is not started to operate as necessary, capable of reducing the apparatus size and cost by reducing a load of a driving source, and capable of enhancing conveying accuracy of a recording medium.

In order to attain the above-described object, the present invention (claim 1) is, in a both-side recording apparatus comprising a sheet feeding roller, a recording section and a sheet reversing section, wherein after recording is performed onto a first surface of a recording medium in said recording section, the recording medium is conveyed to the aforesaid sheet reversing section by the aforesaid sheet feeding roller, and the recording medium after being reversed is nipped by the aforesaid sheet feeding roller again to perform recording onto a second surface of the recording medium, characterized in that after the recording is performed onto the first surface, the aforesaid reversing section roller starts synchronous rotation with the aforesaid sheet feeding roller in a period of time from a start of a drive of the aforesaid sheet feeding roller to convey the recording medium to the aforesaid sheet reversing section until a tip end of the recording medium is nipped by a reversing section roller of the aforesaid sheet reversing section.

In order to attain the above-described object, another aspect of the present invention (claim 3) is, in a both-side recording apparatus comprising a sheet feeding roller, a recording section and a sheet reversing section, wherein after recording is performed onto a first surface of a recording medium in said recording section, the recording medium is conveyed to the aforesaid sheet reversing section by said sheet feeding roller, the recording medium after being reversed is nipped by the aforesaid sheet feeding roller again and recording is performed onto a second surface of the recording medium, characterized in that after the recording medium is conveyed from the aforesaid sheet reversing section and the recording medium is nipped by the aforesaid sheet feeding roller again, the aforesaid reversing section roller does not rotate synchronously with the aforesaid sheet feeding roller in a period of time from releasing of a rear end of the recording medium from the aforesaid reversing section roller until a discharge operation of the recording medium is finished.

DETAILED DESCRIPTION OF THE PREFERRED EMBODIMENTS

Figure 1:
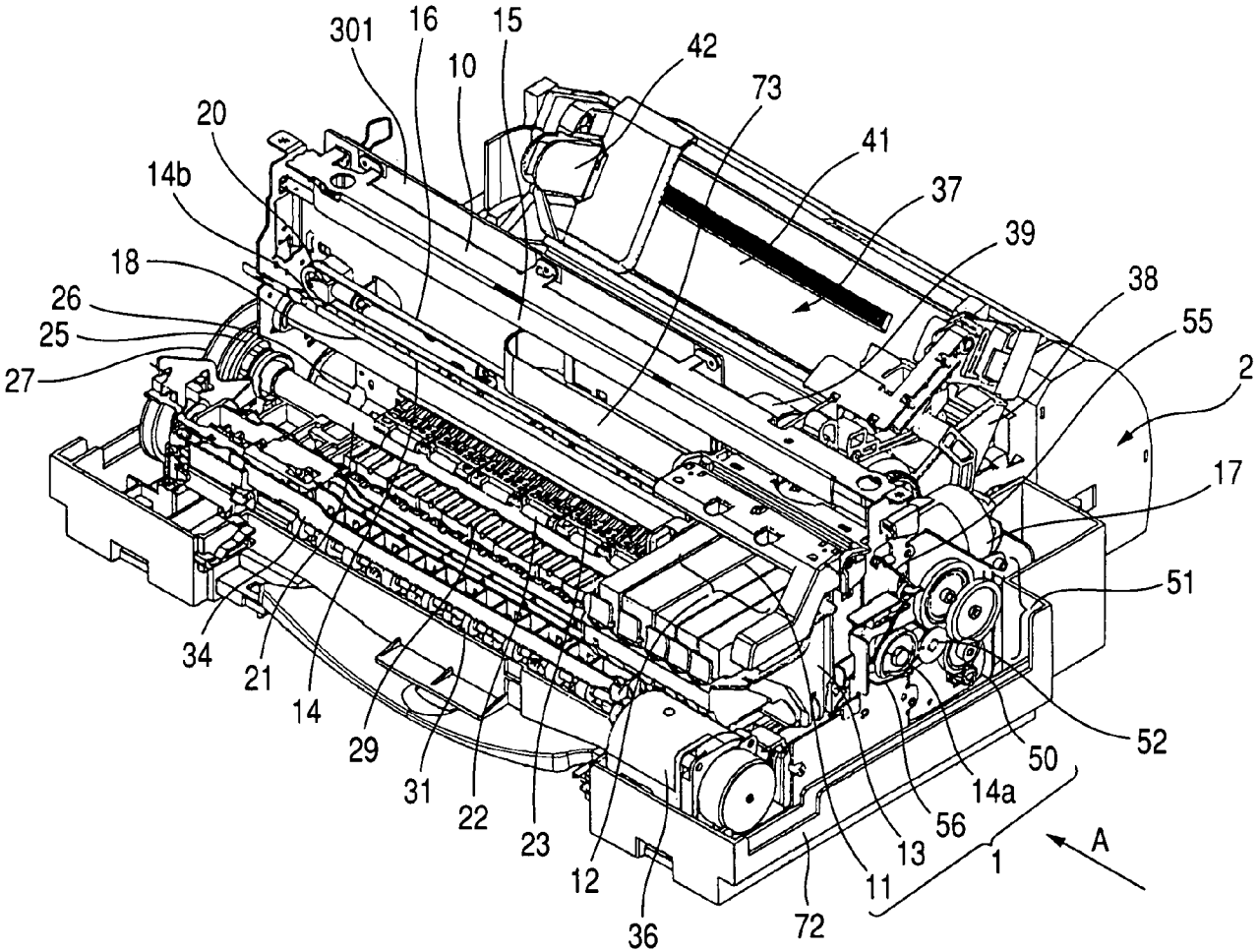
FIG. 1 is a schematic perspective view showing an entire construction of a both-side recording apparatus according to one embodiment of the present invention.
Figure 2:
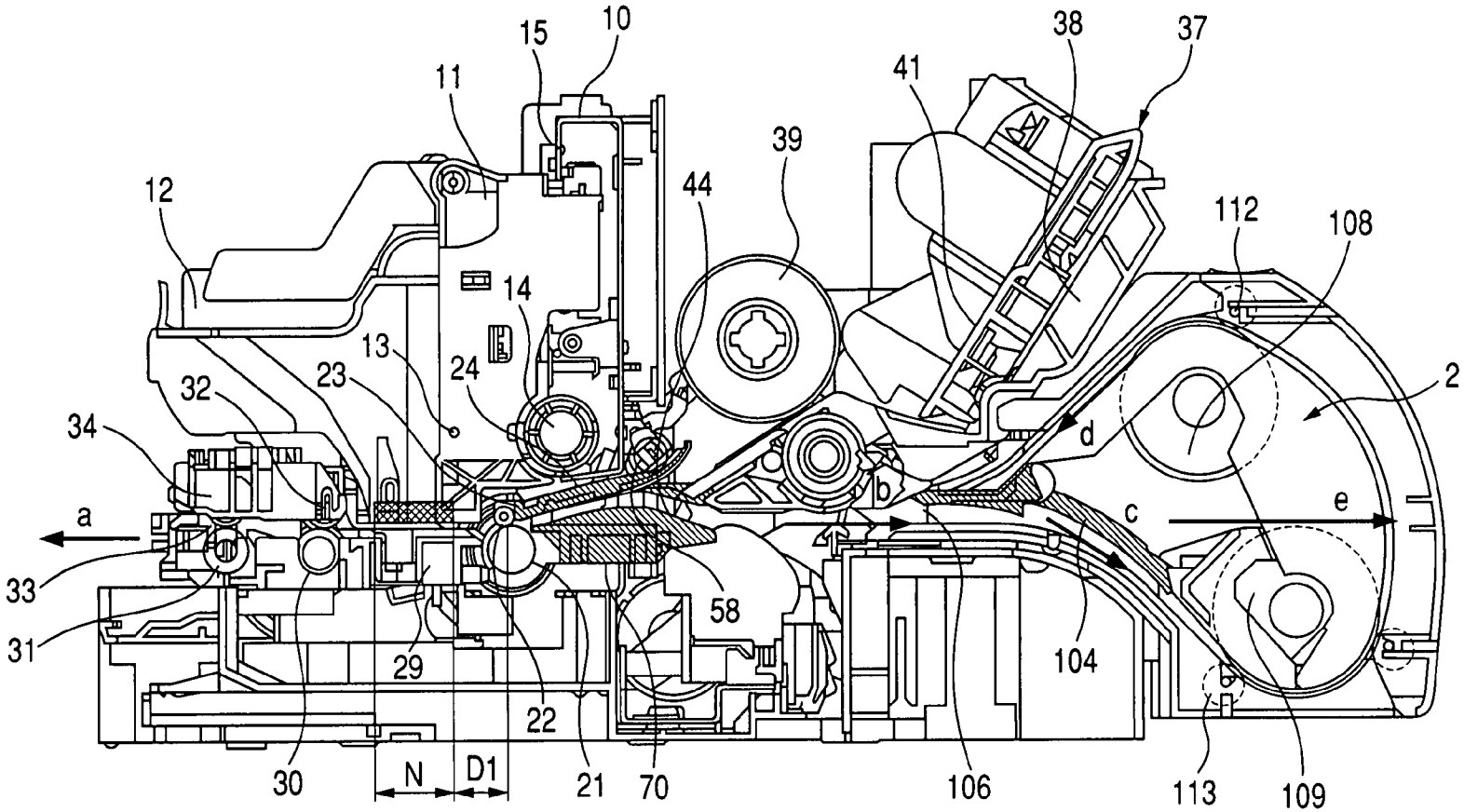
FIG. 2 is a schematic sectional side view showing an entire construction of the both-side recording apparatus according to the one embodiment of the present invention.

The present invention will be explained in detail hereinafter with reference to the drawings. The same reference numerals and characters show the same or the corresponding portions throughout the drawings. FIG. 1 is a schematic perspective view showing an entire construction of one embodiment of a recording apparatus to which the present invention is applied, and FIG. 2 is a schematic sectional side view showing the entire construction of the recording apparatus seen from the direction of the arrow A in FIG. 1. FIG. 1 and FIG. 2 show the case in which the recording apparatus is an ink jet recording apparatus for performing recording on a recording medium by discharging ink. As the recording medium, various materials can be used, such as paper, a plastic sheet, cloth, a metal sheet, or a plate member. In the following explanation, however, the recording sheet (recording paper) is a typical example of the recording medium, and therefore the term, recording sheet or sheet is used where the term, recording medium in a broad sense should be used, but this does not intend to limit the range of the recording medium to recording sheets or sheets.

In FIG. 1 and FIG. 2, reference numeral 1 denotes a recording unit body (recording apparatus body), reference numeral 2 denotes a sheet reversing section (an automatic both-side unit, an automatic reversing section), reference numeral 10 denotes a chassis for supporting a structure of the recording unit body 1, reference numeral 11 denotes a recording head as recording means for discharging ink to perform recording, reference numeral 12 denotes an ink tank for storing ink to be supplied to the recording head 11, reference numeral 13 denotes a carriage for holding the recording head 11 and the ink tank 12 to perform scanning (main scanning), reference numeral 14 denotes a guide shaft for guiding and supporting the carriage 13, reference numeral 15 denotes a guide rail for guiding and supporting the carriage 13 parallel with the guide shaft 14, reference numeral 16 denotes a carriage belt (timing belt) for driving the carriage 13, reference numeral 17 denotes a carriage motor for driving the carriage belt 16 through a pulley, reference numeral 18 denotes a cord strip for detecting the position of the carriage 13, and reference numeral 20 denotes an idler pulley opposed to the pulley of the carriage motor 17, for looping the carriage belt 16 over.

In FIG. 1 and FIG. 2, reference numeral 21 denotes a sheet feeding roller (conveying roller or conveying means) for feeding (conveying) the recording medium (recording sheet or sheet), reference numeral 22 denotes a pinch roller driven by being pressed by the sheet feeding roller 21, reference numeral 23 denotes a pinch roller holder for rotatably holding the pinch roller 22, reference numeral 24 denotes a pinch roller spring for bringing the pinch roller 22 into pressure contact with the sheet feeding roller 21, reference numeral 25 denotes a sheet feeding roller pulley fixed to the sheet feeding roller 21, reference numeral 26 denotes an LF motor (line feed motor, or drive means) for driving the sheet feeding roller 21, reference numeral 27 denotes a cord wheel for detecting an rotation angle of the sheet feeding roller 21, and reference numeral 29 denotes a platen opposed to the recording head 11 to support the recording sheet 4.

Reference numeral 30 is a first sheet discharging roller for conveying the recording sheet 4 in concert with the sheet feeding roller 21, reference numeral 31 denotes a second sheet discharging roller provided at a downstream side of the first sheet discharging roller 30, reference numeral 32 is a first spur train as a rotary body opposed to the first sheet discharging roller 30 and holding the recording medium, reference numeral 33 denotes a second spur train as a rotary body opposed to the second sheet discharging roller 31 and holding the recording medium, reference numeral 34 denotes a spur base for rotatably holding the first super train 32 and the second spur train 33, reference numeral 36 denotes a maintenance unit operated when ink discharge performance is maintained and restored by preventing clogging of the recording head 11 (clogging in a discharge port and a nozzle), and ink is spread over an ink passage of the recording head when the ink tank 12 is replaced, and reference numeral 37 denotes a main ASF (Automatic Sheet Feeder) as an automatic sheet supplying section loaded with the recording media and supplying the recording media to the recording section one by one at the time of recording operation.

In FIG. 1 and FIG. 2, reference numeral denotes an ASF base being a base of the main ASF 37, reference numeral 39 denotes a sheet supplying roller abutting to the loaded recording medium (recording sheet) to feed out the recording medium, reference numeral 40 is a separating roller for separating a plurality of recording sheets one by one when they are conveyed at the same time, reference numeral 41 denotes a pressure plate loaded with the recording sheet and biasing it toward the sheet supplying roller 39, reference numeral 42 denotes a side guide provided on the pressure plate 41 and fixable at an optional position in a width direction of the recording sheet, reference numeral 43 denotes a returning claw for returning a tip end of the recording sheet (recording medium) advancing ahead of nip portions of the sheet supplying roller 39 and the separating roller 40 to a predetermined position at the time of sheet supplying operation, and reference numeral 44 denotes an ASF flap for restricting the passing direction of the recording medium from the main ASF 37 to one direction.

Reference numeral 50 denotes a lift input gear meshed with an ASF planetary gear 49, reference numeral 51 denotes a lift decelerating gear train for transmitting power from the lift input gear 50 while decelerating the power, reference numeral 52 denotes a lift cam gear directly connected to a lift cam shaft, reference numeral 55 denotes a guide shaft spring for biasing the guide shaft 14 aside, reference numeral 56 denotes a guide slope surface on which a cam of a guide shaft gear 53 slides, reference numeral 58 denotes a lift cam shaft for lifting a pinch roller holder 23 and the like, reference numeral 70 denotes a sheet passing guide for guiding the tip end of the recording medium to nip portions of the sheet feeding roller 21 and the pinch roller 22, reference numeral 72 denotes a base for supporting the entire recording unit body 1, and reference numeral 301 denotes a control base plate for combining a control section (control means).

Figure 21:
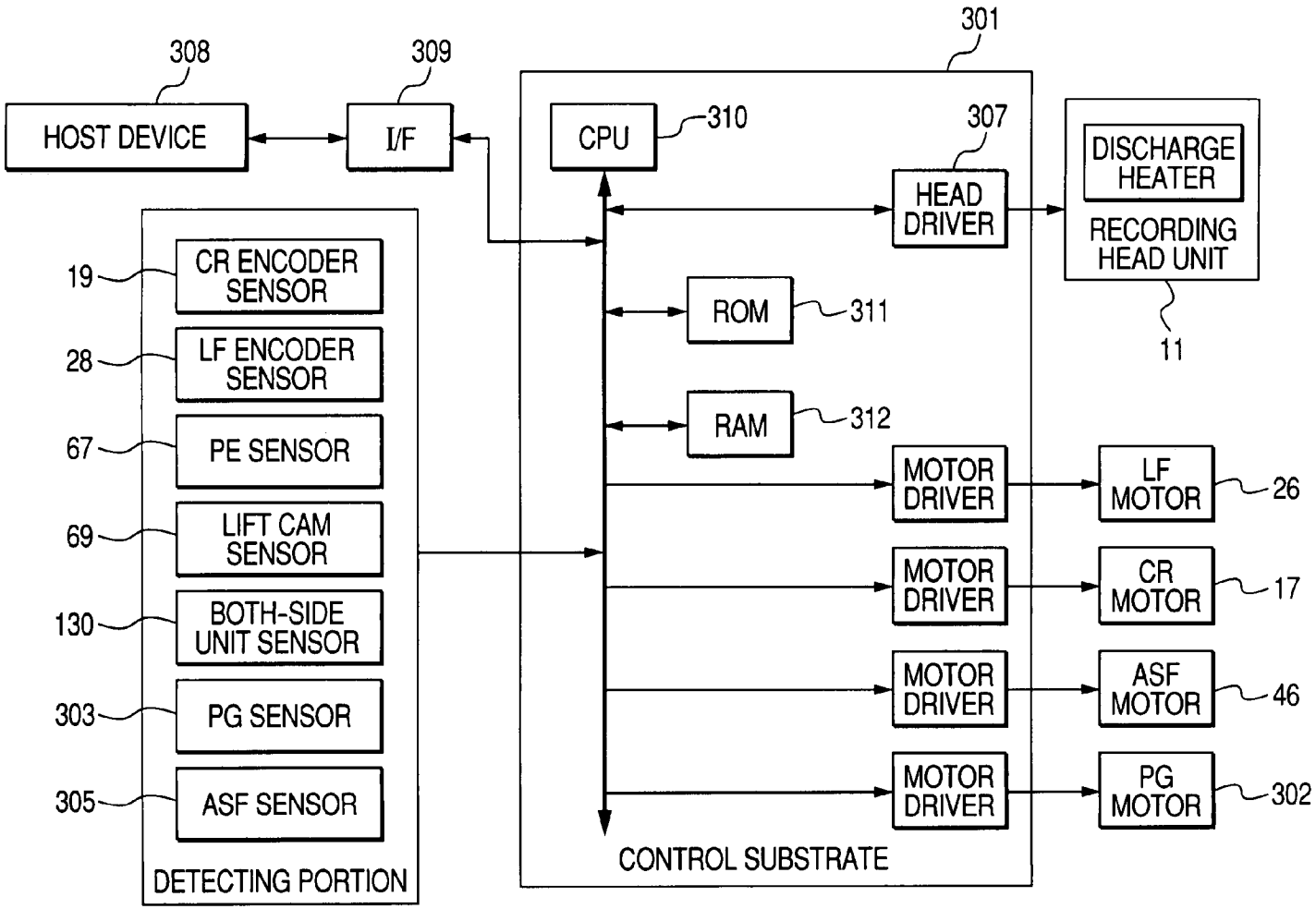
FIG. 21 is a schematic block diagram showing a control circuit construction of the both-side recording apparatus according to the one embodiment of the present invention.

FIG. 21 is a block diagram showing drive means for driving the entire recording apparatus to which the present invention is applied. In FIG. 21, reference numeral 19 denotes a CR (carriage) encoder sensor loaded on the carriage 13 and reading the code strip 18, reference numeral 28 denotes an LF encoder sensor for reading the code wheel 27 mounted to the chassis 1, reference numeral 46 denotes an ASF motor for driving the main ASF 37, reference numeral 67 denotes a PE (paper end) sensor for detecting the operation of a PE sensor lever 66, reference numeral 69 denotes a lift cam sensor for detecting the operation of the lift cam shaft 58, and reference numeral 130 denotes a sheet reversing section (both-side unit) sensor for detecting attaching and detaching of the sheet reversing section (automatic both-side unit) 2.

In FIG. 21, reference numeral 302 denotes a PG motor for driving the maintenance unit 36, reference numeral 303 denotes a PG sensor for detecting the operation of the maintenance unit 36, reference numeral 305 denotes an ASF sensor for detecting the operation of the main ASF 37, reference numeral 307 denotes a head driver for driving the recording head 11, reference numeral 308 denotes a host device for sending recording data to this recording apparatus, reference numeral 309 denotes an I/F (interface) for mediating to electrically connect the host device 308 and this recording apparatus, reference numeral 310 denotes a CPU for conducting a control of this recording apparatus and outputting a control command, reference numeral 311 denotes a ROM in which control data and the like are written, and reference numeral 312 denotes a RAM to be a region in which the recording data and the like are developed.

Here, referring to FIG. 1, FIG. 2 and FIG. 21, an outline of the recording apparatus according to the present invention will be explained, and thereafter, the operation of each section will be explained. First, a construction of an ordinary serial scanning type recording apparatus will be explained. The recording apparatus according to this embodiment is constructed by a sheet supplying section, a recording medium conveying section (sheet conveying section), a recording section, a recording means (recording head) maintenance section and the sheet reversing section (automatic reversing section, automatic both-side unit), when the recording apparatus is broadly divided. When the recording data is sent from the host device 308, and the data is stored on the RAM 312 through the interface (I/F) 309, the CPU 310 issues a recording operation starting command to start the recording operation.

When recording is started, the sheet supplying operation is performed first. The sheet supplying section is the main ASF (Automatic Sheet Feeder), and this sheet supplying section is constructed by the automatic sheet supplying section for drawing out the recording sheet one by one for each recording operation from the recording media (recording sheets) a plurality of which are loaded on the pressure plate 41 and sending the recording medium to the recording medium conveying section (sheet conveying section). At start of the sheet supplying operation, the ASF motor 46 is rotated in a forward direction, and its power drives the cam holding the pressure plate 41 through the gear train. When the cam is disengaged by the rotation of the ASF motor 46, the pressure plate 41 is biased toward the sheet supplying roller 39 by the action of the pressure plate spring not shown. At the same time, the sheet supplying roller 39 is rotated in the direction to convey the recording medium (sheet), and therefore the uppermost piece of the loaded recording medium starts to be conveyed. On this occasion, a plurality of number of recording sheets are sometimes fed out due to the conditions of the frictional force between the sheet supplying roller 39 and the recording sheets 4, and the frictional force between the recording sheets.

In this case, the separating roller 40, which the sheet supplying roller 39 contacts with pressure and which has predetermined return rotation torque in the reverse direction from the recording sheet conveying direction, works, and this separating roller 40 works to push back the recording sheets other than the nearest recording sheet to the sheet supplying roller 39 onto the pressure plate. When the ASF sheet supplying operation is finished, the separating roller 40 is released from the state of pressure contact with the sheet supplying roller 39 by the operation of the cam, and is spaced at a predetermined distance, and on this occasion, in order to push back the recording sheets into a predetermined position on the pressure plate, the returning claw 43 rotates and plays a part in this. Only one recording sheet is conveyed to the sheet conveying section by the operation as described above.

When one recording sheet is conveyed from the main ASF 37, the tip end of the recording sheet abuts to the ASF flap 44 biased in the direction to interfere with the sheet passing path by the ASF flap spring, but the tip end of the recording sheet pushes away the ASF flap 44 and passes. When the recording operation of the recording sheet is finished, and a rear end of the recording sheet passes the ASF flap 44, the ASF flap 44 returns to the original biased state and the sheet passing path is closed, and therefore the recording sheet does not return to the side of the main ASF 37 even if the recording sheet is conveyed in the reverse direction.

The recording sheet 4 as the recording medium, which is conveyed from the sheet supplying section, is conveyed to the nip portion of the sheet feeding roller (conveying roller) 21 being the sheet conveying section (recording medium conveying section) and the pinch roller 22. A center of the pinch roller 22 is mounted with a little offset in the direction to approach the first sheet discharging roller 30 with respect to a center of the sheet feeding roller 21, and therefore the tangential direction angle at which the recording sheet is inserted is slightly inclined from horizontality. Therefore, the sheet (recording sheet) is conveyed by being angled by the sheet passing path formed by the pinch roller holder 23 and the guide member (sheet passing guide) 70 so that the tip end of the sheet is properly guided to the nip portion.

The sheet (recording sheet) conveyed (fed, supplied) by the ASF 37 is butted to the nip portion of the sheet feeding roller 21 in a stopped state. At this time, the recording sheet is conveyed longer distance than predetermined length of the sheet passing path by the main ASF 37, and thereby a loop of the sheet is formed between the sheet supplying roller 39 and the sheet feeding roller 21. The tip end of the sheet is pressed by the nip portion of the sheet feeding roller 21 with the force of the loop to return to straight, whereby the tip end of the sheet becomes parallel following the roller 21, and a so-called registration operation is completed. After the registration operation is completed, the rotation (the rotation in the forward direction) of the LF motor 26 (conveying motor) is started in the direction in which the recording sheet moves in the forward direction (direction to advance toward the first sheet discharging roller 30).

Thereafter, the sheet supplying roller 39 has its driving force cut off, and freely runs with the recording sheet. At this point of time, the recording sheet is conveyed by only the sheet feeding roller 21 and the pinch roller 22. The recording sheet advances in the forward direction for each predetermined line feeding amount, and travels along a rib provided at the platen 29. The tip end of the sheet is gradually caught in the nip portion of the first sheet discharging roller 30 and the first spur train 32, and the nip portion of the second sheet discharging roller 31 and the second spur train 33. However, since the circumferential speeds of the first sheet discharging roller 30 and the second sheet discharging roller 31 are set to be approximately equal to the circumferential speed of the sheet feeding roller 21, and the sheet feeding roller 21, the first sheet discharging roller 30 and the second sheet discharging roller 31 are connected with the gear train, the first sheet discharging roller 30 and the second sheet discharging roller 31 are rotated synchronously with the sheet feeding roller 21, and therefore the recording sheet 4 is conveyed without being loosened or pulled.

The recording section is constituted mainly of the recording head 11 as the recording means, and the carriage 13 loaded with the recording head 11 and scanning (moving) in a direction intersecting (usually, orthogonal to) the recording sheet conveying direction. The carriage 13 is guided and supported by the guide shaft 14 fixed to the chassis 10 and the guide rail 15 which is a part of the chassis 10, and is reciprocally moved (scanned) by the drive force of the carriage motor 17 being transmitted through the carriage belt 16 laid between the carriage motor 17 and the idler pulley 20.

A plurality of ink passages connected to the ink tank 12 are formed in the recording head 11, and the ink passages communicates with a discharge port placed in a surface (discharge port surface) opposed to the platen 29. An actuator (energy generating means) for discharging ink is placed in an internal portion of each of the plurality of discharge ports forming a discharge port train. As the actuator, for example, the one utilizing film boiling pressure of liquid by an electrothermal converter (heat generating element), an electromechanical transducer (electricity-pressure converting element) such as a piezo element and the like are used.

In the ink jet recording apparatus using the recording head 11 as described above as the recording device, it is possible to discharge an ink drop in accordance with the recording data by transmitting a signal of the head driver 307 to the recording head 11 through a flexible flat cable 73. The ink drop can be discharged to the recording sheet in a proper timing by reading the cord strip 18 laid across the chassis 10 by the CR (carriage) encoder 19 loaded on the carriage 13. In this manner, when the recording corresponding to one line is finished, the recording sheet is conveyed (sheet feeding) by a required amount by the aforesaid sheet conveying section (recording medium conveying section). By repeatedly carrying out this operation, the recording operation for the entire surface of the recording sheet is enabled.

The recording head maintenance section (maintenance unit) 36 is for maintaining and restoring the recording operation of the recording head 11 as the recording means in and to the normal state by preventing clogging of the discharge ports of the recording head 11, and by eliminating contamination of the discharge port surface of the recording head 11 due to paper particles and the like. The aforesaid recording head maintenance section 36 also has a function of sucking ink when the ink tank 12 is replaced. Therefore, the maintenance unit 36, which is placed to opposed to the recording head 11 in the home position (standby position) of the carriage 13, is constructed by a capping mechanism including a cap abutting to a discharge port surface (the surface on which the discharge ports are arranged) of the recording head 11 to protect the discharge ports, a suction restoring mechanism for generating vacuum inside the cap which caps the discharge port and sucking and discharging the ink from the discharge port, a wiping mechanism for wiping and cleaning a peripheral portion of the discharge port, and the like, for example.

Namely, when the ink is sucked out to refresh the ink inside the discharge ports of the recording head 11, the cap is pressed onto the discharge port surface, and the suction pump is driven to create negative pressure inside the cap, thereby sucking and discharging the ink. In order to remove the ink and foreign matters when the ink attaches to the discharge port surface after the ink is sucked, and when the foreign matters such as paper particles attach to the discharge port surface, the discharge port surface is wiped (wiping cleaning) by making the wiper abut to the discharge port surface and moving the wiper in parallel, and thereby the attached substances are removed. The outline of the recording apparatus is as described above.

The construction peculiar to this embodiment including the construction of the sheet reversing section (the automatic both-side unit as the automatic reversing section) 2 will be explained in detail next. The recording apparatus according to this embodiment is characterized by being capable of so-called automatic both-side recording for performing automatic recording onto a front and a back of the recording sheet constituted of cut paper in a sheet shape without the service of the operator. First, using FIG. 2, a passing route of the recording medium (recording sheet) will be explained. In FIG. 2, reference numeral 104 denotes a switching flap constituted of a movable flap rotatably supported to determine the sheet passing direction of the recording sheet, reference numeral 106 denotes an outlet port flap rotatably supported and opening and closing when the recording sheet goes out of the sheet reversing section 2, reference numeral 108 denotes a both-side roller A as a reversing section roller or reversing and conveying means for conveying the recording sheet (recording medium) along the reversing path in the both-side unit 2 as the sheet reversing section, reference numeral 109 denotes a both-side roller B as a reversing section roller for conveying the recording sheet in the both-side unit 2 as the sheet reversing section, reference numeral 112 denotes a reversing section pinch roller (a both-side pinch roller) A driven following the both-side roller A108, and reference numeral 113 denotes a reversing section pinch roller (a both-side pinch roller) B driven following the both-side roller B109.

When the recording operation is started, the recording sheet is supplied one by one by the operation of the sheet supplying roller 39 from a plurality of recording sheets loaded on the main ASF 37, and is fed (conveyed) to the sheet feeding roller 21. The recording sheet nipped by the sheet feeding roller 21 and the pinch roller 22 is conveyed in the direction of the arrow a in FIG. 2. When both-side recording is carried out, the recording sheet is conveyed in the direction of the arrow b in FIG. 2 in a horizontal path provided under the main ASF 37 after the front surface recording is finished. The both-side unit 2 as the sheet reversing section is disposed behind the main ASF 37, and therefore the recording sheet is guided into the both-side unit 2 from the horizontal path and conveyed in the direction of the arrow c in FIG. 2.

In the both-side unit 2, the recording sheet is nipped by the both-side roller B109 and the both-side pinch roller B113 and reverses the traveling direction, then is further nipped by the both-side roller A108 and the both-side pinch roller A112 and conveyed in the direction of the arrow d in FIG. 2, and finally changes the traveling direction by 180 degrees (reverses) to return to the horizontal path. The recording sheet conveyed in the direction of the arrow a in FIG. 2 in the horizontal path is nipped by the roller 21 and the pinch roller 22 again, and recording on the back surface is carried out. As described above, the recording sheet after finishing the front surface (the front side) recording is reversed from the front to the back by the horizontal path under the main ASF 37 and the sheet reversing section 2 behind the main ASF 37, and is subjected to recording on the back surface again, whereby recording is automatically carried out on the front surface and the back surface.

Here, the recording range at the time of recording the front surface (the first surface, the front side) will be explained. The recording head 11 as the recording means has a discharge port region (recording region, ink discharge region) N between the sheet feeding roller 21 and the fist sheet discharging roller 30, but it is usually difficult to dispose the discharge region N near the nip portion of the sheet feeding roller 21 for the reason of placement of the ink passage to the discharge ports, for the reason of wiring to the actuator (discharge energy generating means) for discharging the ink, and the like. Therefore, in the range in which the recording sheet is nipped by the sheet feeding roller 21 and the pinch roller 22, recording cannot be performed only in the range up to a portion spaced from the nip portion of the sheet feeding roller 21 to the downstream side by the length D1 shown in FIG. 2.

In order to reduce the front surface lower end blank region, in the recording apparatus according to this embodiment, recording is continued until the recording sheet is released from the nip portion of the sheet feeding roller 21 and is nipped and conveyed only by the first sheet discharging roller 30 and the second sheet discharging roller 31. As a result, the recording operation becomes possible until the front surface lower end blank becomes zero. However, when the recording sheet is to be transferred in the direction of the arrow b in the aforementioned FIG. 2 from this state, the recording sheet cannot (or is difficult to) be led (guided) to the nip portion of the sheet feeding roller 21 and the pinch roller 22, and there is the possibility that so-called sheet jam occurs. In this embodiment, in order to avoid such sheet jam, the pinch roller 22 is released (spaced) from the sheet feeding roller 21 by the means explained below to make a predetermined clearance, and after the recording sheet end portion is drawn into the clearance, the pinch roller 22 is brought into pressure contact with the sheet feeding roller 21, thereby making it possible to convey the recording sheet in the direction of the arrow b in FIG. 2.

Next, a release mechanism of the pinch roller 22, a release mechanism of the sheet detection lever (the PE sensor lever, the paper end sensor lever) 66, a pressure adjusting mechanism of the pinch roller spring 24, an raising and lowering mechanism of the guide member (sheet guide) 70, and an raising and lowering mechanism of the carriage 13 will be explained next. As described above, the pinch roller 22 is operated to release (disengage, separate) from the sheet feeding roller 21 to draw the recording sheet as the recording medium again, and in order to reverse the front side and the back side of the recording sheet after the recording sheet is drawn again, several mechanisms are provided other than this.

One of the mechanisms is the release mechanism of the PE sensor lever 66 as the sheet detection lever. The ordinary PE sensor lever 66 is mounted to oscillate at a predetermined angle with respect to the surface of the recording sheet in order to be able to detect the positions of the tip end and the rear end of the recording sheet accurately when the recording sheet travels in the forward direction. Since the PE sensor lever 66 is thus set, there is the technical problem that the end portion of the recording sheet is caught thereby or the tip end of the PE sensor lever 66 bites the recording sheet which is being conveyed when the sheet travels in the reverse direction. Therefore, in this embodiment, the PE sensor lever 66 is released from the sheet surface until the midpoint of the front and back reversing process of the recording sheet (recording medium), so that the PE sensor lever 66 does not abut to the recording sheet.

It is possible to replace the release mechanism of the above-described PE sensor lever 66 with the other means or component. In other words, as the means for solving the aforementioned technical problem, it may be suitable to adopt the means for solving the above-described technical problem by providing a roller or the like at the tip end of the PE sensor lever 66 so that the roller rotates even when the recording sheet travels in the reverse direction. It may be suitable to adopt the means for solving the aforementioned technical problem by taking a large oscillation angle of the PE sensor lever 66 so that the PE sensor lever 66 oscillates to the angle in the reverse direction from usually when the recording sheet is conveyed in the reverse direction.

Another mechanism is the pressure adjusting mechanism of the pinch roller spring 24, namely, the pressure adjusting mechanism for varying the pressure (spring force) which brings the pinch roller 22 into pressure contact with the sheet feeding roller 21. In this embodiment, in order to release (separate) the pinch roller 22, the pinch roller 22 is released by rotating the entire pinch roller holder 23. The pinch roller holder 23 is pressed with the pinch roller spring 24 in the state in which the pinch roller 22 is in pressure contact with the sheet feeding roller 21, and therefore when the pinch roller holder 23 is rotated in the release direction, the pressure of the pinch roller spring 24 varies to increase, thus causing harmful effects such as an increase in load for releasing the pinch roller holder 23 and an increase in stress exerted on the pinch roller holder 23 itself. In order to prevent this, the mechanism (pressure adjusting mechanism), which decreases the pressure of the pinch roller spring 24 when the pinch roller holder 23 is released, is provided.

Another mechanism is the raising and lowering mechanism for the sheet passing guide 70. In order to guide the recording sheet supplied from the main ASF 37 to the sheet feeding roller 21, the sheet passing guide 70 is usually located at a place slightly angled upward from the horizontal path (the state shown in FIG. 2) so that the recording sheet is smoothly guided to the nip portion of the LF roller 21 slightly angled from horizontality as described above. However, as it is, when the recording sheet is conveyed in the direction of the arrow b in FIG. 2, the recording sheet is guided toward the main ASF 37 again, and therefore it is preferable to change the angle of the sheet passing guide 70 to be horizontal so as to prevent this and to be able to guide to the horizontal path smoothly. As a result, the raising and lowering mechanism for moving the sheet passing guide 70 as the guide member up and down is provided.

The last mechanism is the raising and lowering mechanism for the carriage 13. This is for preventing the pinch roller holder 23 and the carriage 13 from abutting to each other and the carriage 13 from being unmovable in the main scanning direction since the tip end of the pinch roller holder 23 approaches the carriage 13 when the pinch roller holder 23 is in the release state (the state in which the pinch roller holder 23 is spaced from the paper feeding roller 21). Therefore, the raising and lowering mechanism, which raises the carriage 13 synchronously with the release operation of the pinch roller holder 23, is provided. The raising and lowering mechanism for this carriage 13 can be applied to the other use purpose, and it can be used, when the recording head 11 is moved for the purpose of retreating the recording head 11 so that the recording head 11 as the recording means and the recording medium do not contact each other when recording is performed on the thick recording medium.

Figure 3:
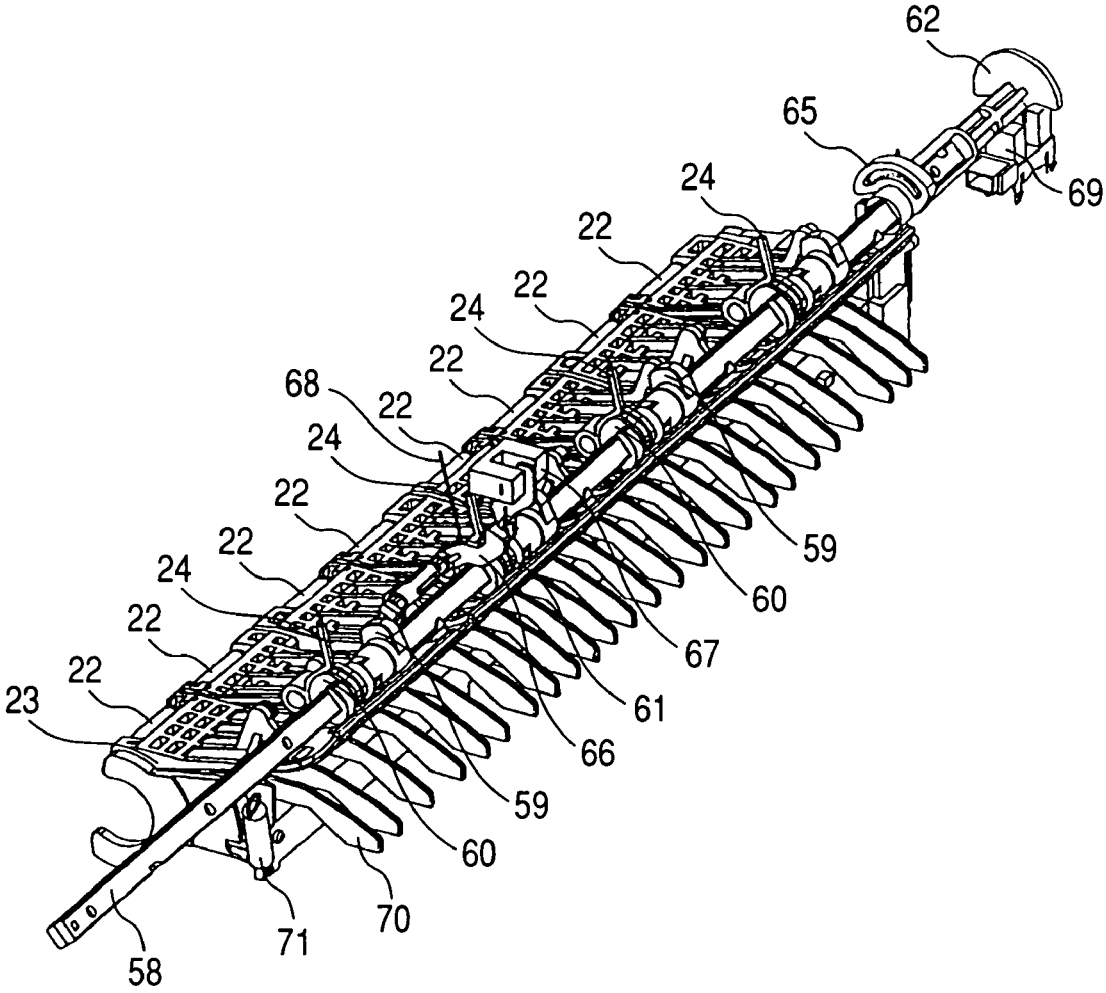
FIG. 3 is a schematic perspective view showing a pinch roller contacting with pressure and separating mechanism of the both-side recording apparatus according to the one embodiment of the present invention.

The aforementioned five mechanisms (the release mechanism of the pinch roller 22, the release mechanism of the PE sensor lever 66, the pressure adjusting mechanism of the pinch roller spring 24, the raising and lowering mechanism for the sheet passing guide 70, the raising and lowering mechanism for the carriage 13) will be explained in detail. FIG. 3 is a schematic perspective view showing a general construction of the pinch roller release mechanism, the PE sensor lever release mechanism, the pinch roller spring pressure adjusting mechanism, and the sheet passing guide raising and lowering mechanism.

In FIG. 3, reference numeral 59 denotes a pinch roller holder pressing cam for abutting to the pinch roller holder 23, reference numeral 60 denotes a pinch roller spring pressing cam being the point of action of the pinch roller spring 24, reference numeral 61 denotes a PE sensor lever pressing cam for abutting to the PE sensor lever 66, reference numeral 62 denotes a lift cam shaft masking shield indicating the angle of the lift cam shaft 58, reference numeral 65 denotes a sheet passing guide pressing cam for abutting to the sheet passing guide 70, reference numeral 66 denotes the PE sensor lever as the recording medium contacting the recording sheet and detecting the tip end and the rear end, reference numeral 67 denotes a PE (paper end) sensor transmitted/shielded by the PE sensor lever 66, reference numeral 68 denotes a PE sensor lever spring for biasing the PE sensor lever 66 in a predetermined direction, reference numeral 69 denotes a lift cam sensor transmitted/shielded by the lift cam shaft masking shield 62, and reference numeral 71 denotes a sheet passing guide spring for biasing the sheet passing guide 70 in a predetermined direction.

The pinch roller release mechanism, the PE sensor lever release mechanism, the pinch roller spring pressure adjusting mechanism and the sheet passing guide raising and lowering mechanism are operated by the rotation of the lift cam shaft 58. In the mechanism of this embodiment, the pinch roller holder pressing cam 59, the pinch roller spring pressing cam 60, the PE sensor lever pressing cam 61 and the sheet passing guide pressing cam 65 are respectively fixed to the lift cam shaft 58, and therefore the respective cams are operated in synchronism with one rotation of the lift cam shaft 58. Here, the initial angle and one rotation of the lift cam shaft 58 are recognized by the lift cam shaft masking shield 62 shields or transmits the lift cam sensor 69. The spirit of the present invention is not limited to the above construction, and a mechanism for individually driving each of them may be adopted.

Figure 4A:
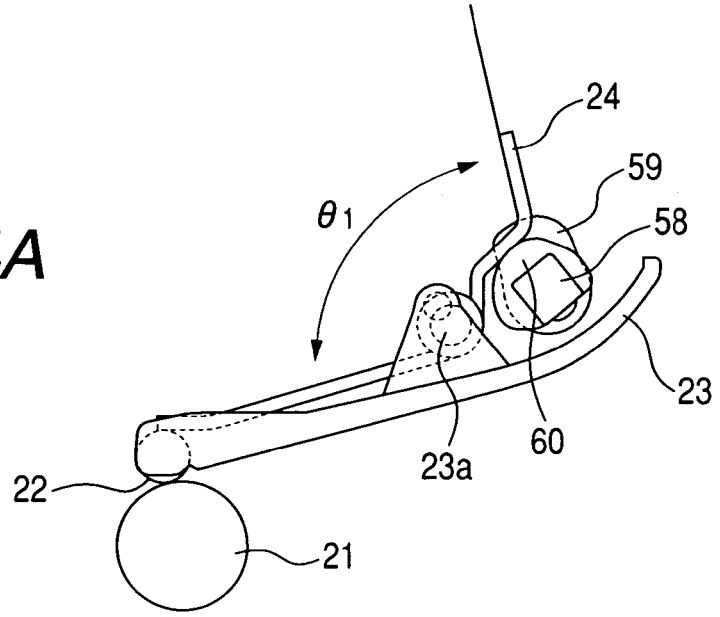
FIGS. 4A, 4B and 4C are schematic sectional side views showing a pinch roller contacting with pressure and separating mechanism of the both-side recording apparatus according to the one embodiment of the present invention.
Figure 4B:
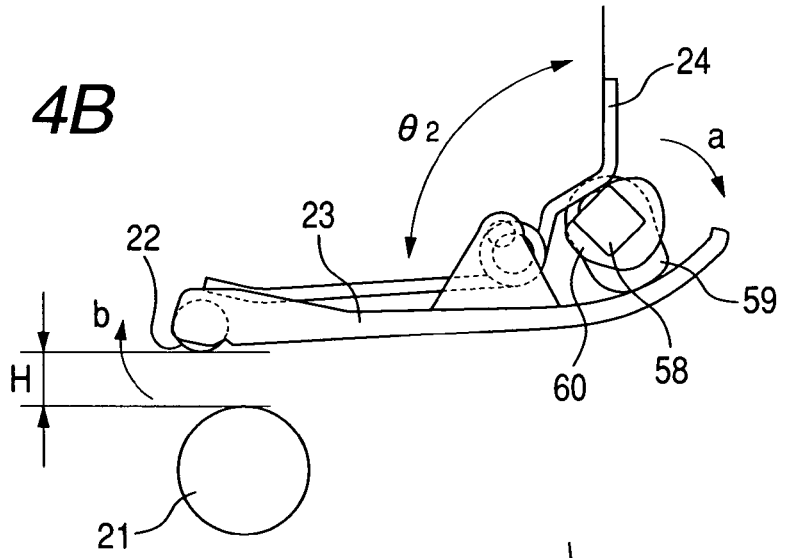
Figure 4C:
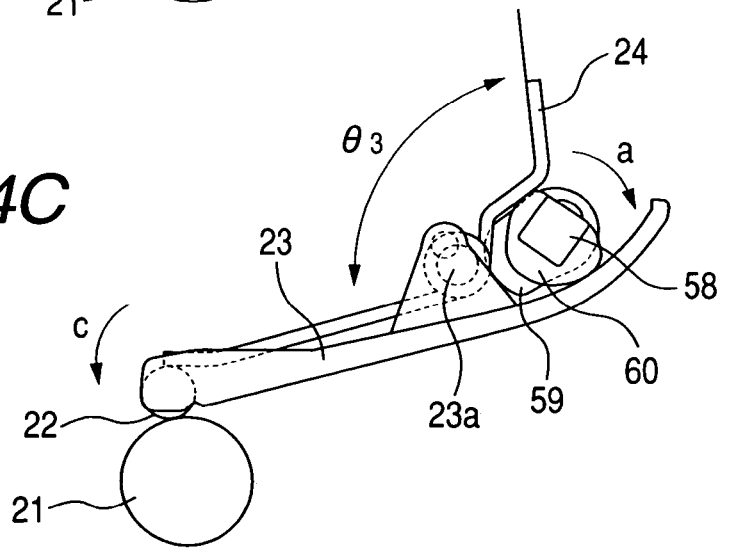

Next, the operation of each mechanism will be explained. FIGS. 4A, 4B and 4C are partial side views schematically showing the operations of the pinch roller release mechanism and the pinch roller spring pressure adjusting mechanism. FIG. 4A shows the case where the pinch roller pressing cam 59 is at an initial position, the pinch roller 22 is in pressure contact with the sheet feeding roller 21, and the pressure of the pinch roller spring 24 is in a standard state. The pinch roller holder 23 is rotatably supported at the pinch roller holder shaft 23*a* by the bearing portion of the chassis 10, and is swingable over the range of a predetermined angle. The pinch roller 22 is rotatably supported at one end of the pinch roller holder 23, and a region which abuts to the pinch roller holder pressing cam 59 is provided at the other end.

In FIG. 4A, the pinch roller spring 24 is a helical torsion spring with its one end abutting to the pinch roller holder 23 at the side of the pinch roller 22 as the power point, the other end supported by the pinch roller spring pressing cam 60, and its spring intermediate portion supported by the support portion of the chassis 10. By such a supporting form (initial state), the pinch roller 22 is in contact with pressure with the sheet feeding roller 21. When the rotation driving mechanism of the sheet feeding roller 21 is operated in this state, the recording sheet nipped by the nip portion of the sheet feeding roller 21 and the pinch roller 22 can be conveyed.

FIG. 4B shows the case where the pinch roller 22 is released (separated) and the pinch roller spring 24 is in a force release state. In other words, as a result that the lift cam shaft, 58 rotates in the direction of the arrow a in FIG. 4B, the pinch roller holder pressing cam 59 abuts to the pinch roller holder 23, then the pinch roller holder 23 is gradually rotated in the direction of the arrow b in FIG. 4B, and the pinch roller 22 is released (separated or isolated) from the sheet feeding roller 21. In the state in FIG. 4B, the abutting surface of the pinch roller spring pressing cam 60 to the pinch roller spring 24 is a small radius portion, and a twist angle θ2 is more opened (larger) than an angle θ1 in FIG. 4A. Therefore, spring load is reduced, and the load is hardly applied onto the pinch holder 23. As a result, stress is hardly applied onto the pinch roller holder 23. In this state, a predetermined amount of clearance H is formed between the sheet feeding roller 21 and the pinch roller 22, and it is possible to easily insert the tip end of the recording sheet into the nip portion even if it is roughly guided.

FIG. 4C shows the case where the pinch roller 22 is in contact with pressure with the sheet feeding roller 21 as in FIG. 4A, but it is in the state in contact with light pressure with weak contact pressure. In the state of FIG. 4C, the lift cam shaft 58 is further rotated in the direction of the arrow a in FIG. 4C, whereby abutment of the pinch roller holder pressing cam 59 and the pinch roller holder 23 is released, then the pinch roller holder 23 is rotated in the direction of the arrow c in FIG. 4C to return to the original state, and the abutting surface of the pinch roller spring pressing cam 60 to the pinch roller spring 24 have the middle radius between the case of FIG. 4A and the case of FIG. 4B.

As a result, a twist angle θ3 of the pinch roller spring 24 is slightly less (smaller) than the angle θ1 in FIG. 4A, and therefore the force to bring the pinch roller 22 into pressure contact with the sheet feeding roller 21 is slightly less (smaller). According to such a construction, when a thicker recording sheet than usual is nipped between the sheet feeding roller 21 and the pinch roller 22, the twist angle of the pinch roller spring 24 becomes larger than usual, and thereby the load occurring to the pinch roller holder 23 can be prevented from being large. Therefore, either in the case of the recording sheet of normal thickness, or in the case of the thick recording medium, the rotation load by the axial loss of the sheet feeding roller 21 can be leveled. When the lift cam shaft 58 is turned one turn through the above described states, the pinch roller release mechanism and the pinch roller spring pressure adjusting mechanism return to the state in FIG. 4A to be in the standard state.

Figure 5A:
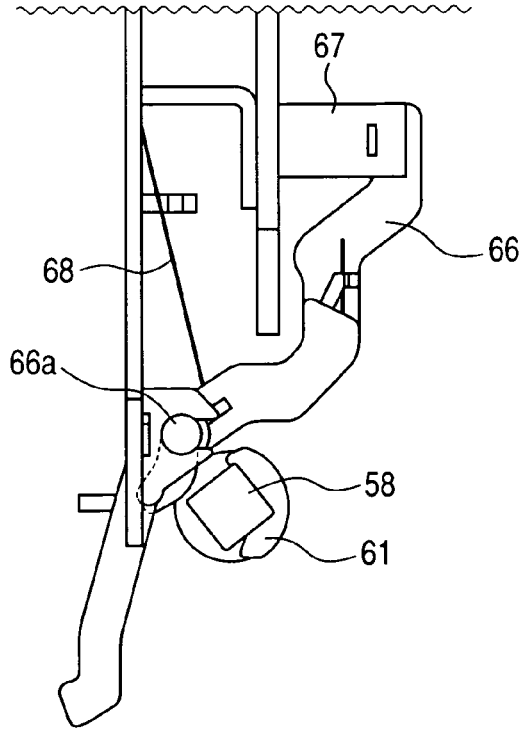
FIGS. 5A and 5B are schematic sectional side views showing a PE sensor raising and lowering mechanism of the both-side recording apparatus according to the one embodiment of the present invention.
Figure 5B:
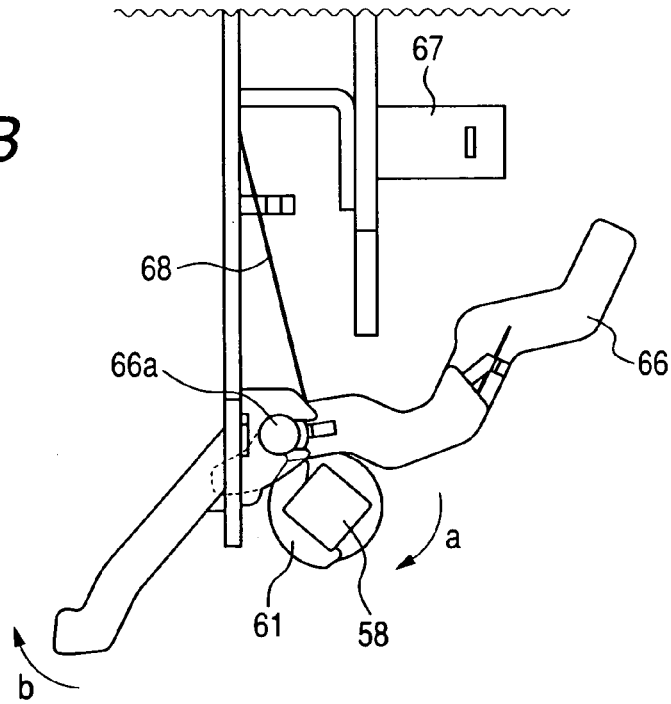

FIGS. 5A and 5B are partial side views schematically showing an operation of the PE sensor lever raising and lowering mechanism. FIG. 5A shows the case where the PE sensor lever pressing cam 61 is at the initial position, and the PE sensor lever (sheet detecting lever) 66 is in the free state. The PE sensor lever 66 is rotatably supported by its PE sensor lever shaft 66*a* borne at the bearing portion of the chassis 10. In the state in FIG. 5A, the PE sensor lever 66 is biased to the position shown in the drawing by the action of the PE sensor lever spring 68, and the shielding plate portion of the PE sensor lever 66 shields the PE sensor 67. When the recording sheet passes the region of the PE sensor lever 66 from this state, the PE sensor lever 66 rotates in the clockwise direction in FIG. 5A, and the PE sensor 67 is in the permeation state, thus making it possible to detect the existence of the recording sheet. In this light shielding and permeating state, the tip end and the rear end of the recording medium (recording sheet) can be detected.

FIG. 5B is a partial side view schematically showing the state in which the PE sensor lever 66 as the sheet detecting lever is locked. In FIG. 5B, the PE sensor lever pressing cam 61 is rotated in the direction of the arrow a, whereby a cam follower portion of the PE sensor lever 66 is pushed up and rotated in the direction of the arrow b. In this state, the sheet detecting portion of the PE sensor lever 66 hides inside from the pinch roller holder 23, and even when the recording sheet is on the passage path, the recording sheet and the PE sensor lever 66 do not abut to each other. Therefore, even if the recording sheet is conveyed in the direction of the arrow b in FIG. 2, it never happens that the recording sheet hits on the PE sensor lever 66 and jams.

Figure 6A:
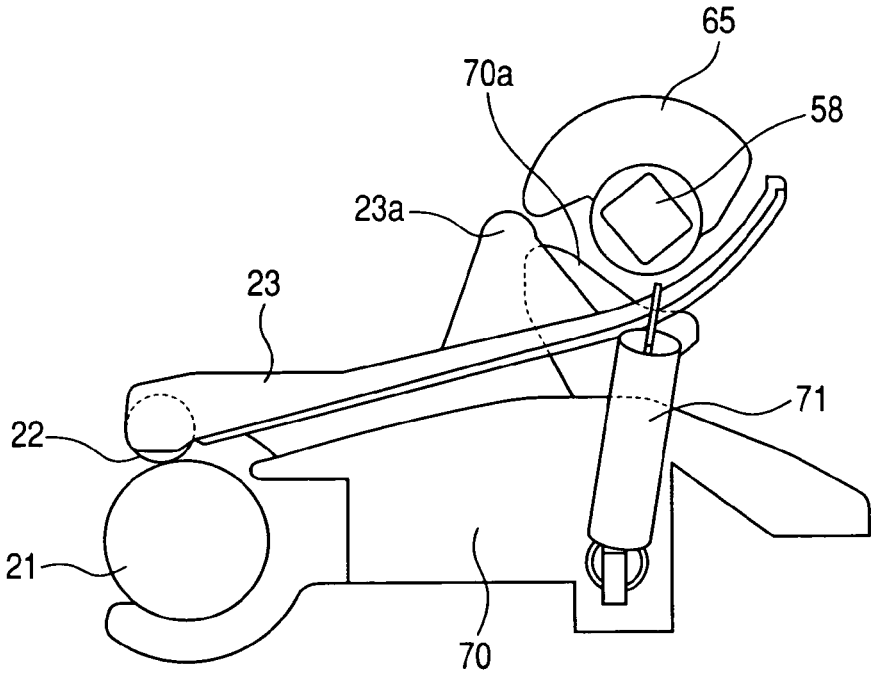
FIGS. 6A and 6B are schematic sectional side views showing a sheet passing guide raising and lowering mechanism of the both-side recording apparatus according to the one embodiment of the present invention.
Figure 6B:
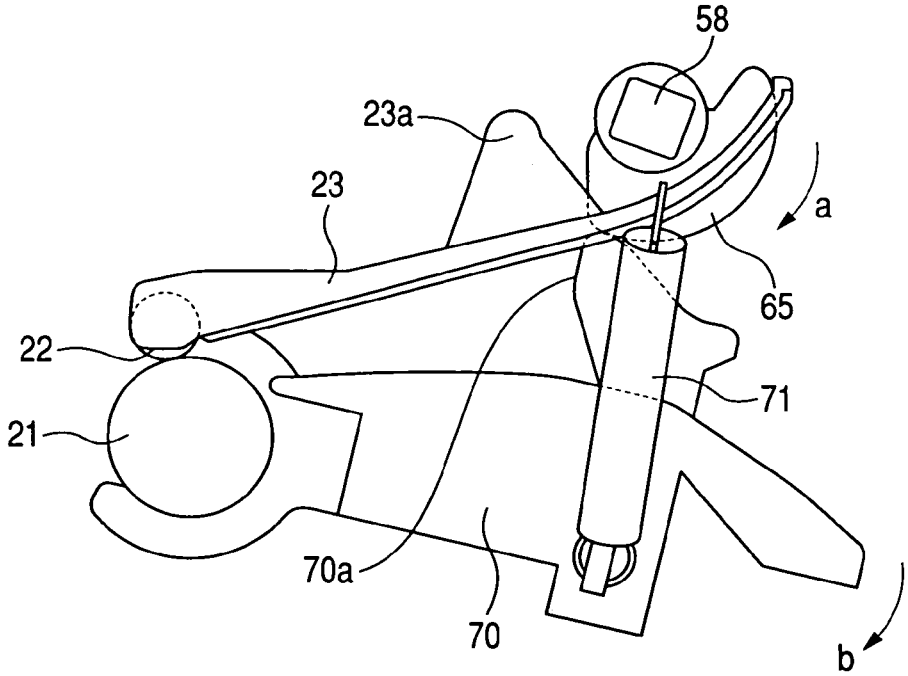

FIGS. 6A and 6B are partial side views schematically showing the operation of the sheet passing guide raising and lowering mechanism. FIG. 6A shows the case where the sheet passing guide 70 as the guide member is in an up state. In FIG. 6A, the sheet passing guide 70 is usually biased in the direction in which the sheet passing guide 70 is lifted up by the sheet passing guide spring 71, and its position (raised position, up position) is determined by butting against a stopper not shown. When the recording sheet supplied from the main ASF passes, the sheet passing guide 70 keeps this attitude (up state) by the action of the sheet passing guide spring 71 as the elastic member. However, when a larger force than usual is exerted, the sheet passing guide 70 can go down (in the down state) against the spring force of the sheet passing guide spring 71.

FIG. 6B shows the case where the sheet passing guide 70 is in the down state. In FIG. 6B, the sheet passing guide pressing cam 65 fixed to the lift cam shaft 58 is rotated in the direction of the arrow a in FIG. 6B, and thereby the sheet passing guide pressing cam 65 abuts to the sheet passing guide cam follower portion 70*a* which is a part of the sheet passing guide 70 and gradually pressing the sheet passing guide cam follower portion 70*a*. As a result, the sheet passing guide 70 is rotated in the direction of the arrow b in FIG. 6B, and is pushed down against the spring force of the sheet passing guide spring 71. In this state, a portion of the sheet passing guide 70, which faces the sheet passing path becomes approximately horizontal, and the sheet passing path becomes approximately completely straight. As a result, when the sheet is conveyed in the direction of the arrow b by the sheet feeding roller 21 in FIG. 2, the recording sheet is conveyed horizontally, and it never happens that the portion of the recording sheet front surface (the front side, the first surface) on which recording is already performed is pressed against the upper portion of the sheet passing path.

Figure 7:
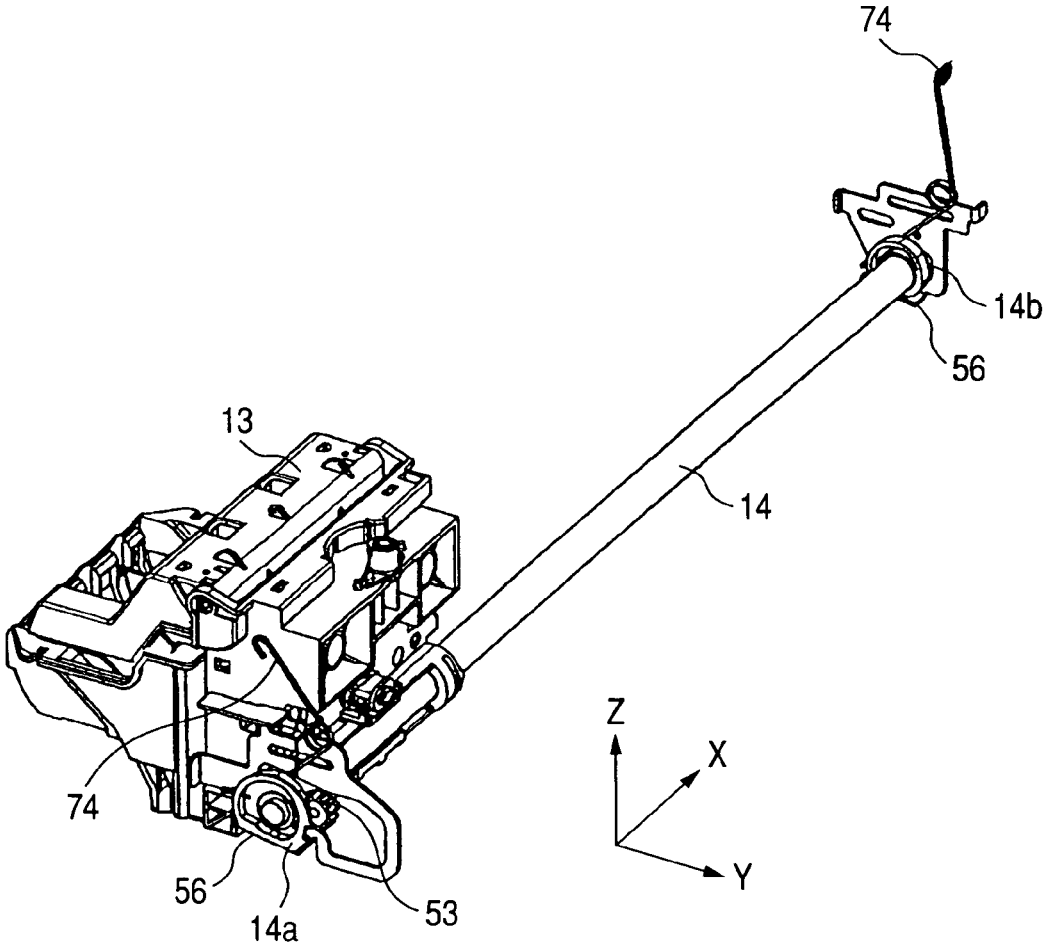
FIG. 7 is a schematic perspective view showing a guide shaft raising and lowering mechanism of the both-side recording apparatus according to the one embodiment of the present invention.

FIG. 7 is a schematic perspective view showing the carriage raising and lowering mechanism. In FIG. 7, reference numeral and character 14*a* denotes a right guide shaft cam mounted to the guide shaft 14, reference numeral and character 14*b* denotes a left guide shaft cam mounted to the guide shaft 14, and reference numeral 53 denotes a cam idler gear for connecting the lift cam gear 52 and a gear portion of the right guide shaft cam 14*a*. The guide shaft 14 is supported at both the side surfaces of the chassis 10 as shown in FIG. 1, the guide shaft 14 fitted into a guide long hole in the vertical direction not shown, and the guide shaft 14 can move freely in the direction of the arrow Z in FIG. 7, but is restricted in the movement in the directions of the arrows X and Y in FIG. 7.

In the mechanism shown in FIG. 7, the guide shaft 14 is usually biased downward (the opposite direction to the arrow Z) by the guide shaft spring 74, but when the cam idler gear 53 rotates, the right guide shaft cam 14*a* and the left guide shaft cam 14*b* abut to the guide slope 56, and thereby the guide shaft 14 moves in the up and down direction while rotating.

Figure 8A:
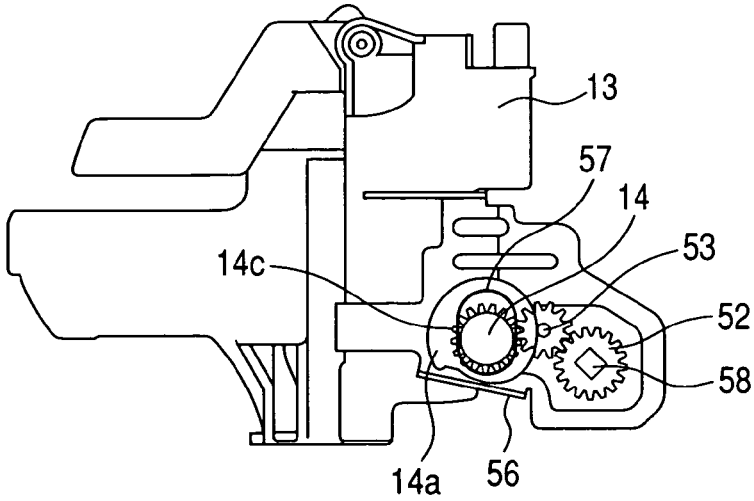
FIGS. 8A, 8B and 8C are schematic sectional side views showing the guide shaft raising and lowering mechanism of the both-side recording apparatus according to the one embodiment of the present invention.
Figure 8B:
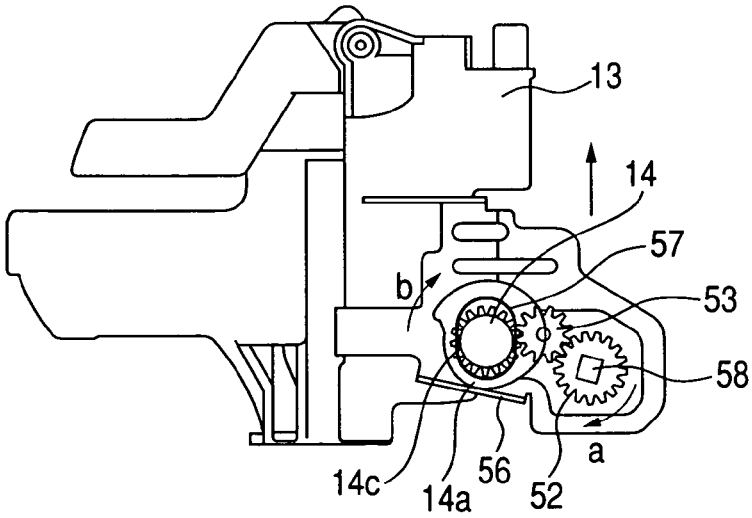
Figure 8C:
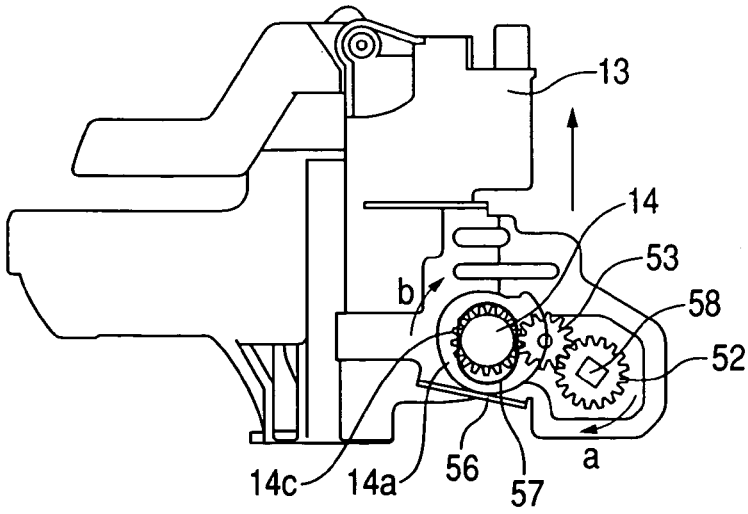

FIGS. 8A, 8B and 8C are partial side views schematically showing an operation of the carriage raising and lowering mechanism. FIG. 8A shows the case where the carriage 13 is in a first carriage position being a standard position. In this state, the guide shaft 14 is positioned by being butted against the lower limit of a guide long hole 57 of the chassis 10, and the guide shaft cam 14*a* and the guide slope 56 are not in contact with each other.

FIG. 8B shows the state in which the carriage 13 moves to a little higher second carriage position. The lift cam gear 52 fixed to the lift cam shaft 58 is rotated by the rotation of the lift cam shaft 58, from the first carriage position, and the guide shaft cam R gear 14*c* rotates through the cam idler gear 53 engaged with the lift cam gear 52. At this time, if the lift cam gear 52 and the guide shaft cam R gear 14*c* are made to have the same number of teeth, the lift cam shaft 58 and the guide shaft 14 rotate by approximately the same angle in the same direction. The reason why they do not rotate at exactly the same angle is that the distance between the gears is varied because as for the guide shaft cam R gear 14*c*, the guide shaft 14 being the rotary shaft, itself, is accompanied by up and down movements, while the rotary shafts of the lift cam gear 52 and the cam idler gear 53 are fixed.

According to the above, when the lift cam shaft 58 is rotated in the direction of the arrow a in FIG. 8B, the guide shaft 14 also rotates in the direction of the arrow b in FIG. 8B. By this rotation, the guide shaft cam R 14*a* and the guide shaft cam L 14*b* respectively abut to the fixed guide slope 56, and the guide shaft 14 moves to the second carriage position since the moving direction of the guide shaft 14 is restricted to only the up and down direction by the guide long hole 57 of the chassis 10 as described above. The second carriage position is preferably set in such a case as the deformation of the recording sheet is so large that the recording sheet and the recording head 11 abut to each other in the first carriage position.

FIG. 8C shows the case where the carriage 13 is the highest third carriage position. As a result that the lift cam shaft 58 is further rotated from the second carriage position, the radiuses of the cam surfaces of the guide shaft cam R 14*a* and the guide shaft cam L 14*b* become large, and the guide shaft 14 is moved to a higher position. This third carriage position is preferable for the case where the recording medium (recording sheet) thicker than usual is used. The above is the detailed explanation of the five mechanisms, namely, the pinch roller release mechanism, the PE sensor lever release mechanism, the pinch roller spring pressure adjusting mechanism and the sheet passing guide raising and lowering mechanism.

Figure 9:
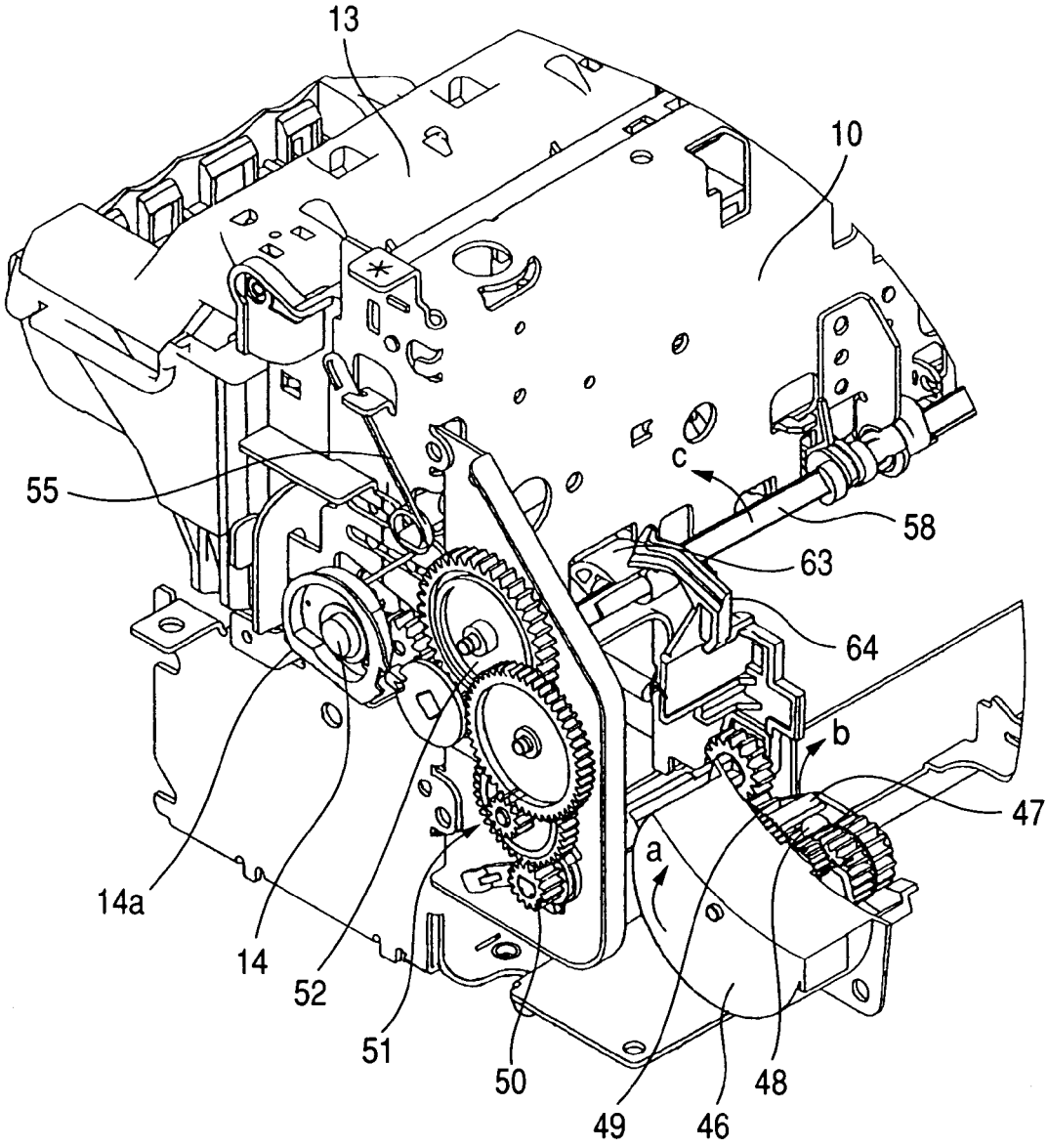
FIG. 9 is a schematic perspective view showing a driving mechanism of a lift cam shaft of the both-side recording apparatus according to the one embodiment of the present invention.

FIG. 9 is a schematic perspective view showing a driving mechanism of the lift cam shaft. Next, a driving mechanism of the lift cam shaft 58 will be explained. In this embodiment, a driving source of the lift cam shaft 58 depends on the ASF motor 46 for driving the main ASF 37. The main ASF 37 (automatic sheet supplying section) 37 is properly operated and the lift cam shaft 58 is operated, by control of the rotating direction and the rotating amount of the ASF motor 46. In FIG. 9, reference numeral 46 denotes an ASF motor (shown by cutting away the upper half to show gears) as the driving source, reference numeral 47 denotes an ASF pendulum arm located at the next stage of the gears mounted to the ASF motor 46, reference numeral 48 denotes an ASF sun gear mounted to a center of the ASF pendulum arm 47, reference numeral 49 denotes an ASF planetary gear mounted to an end portion of the ASF pendulum arm 47 and meshed with the ASF sun gear 48, reference numeral 63 denotes a pendulum lock cam fixed to the lift cam shaft 58, and reference numeral 64 is a pendulum lock lever swinging to act on the pendulum lock cam 63.

As described above, the driving force transmitting direction is determined by the rotating direction of the ASF motor 46, but in the case with the purpose of operating the lift cam shaft 58, the ASF motor 46 is rotated in the direction of the arrow a in FIG. 9. Then, the gear mounted to the ASF motor 46 rotates the ASF sun gear 48. Since the ASF sun gear 48 and the ASF pendulum arm 47 are rotatably engaged with each other with a predetermined frictional force, the ASF pendulum arm 47 swings in the rotating direction (the direction of the arrow b in FIG. 9) of the ASF sun gear 48. Then, the ASF planetary gear 49 is engaged with the lift input gear 50 at the next stage. As a result, the driving force of the ASF motor 46 is transmitted to the lift cam gear 52 through the lift speed reducing gear train 51. At this time, the ASF pendulum arm 47 swings in the direction of the arrow b in FIG. 9, and thereby the driving force to the gear train for driving the main ASF 37 as the automatic sheet supplying section is in a cutoff state.

On the other hand, when the main ASF 37 as the automatic sheet supplying section is to be driven, the ASF motor 46 is rotated in the reverse direction from the arrow a in FIG. 9, and thereby the ASF pendulum arm 47 swings in the reverse direction from the arrow b in FIG. 9 in contrast with the above description. As a result, the engagement of the ASF planetary gear 49 and the lift input gear 50 is released, and another ASF planetary gear 49 provided at the ASF pendulum arm 47 is engaged with the gear train at the side of the main ASF 37, and the main ASF 37 is driven. In this embodiment, a so-called stepping motor is used as the ASF motor 46, and this is controlled in an open loop. It goes without saying that an encoder is used for a DC motor and the like and closed control may be performed.

Here, in the case where a planetary gear mechanism is used for transmitting the driving force, when the driven part is under a negative load, the pendulum lock lever 64 moves to release the engagement of the gears, and there is the possibility that so-called advance ahead of another, that is, the driven part advancing in phase more than the driving source, occurs. In order to prevent this, the pendulum lock cam 63 and the pendulum lock lever 64 are placed in this embodiment. When the lift cam shaft 58 is in the range of a predetermined angle, the pendulum lock lever 64 swings n the direction of the arrow c in FIG. 9 due to the cam surface shape of the pendulum lock cam 63, and the pendulum lock lever 64 engages with the ASF pendulum arm 47 to fix the ASF pendulum arm 47 so that the ASF pendulum arm 47 cannot return to the side to drive the main ASF 37. As a result, the ASF planetary gear 49 is always meshed with the lift input gear 50, and therefore, the ASF motor 46 and the lift cam shaft 58 are always rotated synchronously.

When the pendulum lock cam 63 returns to the predetermined angle range, the pendulum lock lever 64 returns to the opposite direction from the arrow c in FIG. 9, then, lock of the ASF pendulum arm 47 is released, and is returned to the state in which the drive can be transmitted to the main ASF side if the ASF motor 46 is reversed. The driving mechanism of the lift cam shaft 58 explained above makes it possible to release the pinch roller 22, lock the PE sensor lever 66, adjust pressure of the pinch roller spring 24, operate the sheet passing guide 70 up and down, and operate the carriage 13 up and down. The aforesaid five kinds of moving mechanism will be generally called as a lift mechanism hereunder.

Figure 10A:
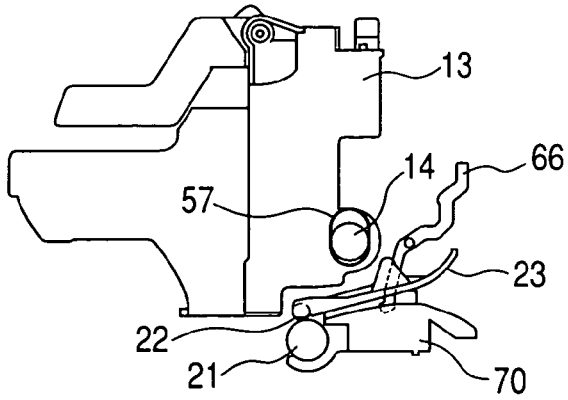
FIGS. 10A, 10B, 10C and 10D are schematic sectional side views showing a state in each position of a lift mechanism of the both-side recording apparatus according to the one embodiment of the present invention.

Next, how these five kinds of moving mechanisms (lift mechanism) are correlated to operate will be explained. FIGS. 10A, 10B, 10C and 10D are schematic partial side views showing operations of the carriage 13, the pinch roller 22, the PE sensor lever 66 and the sheet passing guide 70. FIG. 10A shows the case where the lift mechanism is at the first position. In this state, the pinch roller 22 is in pressure contact with the sheet feeding roller 21, the PE sensor lever 66 is in the free state, the pinch roller spring 24 (FIGS. 4A, 4B and 4C) is in pressure contact with normal pressure, the sheet passing guide 70 is in the up state, and the carriage 13 is in the first carriage position.

The state in FIG. 10A is in the position which is used for a recording operation using an ordinary recording sheet, registration after the recording sheet is reversed in the sheet reversing section (automatic both-side unit) 2, or the like. The carriage 13 is guided and supported movably along the guide shaft 14, and the carriage 13 is moved up and down by moving the guide shaft 14 up and down along the guide long hole 57 formed at the chassis 10.

Figure 10B:
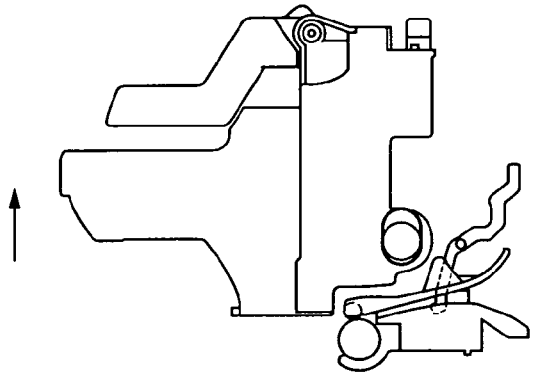

FIG. 10B shows the case where the lift mechanism is in the second position. In this state, the pinch roller 22 is in pressure contact with the sheet feeding roller 21, the PE sensor lever 66 is in the free state, the pinch roller spring 24 is in pressure contact with normal pressure, the sheet passing guide 70 is in the up state, and the carriage 13 is in the second carriage position. This state differs in the height position of the carriage 13 as compared with the first position of the lift mechanism. This state is in the position which is used to prevent the recording sheet and the recording head 11 from rubbing against each other when the deformation of the recording sheet as the recording medium is large, or used when comparatively thick recording medium is used, or the like.

Figure 10C:
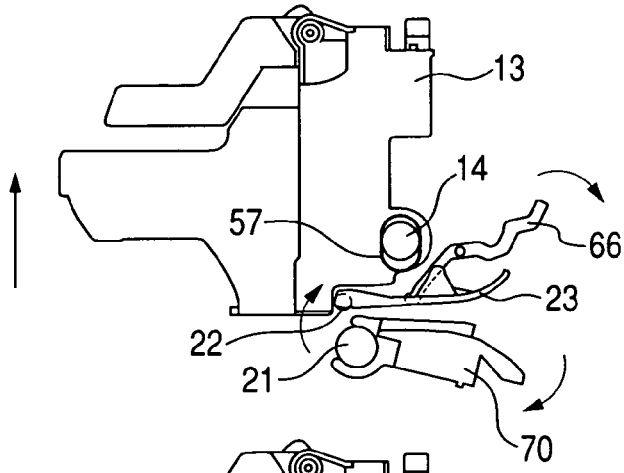

FIG. 10C shows the case where the lift mechanism is in the third position. In this state, the pinch roller 22 is released (separated) from the sheet feeding roller 21 with a predetermined clearance between them, the PE sensor lever 66 is retreated above to be in the locked (locked up) state, the pinch roller spring 24 (FIGS. 4A, 4B and 4C) is in the state with pressure contact force being weakened, the sheet passing guide 70 is in the down state, and the carriage 13 is the highest third carriage position. As compared with the second position of the lift mechanism, the states of all are changed, and the sheet passing path is opened straight, which is the state in which drawing of the recording sheet is possible. This state is in the position which is used when the recording sheet is conveyed in the direction of the arrow b in FIG. 2 after the front surface recording of the recording sheet is finished, when the thick recording sheet is inserted, or the like.

Figure 10D:
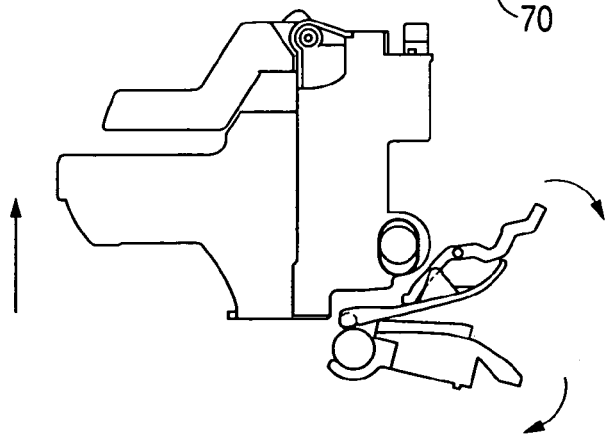

FIG. 10D shows the case where the lift mechanism is in the fourth position. In this state, the pinch roller 22 is in pressure contact with the sheet feeding roller 21, the PE sensor lever 66 is released above and in the locked (locked up) state, the pinch roller spring 24 (FIGS. 4A, 4B and 4C) is in pressure contact with a slightly weak pressure, the sheet passing guide 70 is in the down state, and the carriage 13 is in the highest third carriage position. As compared with the third position of the lift mechanism, this state has changed in such a way as the pinch roller 22 is returned to the pressure contact state, and the pinch roller spring 24 is in pressure contact with slightly weak pressure. This state is in the position which is used when the recording sheet is conveyed toward the automatic both-side unit 2 as the sheet reversing section after the recording sheet is drawn again at the time of automatic both-side recording, and recording is performed by using the thick recording medium.

In this embodiment, the mechanism is simplified by limiting to the four kinds of positions of the lift mechanism as shown in FIG. 10A to FIG. 10D as an example, in view of the operation of the recording apparatus. In other words, while the lift cam shaft 58 makes one rotation, the position changes by circulating from the first position→the second position→the third position→the fourth position→the first position. The spirit of the present invention is not limited to this, and the respective mechanical components may be constructed to independently operate properly. The pressure adjusting mechanism of the pinch roller spring 24 is not indispensable, and it may be omitted when the rigidity of the pinch roller holder 23 is sufficiently high, and when the load variation of the LF motor 26 does not matter. If the mechanism can properly guide the tip end of the recording sheet to the nip portion of the sheet feeding roller 21 due to the placement of the main ASF 37, even if the sheet passing guide 70 is horizontal, the raising and lowering mechanism for the sheet passing guide 70 may be omitted.

Figure 11:
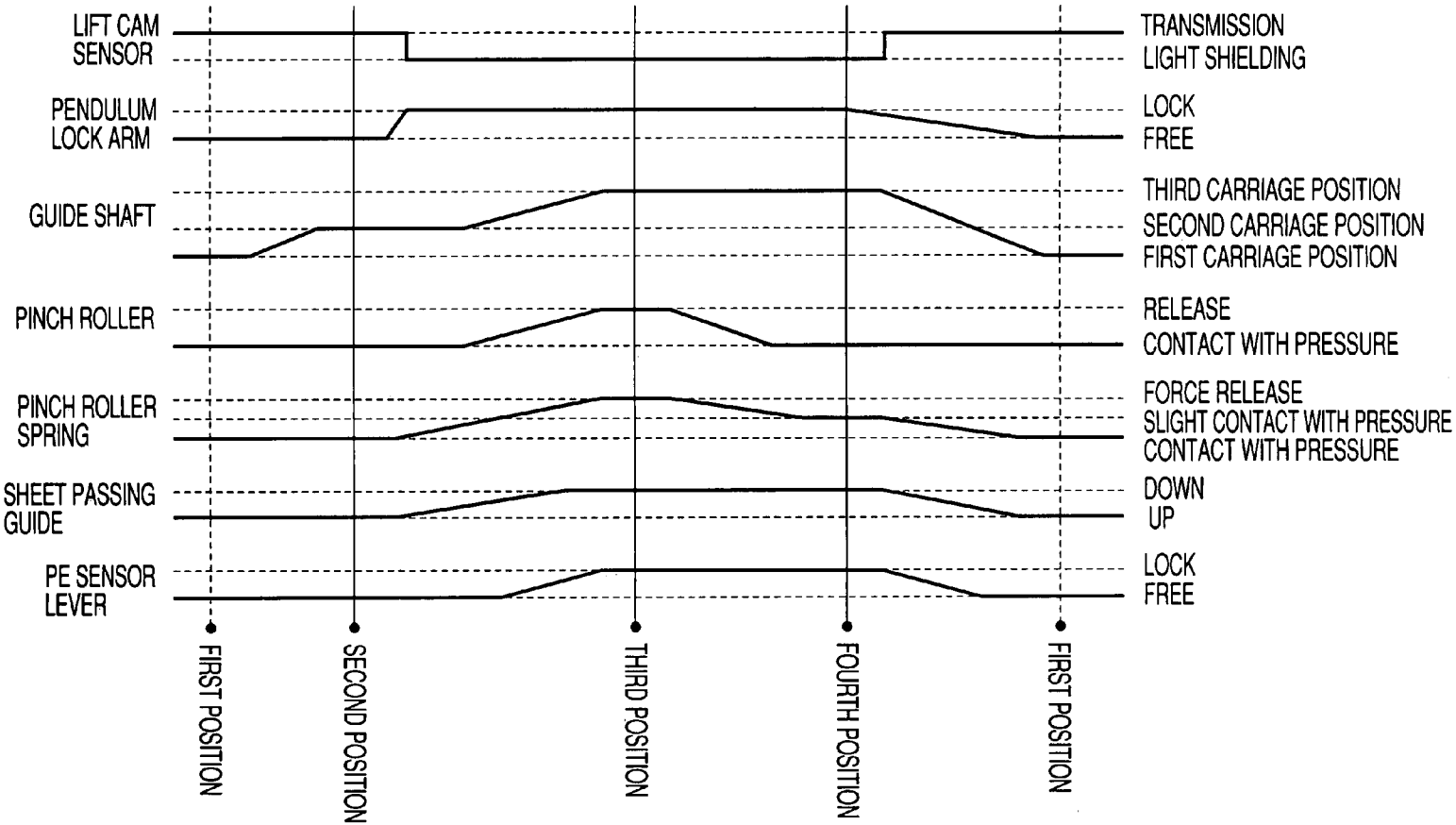
FIG. 11 is a timing chart showing an operating state of the lift mechanism of the both-side recording apparatus according to the one embodiment of the present invention.

FIG. 11 is a timing chart showing an operation state of the lift mechanism. In order to make the content explained in FIGS. 4A, 4B and 4C to FIGS. 10A, 10B, 10C and 10D more understandable, explanation will be made again by using the timing chart in FIG. 11. The horizontal axis of FIG. 11 shows the angle of the lift cam shaft 58 in the range of 360 degrees, and the vertical axis shows the respective mechanism components and their positions. In FIG. 11, the angle of the lift cam shaft 58 is detected by the lift cam sensor 69 (FIG. 3) by synchronously operating the lift cam shaft 58 and the guide shaft 14 and the rotation angle of the ASF motor 46 (FIG. 21) is only controlled, thereby making it possible to operate a plurality of mechanisms at the same time. The above is the explanation of the operation of the lift mechanism.

Figure 12A:
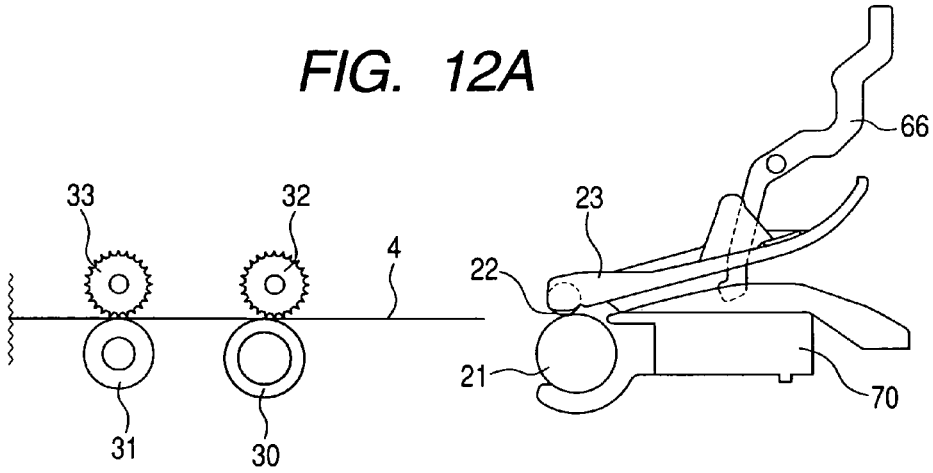
FIGS. 12A, 12B and 12C are schematic sectional side views showing a state at the time of start of back feed (at the time of starting conveyance to the sheet reversing section) of a recording medium of the both-side recording apparatus according to the one embodiment of the present invention.
Figure 12B:
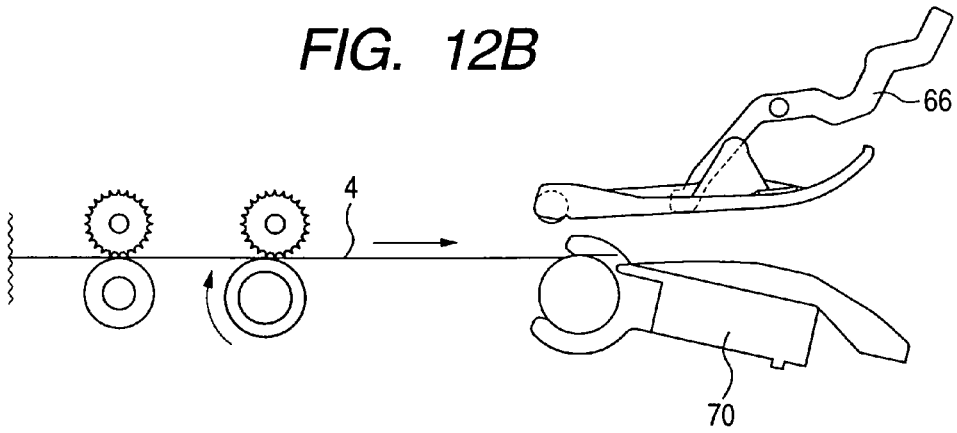
Figure 12C:
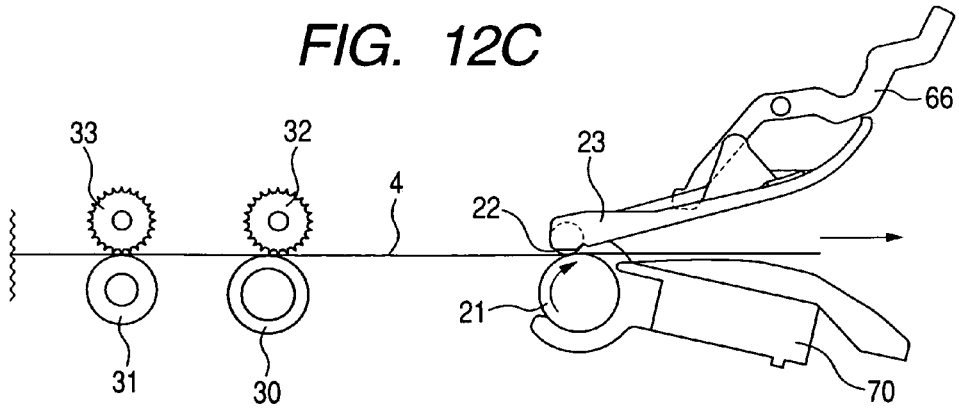

FIGS. 12A, 12B and 12C are schematic side views for explaining the process of drawing the recording sheet into the nip portion of the sheet feeding roller 21 again after recording of the front surface (the front side, the first surface) of the recording sheet is finished. Next, referring to FIGS. 12A, 12B and 12C, how automatic both-side recording is performed onto the recording sheet will be specifically explained. FIG. 12A shows the state in which recording on the front surface (the front side, the first surface) of a recording sheet 4 as the recording medium is finished, and the recording sheet 4 is nipped by the first sheet discharging roller 30 and the first spur train 32, and the second sheet discharging roller 31 and the second spur train 33. The first spur train 32 and the second spur train 33 are constructed by the rotary bodies driven to rotate by being pressed by the sheet discharging roller. At this time, the lift mechanism is in the state of the first position or the second position. As describe above, if recording is performed by moving the recording sheet 4 forward up to this state, the discharge port train (discharge nozzle train, ink discharge portion) of the recording head 11 can oppose to the limit of the rear end portion of the recording sheet 4, and therefore it is possible to perform recording on the recording sheet 4 without leaving a blank space at the lower end.

Next, the lift mechanism is shifted to the third position as shown in FIG. 12B, and a predetermined amount of large clearance is provided between the pinch roller 22 and the sheet feeding roller 21, and thereby even if the rear end of the recording sheet 4 rolls more or less, or get warped upward, the rear end of the recording sheet 4 can be easily drawn. At this time, the pinch roller holder 23 and the carriage 13 do not interfere with each other, and therefore the carriage 13.may be located at any position in the main scanning direction.

FIG. 12B shows the state in which the recording sheet 4 is conveyed in the direction of the arrow b in FIG. 2 (hereinafter, conveying the recording medium 4 in this direction will be called conveying in the reverse direction) by rotating the first sheet discharging roller 30 in the arrow direction in the drawing from the state of FIG. 12A, and the recording sheet 4 is moved under the pinch roller 22 and stopped there. The main reason why the sheet 4 is stopped in this state is that the recording apparatus of this embodiment adopts the wet type ink jet recording method. In other words, the recorded surface of the recording sheet 4 (the top surface in FIGS. 12A, 12B and 12C) is wet with ink directly after the recording operation, and if it is pressed in contact with the pinch roller 22 and the sheet feeding roller 21 immediately, there is the possibility that the ink is transferred to the pinch roller 22, then the ink is transferred onto the recording sheet 4 again, and the recording sheet 4 is contaminated.

It depends on the various conditions whether the ink is transferred onto the pinch roller 22, in other words, whether the ink hit on the recording sheet 4 as the recording medium is dried or not. Namely, the conditions such as the kind of the recording medium 4, the kind of ink to be used, overprinting method of the ink used, a printing amount of the ink used per unit area (for example, density of the recorded data per unit area), the temperature of the environment where the recording operation is performed, the humidity of the environment where the recording operation is performed, flow velocity of the gas in the environment where the recording operation is performed, and the like. In general information, when the recording medium having the ink receiving layer on the surface and capable of quickly guiding the ink inside, the ink is easily dried. When the ink having small grains of ink such as dye and easily penetrating inside the recording medium is used, the ink is easily dried. When the ink which chemically reacts is used, and an ink system solidifying the ink by overprinting the ink on the recording medium front surface is used, the ink is easily dried quickly.

If the amount of ink hit per unit area is reduced, the ink is quickly dried. If the temperature of the environment where the recording operation is performed is increased, the ink is quickly dried. If the humidity of the environment where the recording operation is performed is increased, the ink is quickly dried. If the flow velocity of the gas in the environment where the recording operation is performed is made high, the ink is quickly dried. As described above, required drying time is determined by the several conditions, and therefore in this embodiment, the drying time which is required when recording is performed under the ordinary use conditions (an ordinary recording sheet and an ordinary recording operation environment) using a predetermined ink system is specified as the standard value, and the drying time is varied in accordance with the predictable conditions.

The predictable condition is the amount of hit ink per unit area, and if environment temperature detecting means, environment humid detecting means, environment wind velocity detecting means and the like are use in combination other than the amount of hit ink, it is possible to predict dry standby time finely. For example, the data-received from the host device 308 (FIG. 21) is stored on the RAM 312 (FIG. 21), the amount of hit ink per unit area is calculated, then the maximum value of it is compared with a predetermined threshold value described in the ROM 311 (FIG. 21), which can be made the method for determining the dry standby time. Namely, when the maximum value of the amount of hit ink per unit area is large, the dray standby time is set to be long, and on the other hand, when the amount of hit ink per unit area is small, the dry standby time is shortened, thus making it possible to optimize the dry standby time according to the recording pattern.

The dry standby time differs depending on whether the kind of ink used for recording is die ink or pigmented ink. In the case of die ink, which is easily dried, the dry standby time is made short, and in the case of pigmented ink, which is not easily dried, the dray standby time is made long. When the ambient temperature is high, the ink is easily dried, and therefore the dry standby time is made short. When the ambient temperature is low, the ink is not easily dried, and therefore the dry standby time is made long. When the ambient humidity is high, the ink is not easily dried, and therefore the dry standby time is made long. When the ambient humidity is low, the ink is easily dried, and therefore the dry standby time is made short. In the case of the recording medium having the ink receiving layer on the surface to take the ink hit thereon inside the sheet immediately, the recording medium surface is easily dried, and therefore the dry standby time is made short. In the case of the recording sheet with high water repellency, the ink is not easily dried, and therefore the dry standby time is made long.

The reason why it is preferable to feed the recording sheet 4 back to the position in FIG. 12B by rotating the sheet feeding roller 21 in the reverse direction and let it stand by there instead of performing dry standby at the position in FIG. 12A is largely the deformation of the recording sheet 4. Namely, when recording is performed on the recording sheet in the wet type ink jet process, the recording sheet absorbs moisture and fibers of the sheet expand, thus sometimes extending the recording sheet. In accordance with the recorded pattern, some portions of the sheet extend and other portions do not extend, and in such a case, uneven spots are formed on the sheet surface especially conspicuously. The amount of the uneven spots mainly depends on the time from the recording sheet absorbs moisture, and the amount of uneven spots increases as the time elapses, and converges onto a predetermined deformation amount.

When the deformation amount of the end portion of the sheet after the time elapses, there is the possibility that the sheet end portion interferes with the pinch roller 22 and jams even if the pinch roller 22 is moved away from the paper feeding roller 21 and released. In order to prevent this, back feed is performed by the time when the deformation of the uneven spots of the recording sheet becomes large, so that the recording sheet is moved under the pinch roller 22. For the above reason, the rear end of the (front) surface of the recording sheet 4 is fed back to the position in FIG. 12B to wait until the recorded portion of the recording sheet is dried. The clearance between the sheet feeding roller 21 and the pinch roller 22 when they are separated is usually set to be larger the deformation amount of the recording sheet after the recording on the first surface (the front side) of the recording sheet.

FIG. 12C shows the state in which the recording sheet 4 is conveyed toward the automatic both-side unit 2 as the sheet reversing section (conveying in the reverse direction). When the recorded portion of the recording sheet 4 is dried, and ink is not transferred to the pinch roller 22 even if the recording sheet 4 is brought into pressure contact with the pinch roller 22, the lift mechanism is shifted to the fourth position as shown in FIG. 10D, and the recording sheet 4 is nipped with the pinch roller 22 and the sheet feeding roller 21. In this state, the sheet feeding roller 21 is driven in the reverse direction, and the recording sheet 4 is fed back. Since the PE sensor lever 66 is rotated to above and locked at this time, it never happens that the tip end of the PE sensor lever 66 bites the recording sheet 4 or the PE sensor lever 66 rubs and peels the recorded portion.

Since the sheet passing guide 70 is in the down state, the sheet passing surface is approximately horizontal, and thereby the recording sheet 4 can be conveyed straight toward the automatic both-side unit 2. In this embodiment, the sheet passing guide 70 makes the up state as a basis, but the spirit of the present invention is not restricted to this, and the ordinary state of the sheet passing guide may be the down state. In other words, the ordinary standby state is set at the third position or the fourth position, and it is possible to construct the lift mechanism moves to the first position at the time of operation of supplying sheet from the main ASF 37. As a result of such construction, it becomes possible to smoothly insert a recording medium with strong rigidity when the recording medium is inserted from the side of the sheet discharging roller. The above is the explanation of the conveying process from the end of the recording on the front surface (front side) of the recording medium 4 to the sheet reversing seciton 2.

Figure 13:
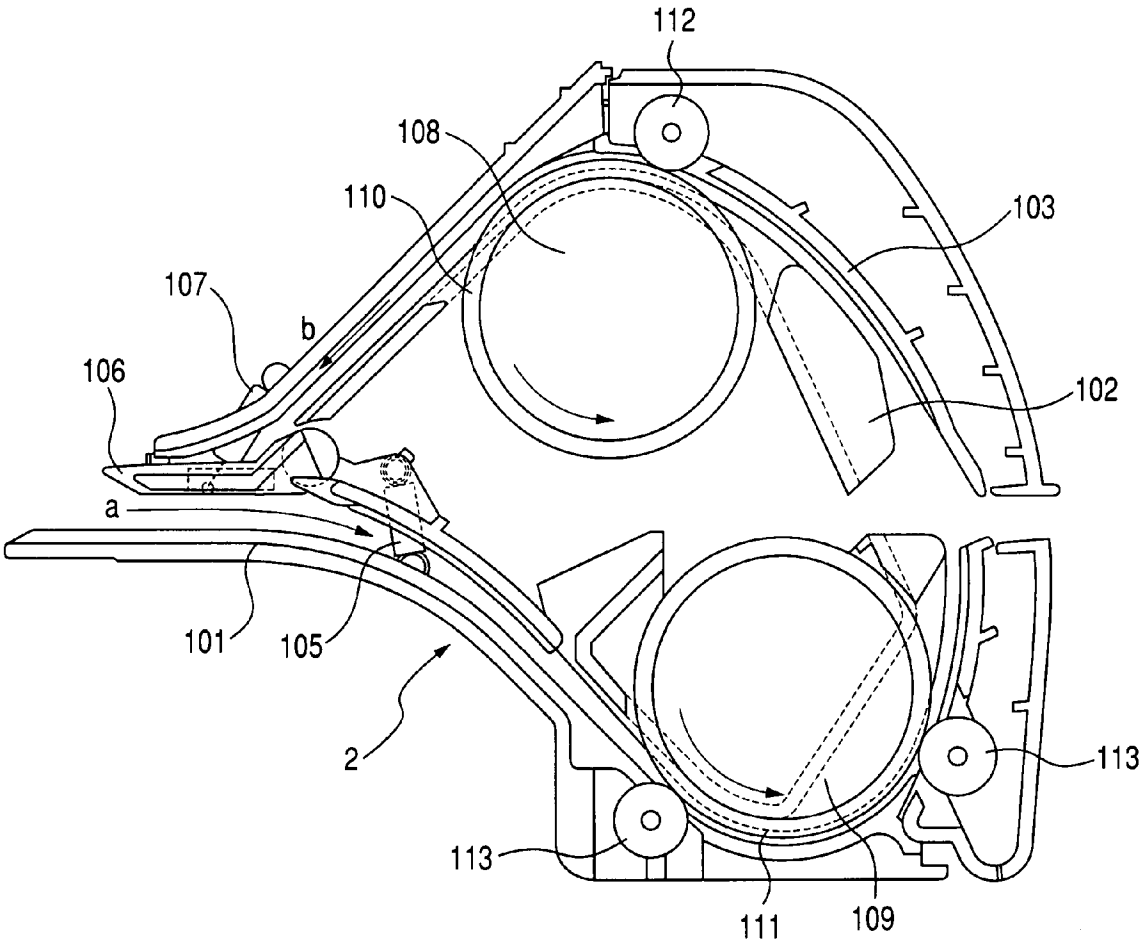
FIG. 13 is a schematic sectional side view showing a construction of the sheet reversing section (an automatic both-side unit) of the both-side recording apparatus according to the one embodiment of the present invention.

FIG. 13 is a schematic sectional side view showing the placement state of the sheet passing path (reversing path) and the conveying rollers of the automatic both-side unit 2 as the sheet reversing section or the automatic reversing section. Next, referring to FIG. 13, the recording medium conveying mode inside the sheet reversing section 2 will be explained. In FIG. 13, reference numeral 101 denotes a sheet reversing section frame (both-side unit frame) constructing a structure of the sheet reversing section (automatic both-side unit) 2 and a part of the sheet conveying path, reference numeral 102 denotes an inner guide fixed inside the both-side unit frame 101 and constructing a part of the sheet conveying route, reference numeral 103 denotes a rear cover placed behind the both-side unit frame 101 to be openable and closable to construct a part of the sheet conveying path, reference numeral 105 denotes a switching flap spring for biasing a switching flap (movable flap) 104 in a predetermined direction, reference numeral 107 denotes an outlet flap spring for biasing an outlet flap 106 in a predetermined direction, reference numeral 110 denotes a both-side roller rubber A which is a rubber portion of a reversing section roller (both-side roller) A108, and reference numeral 111 denotes a both-side roller rubber B which is a rubber portion of a reversing section roller (both-side roller) B109.

When the recording sheet 4 is conveyed to the sheet reversing section 2 from the state in FIG. 12C by the rotation of the sheet feeding roller 21 in the reverse direction, the outlet flap 106 is biased to the position shown in FIG. 13 by the action of the outlet flap spring 107, and therefore the introduction passage is uniquely determined. As a result, the recording sheet 4 travels in the direction of the arrow a in FIG. 13. Next, the recording sheet 4 hits on the switching flap 104 which is a movable flap, but in the case of the recording sheet capable of usual both-side recording, the load of the switching flap spring 105 is set so that the switching flap 104 does not rotate, and therefore the recording sheet 4 travels along the sheet passing path between the switching flap 104 and the both-side unit frame 101. The recorded surface (the first surface, the front side) of the recording paper 4 abuts to the roller rubber B111 of the reversing section roller B109 as it is, and the unrecorded surface (back surface) is in the direction to abut to the reversing section pinch roller B113 made of highly lubricant high polymer resin so that the recording paper 4 is inserted between the roller rubber B111 and the reversing section pinch roller B113.

At this time, the circumferential speeds of the both-side roller (reversing section roller) A108 and the both-side roller (reversing section roller) B109, and the sheet feeding roller 21 are set so that they rotate approximately at the same speed by a driving mechanism which will be described later, and therefore the recording sheet 4 is conveyed without generating slip between the recording sheet 4 and the both-side roller B109. Since the circumferential speeds are approximately the same, the recording sheet 4 is not loosened or is not in the state under tension. When the recording sheet 4 is changed in the traveling direction by the reversing section roller B109, the recording sheet 4 travels along the rear cover 103, and inserted between the roller rubber A110 of the reversing side roller (both-side roller) A108 and the reversing section pinch roller A112.

The recording sheet 4 is conveyed in the direction of the arrow b in FIG. 13 by being changed in the traveling direction by the reversing section roller A108 again. The reversing section roller A108 and the reversing section roller B109 construct the reversing roller to reverse the recording sheet 4 from the front to the back or the conveyed direction of the recording sheet 4. If the recording sheet 4 travels as it is, the tip end of the recording sheet 4 abuts to the outlet flap 106. The outlet flap 106 is biased by the outlet flap spring 107 with a very weak load, and therefore, the recording sheet 4 itself pushes away the outlet flap 106 and goes out of the automatic both-side unit 2 as the sheet reversing section. The length of the sheet passing path inside the automatic both-side unit 2 is set so that the rear end in the traveling direction of the recording sheet 4 already passes under the outlet flap 106 when the tip end in the traveling direction of the recording sheet 4 goes out of the outlet flap 106, and therefore the tip end portion and the rear end portion of the recording sheet 4 itself do not rub each other.

Since it is possible to measure the length of the recording medium by the PE sensor lever 66 when recording is performed on the front surface of the recording medium 4 though a detailed flow chart will be described later, when the recording medium shorter than the distance from the sheet feeding roller 21 to the reversing section roller B109, or the distance from the reversing section roller A108 to the sheet feeding roller 21, or the recording medium longer than the distance from the outlet flap 106 of the sheet reversing section (automatic both-side unit) 2 to the outlet flap 106 to return again after making one round, is inserted, a warning is issued at the stage in which the recording on the front surface ends, and the recording medium 4 is discharged without being conveyed (being conveyed in the reverse direction) to the automatic both-side unit 2.

Here, the reason why the recording sheet 4 is conveyed with the recorded surface of the recording sheet 4 being on the side of the roller rubber A110 and the roller rubber B111 will be explained. Since the roller rubber A110 and the roller rubber B111 are the driving parts, and the reversing section pinch roller A112 and the reversing section pinch roller B113 are the driven parts, the recording sheet 4 is conveyed to follow the driving part roller, and the driven parts are rotated by the frictional force with the recording sheet 4. At this time, it is favorable if the axial loss of the rotary shafts for supporting the reversing section pinch roller A112 and the reversing section pinch roller B113 is sufficiently small, but if the axial loss increases for some reason, there is the possibility that slip occurs between the recording sheet 4, and the reversing section pinch roller A112 and reversing section pinch roller B113. The recorded portion of the recording sheet 4 is dried to such a degree as the ink is not transferred by abutment to the roller, but if it is rubbed, there is the possibility that the ink is peeled off the front surface of the recording sheet 4.

If the recorded surface of the recording sheet 4 is in contact with the sides of the both-side pinch roller A112 and the both-side pinch roller B113, and slip occurs between the recorded surface and the rollers, there is the possibility that the ink on the recorded surface is peeled off. In order to prevent this, arrangement in this embodiment is such that the driving members abut to the recorded surface (front side), and the driven member abuts to the unrecorded surface (back surface). As another reason of arrangement, the following reason can be cited. Namely, since the both-side roller A108 or the both-side roller B109 at the driving side has the restraint by the bent radius of the recording sheet 4, they cannot have the diameter less than some extent, but it is possible to reduce diameters of the both-side pinch roller A112 and the both-side pinch roller B113, and therefore the both-side pinch roller A112 and the both-side pinch roller B113 are designed to have small diameters in many cases in order to design the automatic both-side unit 2 to be compact.

Though the ink is not basically transferred to the rollers from the recorded surface of the recording medium 4, but the ink is transferred to the rollers by an extremely small amount, and the rollers abutting to the recorded surface is gradually contaminated with ink in some cases. It can be said that the small diameter roller is disadvantageous with respect to contamination, because in the case of the roller with reduced diameter, the roller outer circumference frequently contacts the recording medium, and thus the contaminated speed is higher as compared with the roller with a large diameter. From the above, in this embodiment, the both-side roller A108 and the both-side roller B109 with large diameters are disposed at the side to abut to the recorded surface (front surface) of the recording medium, from the viewpoint of the reduction in size of the apparatus and contamination of the rollers.

As another reason of arrangement, the following reason can be also cited. Namely, when the sheet is nipped and conveyed with a pair of rollers one of which is driven, the driving part is made of the material with a high friction coefficient while the driven part is made of the material with a low friction coefficient, and in order to take the area of the nip portion (nip area), either one is made of an elastic material in many cases. It is general that a rubber material (elastic material in a rubber form) capable of providing a high friction coefficient at comparatively low cost and rich in elasticity is used as the driving part material. In order to increase the conveying force, the means for polishing the surface of rubber and the like including elastomer and the like, and applying very small irregularities of polishing marks intentionally is often used. In this case, it is general to form the driven part by high polymer resin with a comparatively small friction coefficient on the front surface.

When the surfaces of rubber or the like with very small irregularities and the smooth high polymer resin are compared, contamination of ink attaches to both of them when they abut to the recorded surface of the recording sheet, but since the rubber or the like with the very small irregularities being attached holds the contamination with the irregularities, the rubber or the like hardly transfers the contamination to the recording sheet again, while the contamination peels off and is sometimes transferred to the recording sheet in the smooth high polymer resin, and therefore it can be said that it is more advantageous to make the rubber or the like abut to the recorded surface of the recording sheet. From the above, in this embodiment, the rollers of the rubber material are placed at the side to abut to the recorded surface of the recording sheet (front side, first surface), and the rollers of a high polymer resin material are placed at the side to abut to the unrecorded surface (back surface, back side). The above is the explanation of the reversing operation to perform both-side recording onto an ordinary recording sheet.

Next, the operation of the automatic both-side unit (Sheet reversing section) 2 when recording is to be performed onto a recording medium with high rigidity instead of performing automatic both-side recording will be explained. The recording medium with high rigidity is assumed to be thick sheet with, for example, a thickness of 2 mm to 3 mm, or is assumed to be in the case where a disc-shaped or oddly-shaped recording medium is placed on a predetermined tray and conveyed. Since such recording medium is high in rigidity, it cannot be bent enough to follow the reversing section roller diameter of the sheet reversing section 2, and therefore automatic both-side recording cannot be performed, but there can be the circumstances in which recording would like to be performed for such a recording medium while the sheet reversing section 2 is kept mounted on the recording apparatus. When rigidity of the recording medium is high, the sheet supply cannot be made by utilizing the main ASF 37, and since a straight sheet feeding path is used in this case, the recording medium is supplied toward the side of the sheet feeding roller 21 from the side of the sheet discharging roller. An operation of the automatic both-side unit (sheet reversing section) 2 on this occasion will be explained hereunder.

Figure 14A:
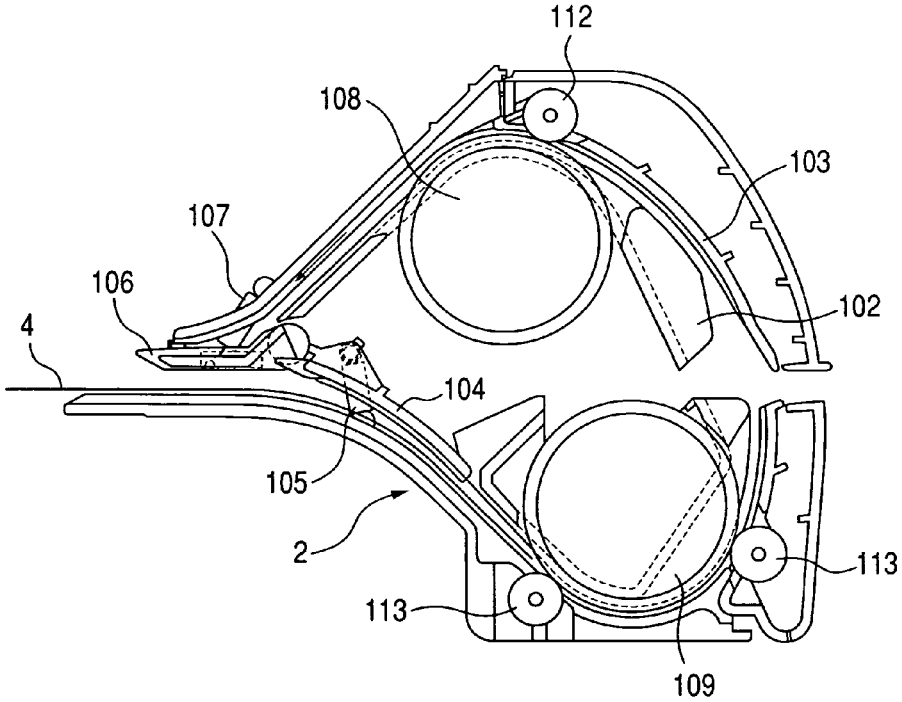
FIGS. 14A and 14B are schematic sectional side view showing an operation of flap in the sheet reversing section of the both-side recording apparatus according to the one embodiment of the present invention.
Figure 14B:
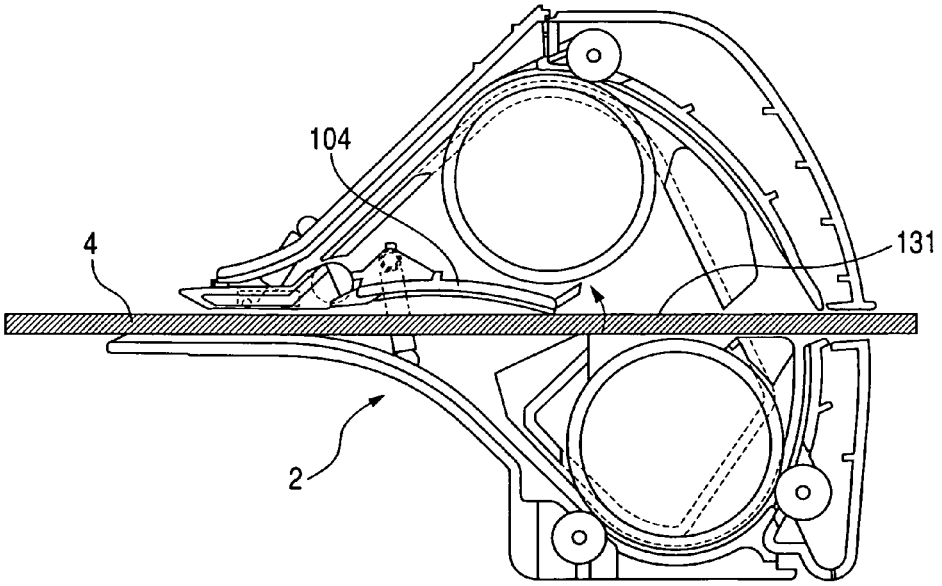

FIGS. 14A and 14B are schematic sectional side views explaining an operation of the switching flap 104. FIG. 14A shows a state in the case where automatic both-side recording is performed by using the aforementioned ordinary recording sheet (recording medium). At this time, the switching flap spring 105 keeps biasing the switching flap 104 to the stopper against the pressing force of the recording sheet 4, and therefore the recording sheet 4 is leaded (guided) to the sheet passing path for reversing.

FIG. 14B shows the state in the case of using the recording medium high in rigidity (including the recording sheet). When the recording medium 4 high in rigidity is conveyed to the automatic both-side unit 2, the recording medium passes under the outlet flap 106 to abut to the switching flap 104. The switching flap spring 105 is set to have such a spring load as to retreat the switching flap 104 by pressing force applied when the recording medium high in rigidity is inserted and presses the switching flap 104, and therefore the switching flap spring 105 rotates in the counterclockwise direction (the arrow direction) in FIG. 14B following the advance of the recording medium with high rigidity to retreat. As a result, the recording medium 4 with high rigidity is guided to the retreating path 131 which is the second sheet passing path provided between the both-side roller A108 and the both-side roller B109. Since a hole (through-hole, opening) is provided at the region of the rear cover 103 corresponding to the retreating path 131, and therefore even if a long recording medium with high rigidity is used, it never happens that the recording medium interferes with the sheet reversing section (automatic both-side unit) 2 and conveyance is restrained.

Figure 22:
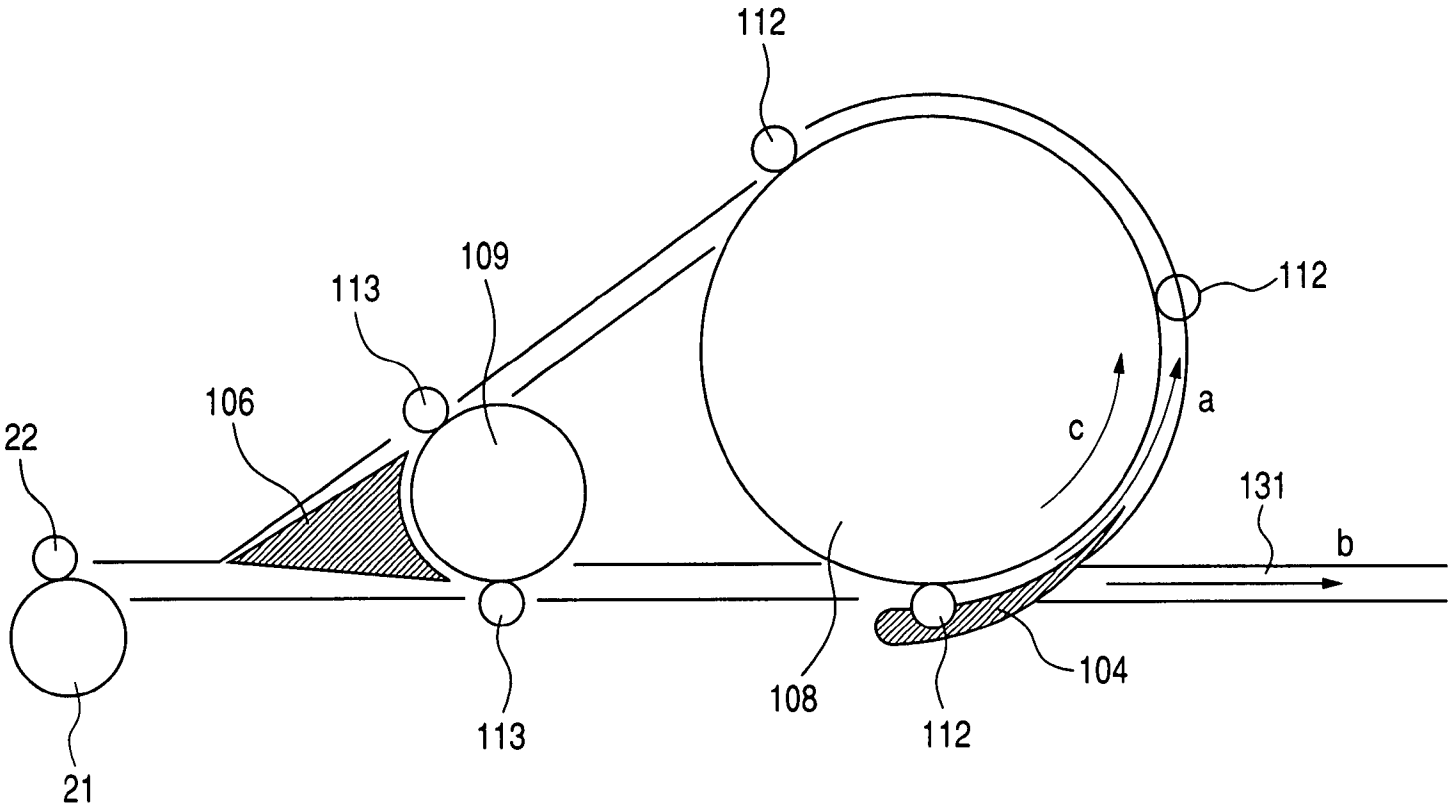
FIG. 22 is a schematic sectional side view showing another construction example of the sheet reversing section (the automatic both-side unit) of the both-side recording apparatus according to the one embodiment of the present invention.

The spirit of the present invention is not restricted to the above-described construction explained with reference to FIG. 14B. Namely, on carrying out the present invention, it is not essential to provide the retreating path 131 between the tow upper and lower both-side rollers 108 and 109, and the following construction is possible. FIG. 22 is a schematic sectional side view showing a sheet reversing section (automatic both-side unit) constructed by placing a reversing section roller (both-side roller) with a large diameter over an approximately horizontal path. In FIG. 22, the switching flap 104 is biased to the position shown in FIG. 22 by a switching flap spring not shown, and the spring force (pressing force) of the switching flap spring is set at the load under which the switching flap 104 can rotate when the recording medium with high rigidity abuts to it. In FIG. 22, the portions corresponding to the portions in FIGS. 13, 14A and 14B are shown by the same reference numerals and characters, the detail of them refers to the aforementioned explanation, and the detailed explanation will be omitted here.

Consequently, in the case of the recording medium with low rigidity, the recording medium travels in the direction of the arrow a in FIG. 22 by the rotation of the reversing section roller (both-side roller) A108 in the direction of the arrow c in FIG. 22, but in the case of the recording medium with high rigidity, it pushes away the switching flap 104 to advance to the retreating path 131 in the direction of the arrow b in FIG. 22. As a result, even when the long recording medium with high rigidity is used, it never happens that the recording medium interferes with the sheet reversing section (automatic both-side unit) and restrains conveyance. According to the above, it is possible to perform one-side recording onto the recording medium (including the recording sheet) which is so high in rigidity that it cannot be bent without removing the automatic both-side unit in the automatic both-side unit in this embodiment. The above is the explanation of the sheet reversing section 2 having two sheet passing paths.

Figure 15A:
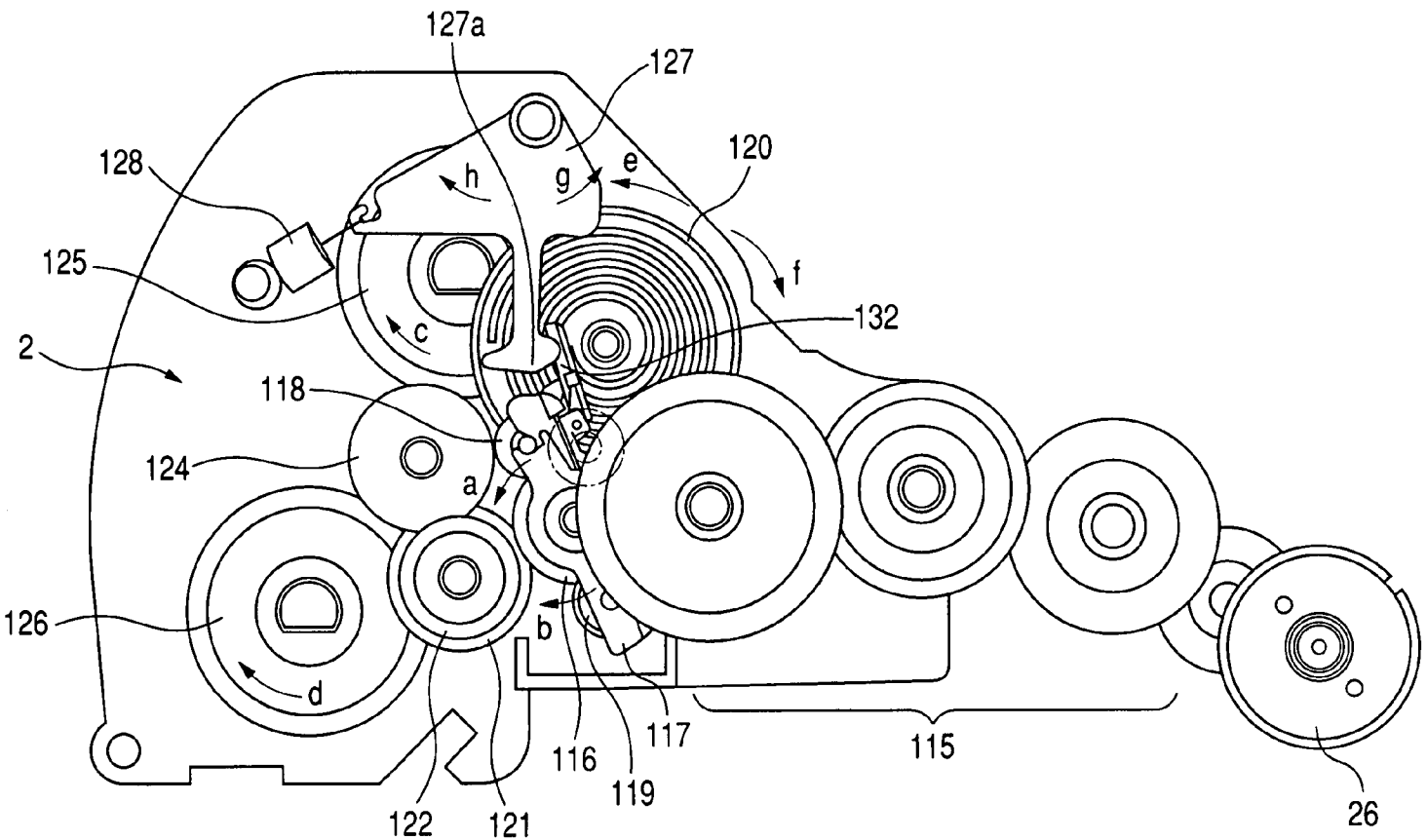
FIGS. 15A, 15B, 15C and 15D are schematic sectional side views showing a driving mechanism of the sheet reversing section of the both-side recording apparatus according to the one embodiment of the present invention.
Figure 15B:
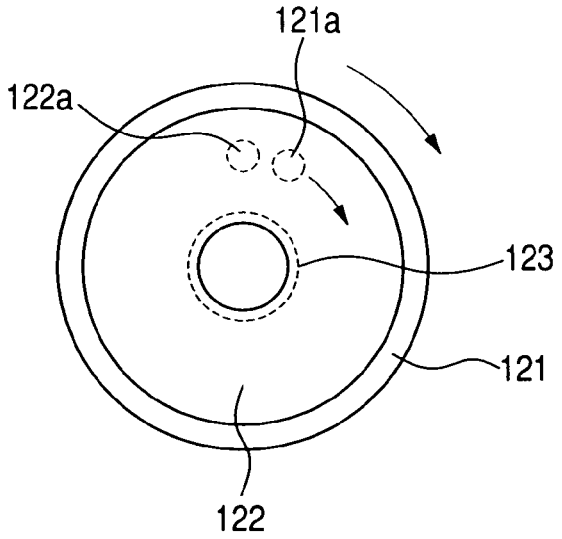

Next, a driving mechanism (transmission means) of the rollers of the automatic both-side unit 2 as the sheet reversing section will be explained. FIG. 15A is a schematic sectional side view showing the construction of the driving mechanism of the rollers of the automatic both-side unit 2 of one embodiment (FIG. 1) of the recording apparatus to which the present invention is applied, seen from the opposite side from FIG. 2. In FIG. 15A, reference numeral 115 denotes a both-side transmission gear train for transmitting power to a both-side sun gear 116 from the LF motor 26 (drive means), reference numeral 116 denotes the both-side sun gear located at a center of the both-side pendulum arm, reference numeral 117 denotes a rocker arm (both-side pendulum arm) swingable with the both-side sun gear 116 as the center of rotation, reference numeral 118 denotes a both-side planetary gear A (second moving and rotating element) rotatably mounted to the both-side pendulum arm 117 and engaged with the both-side sun gear 116, and reference numeral 119 denotes a both-side planetary gear B (first moving and rotating element).

In FIG. 15A, reference numeral 120 denotes a spiral groove gear engaged with the both-side sun gear 116 through an idler gear, reference numeral 121 denotes a reverse rotation delay gear A engaged with the both-side planetary gear B119, reference numeral 122 denotes a reverse rotation delay gear B on the same axis as the reverse rotation delay gear A121, reference numeral 123 denotes a reverse rotation delay gear spring for applying relative biasing force between the reverse rotation delay gear A121 and the reverse rotation delay gear B122, reference numeral 124 denotes a both-side roller idler gear for connecting two both-side roller gears (reversing section roller gears), reference numeral 125 denotes a both-side roller gear A fixed to the both-side roller (reversing section roller) A108, reference numeral 126 denotes a both-side roller gear B fixed to the both-side roller (reversing section roller) B109, reference numeral 127 denotes a stop arm engaged in a groove of the spiral groove gear 120 and swinging, reference numeral 128 denotes a stop arm spring centering the stop arm 127, and reference numeral 132 denotes a both-side pendulum arm spring (biasing means) mounted to the both-side pendulum arm (rocker arm) 117.

As described above, in this embodiment, the driving force of the automatic both-side unit 2 as the sheet reversing section is obtained from the LF motor 26 for driving the sheet feeding roller 21. By such a construction, when the recording sheet is conveyed in cooperation with the sheet feeding roller 21, the reversing section roller (both-side roller) A108, or the reversing section roller (both-side roller) B109, timing of actuation and stopping and the recording sheet conveying speed are completely synchronized, and it is favorable to adopt such a construction. The driving force from the LF motor 26 is transmitted to the both-side sun gear 116 through the both-side transmission gear train 115. The swingable rocker arm (both-side pendulum arm) 117 is mounted to the both-side sun gear 116, and the both-side planetary gear A118 and the both-side planetary gear B119 are mounted to the both-side pendulum arm 117.

A proper friction force works between the both-side sun gear 116 and the both-side pendulum arm 117, and therefore the both-side pendulum arm 117 swings following the rotating direction of the both-side sun gear 116. Here, when the direction in which the LF motor 26 is rotated so that the sheet feeding roller 21 conveys the recording sheet in the sheet discharging direction is set as the forward direction, and the direction in which the recording sheet is conveyed to the automatic both-side unit 2 is set as the reverse direction, the both-side sun gear 116 rotates in the direction of the arrow a in FIG. 15A when the LF motor 26 rotates in the forward direction. Following the rotation of the both-side sun gear 116, the both-side pendulum arm 117 basically swings in the direction of the arrow a in FIG. 15A.

Then, the both-side planetary gear A118 is engaged with the both-side roller idler gear 124 and rotates the both-side roller idler gear 124. With the rotation of the both-side roller idler gear 124, the both-side roller gear A125 rotates in the direction of the arrow c in FIG. 15A, and the both-side roller gear B126 rotates in the direction of the arrow d in FIG. 15A. The direction of the arrow c and the direction of the arrow d in FIG. 15A are the directions in which the both-side roller A108 and the both-side roller B109 convey the recording sheet 4 in the sheet reversing section (automatic both-side unit) 2.

When the LF motor 26 rotates in the reverse direction, the both-side sun gear 116 rotates in the direction in the arrow b in FIG. 15A. With the rotation of the both-side sun gear 116, the both-side pendulum arm 117 basically swings in the direction of the arrow b in FIG. 15A. Then, the both-side planetary gear B119 engages with the reverse rotation delay gear A121. In the reverse rotation delay gear A121 and the reverse rotation delay gear B122, projections (engaging portions) 121*a* and 122*a* project from the thrust surfaces opposed to each other, and when considering that the reverse rotation delay gear B122 is fixed, they play the role of the clutch means of which projections are meshed with each other when the reverse rotation delay gear A121 makes one rotation.

Before the both-side planetary gear B119 engages the reverse rotation delay gear A121, the aforesaid projections 121*a* and 122*a* are biased in the directions to be away from each other by the reverse rotation delay gear spring 123 between the reverse rotation delay gear A121 and the reverse rotation delay gear B122, and therefore the reverse rotation delay gear B122 starts rotating after the reverse rotation delay gear A121 approximately makes one turn after the reverse rotation delay gear A121 starts rotating. The period from the time at which the LF motor 26 starts rotating in the reverse direction until the reverse rotation delay gear B122 starts rotating is the delay period during which the reversing section roller (both-side roller) A108 and the reversing section roller (both-side roller) B109 stop.

When the reverse rotation delay gear B122 rotates, it rotates the both-side roller gear A in the direction of the arrow c in FIG. 15A, and the both-side roller gear B in the direction of the arrow d in FIG. 15A through the both-side roller idler gear 124. This is the same direction as the rotating direction of the LF motor 26 when it is rotated in the forward direction. By such a mechanism, the reversing section roller A108 and the reversing section roller B109 can be always rotated in the recording medium conveying direction irrespective of the rotating direction of the LF motor 26.

Here, the operation of the spiral groove gear 120 and biasing force increasing means having a stop arm 127 will be explained. The spiral groove gear 120 has a gear surface formed on its outer circumference, and a cam with a spiral groove including endless tracks at the innermost circumference and the outermost circumference being provided is formed on an end surface of one side. The spiral groove gear 120 is directly connected with the both-side sun gear 116 through an idler gear in this embodiment, and therefore the spiral groove gear 120 rotated synchronously with the both-side sun gear 116 in the same direction. A follower pin 127*a* which is a part of the stop arm 127 is engaged in the groove of the spiral groove gear 120, and therefore the stop arm 127 swings following the rotation of the spiral groove gear 120. For example, when the spiral groove gear 120 rotates in the direction of the arrow e in FIG. 15A, the follower pin 127*a* is drawn into the inner circumference, and therefore the stop arm 127 swings in the direction of the arrow g in FIG. 15A. Even if the spiral groove gear 120 keeps rotating in the direction of the arrow e in FIG. 15A, the follower pin 127*a* enters the endless track at the innermost circumference, and therefore the stop arm 127 stops at a predetermined position.

When the spiral groove gear 120 rotates in the direction of the arrow f in FIG. 15A, on the other hand, the follower pin 127*a* moves toward the outer circumference, and the stop arm 127 swings in the direction of the arrow h in FIG. 15A. When the spiral groove gear 120 keeps rotating in the direction of the arrow f in FIG. 15A, the follower pin 127*a* also enters the endless track at the outermost circumference, and the stop arm 127 stops at a predetermined position. The stop arm spring 128 for centering with the vicinity of the center of the moving range of the stop arm 127 as the center is mounted to the top arm 127 to be able to smoothly move from the outermost and innermost endless track to the spiral groove when the direction of rotation of the spiral groove gear 120 is changed.

The stop arm 127 performing such an operation acts on the both-side pendulum arm spring (rocker arm spring) 132 mounted to the both-side pendulum arm (rocker arm) 117. The both-side pendulum arm spring 132 is mounted to the both-side pendulum arm 117, and is an elastic member extending in the direction of the stop arm 127. The tip end of the both-side pendulum arm spring 132 is always located further in the direction of the center of the spiral groove gear 120 as compared with the stop arm 127.

When the LF motor 26 rotates in the forward direction, it gives the following operation according to the above positional relationship. Namely, when the LF motor 26 rotates in the reverse direction, conveys the recording sheet 4 to the sheet reversing section 2, and reverses the recording sheet 4 from the front side to the back side, and the recording sheet 4 returns to the sheet feeding roller 21, the stop arm 127 rotates on the endless track at the outermost circumference with respect to the spiral groove gear 120 as shown in FIG. 16C. Thereafter, when the LF motor 26 is rotated in the forward direction and recording on the back side is performed, the stop arm 127 moves toward the inner circumference of the spiral groove gear 120. When the LF motor 26 rotates in the forward direction, the rocker arm 117 swings in the direction of the arrow a in FIG. 15A and transmits power, and therefore on the way toward the inner circumference, the stop arm 127 abuts to the both-side pendulum arm spring 132 as shown in FIG. 16D.

When the LF motor 26 further rotates in the forward direction, the stop arm 127 further moves to the inner circumference and elastically deforms the both-side pendulum arm spring 132, and therefore the biasing force of the both-side pendulum arm spring is increased. The attitude of the both-side pendulum arm 117 is determined by the balance of the force acting in the pressure angle direction when the tooth surfaces of the both-side planetary gear A118 and the both-side roller idler gear 124 are meshed with each other and the force to swing the both-side pendulum arm 117 in the direction of the arrow a in FIG. 15A, and the force of the repulsion force of the both-side pendulum arm spring 132. The repulsion force of the both-side pendulum arm spring 132 is set to be small in the case of this embodiment, and therefore even when the stop arm 127 is in the position where it is in the endless track on the innermost circumference as shown in FIG. 16E, power transmission between the both-side planetary gear A118 and the both-side roller idler gear 124 is continued by only elastically deforming the both-side pendulum arm spring 132.

Even when the operation of the LF motor 26 is in the stopped state when the LF motor 26 repeating rotation and stoppage by intermittent drive, the tooth surfaces of the both-side planetary gear A118 and the both-side roller idler gear 124 remains overlaying one another, and therefore both of them are not disengaged. However, when recording on the back surface of the recording sheet 4 is finished and drive transmission to the automatic both-side unit 2 becomes unnecessary, it is preferable to cut the drive from the viewpoint that the load on the LF motor 26 reduces. As a result, the following means is carried out when the drive transmission is desired to be cut out.

Figure 16A:
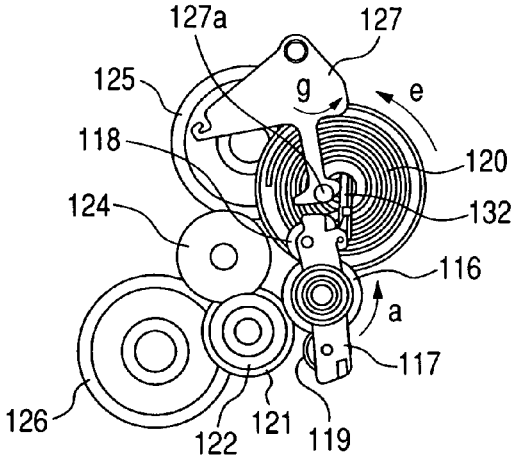
FIGS. 16A, 16B, 16C, 16D, 16E and 16F are schematic sectional side views showing an operation state of the driving mechanism (including clutch means) of the sheet reversing section (the automatic both-side unit) of the both-side recording apparatus according to the one embodiment of the present invention in sequence.
Figure 16D:
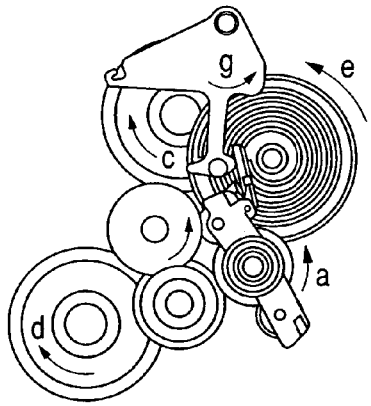
Figure 16B:
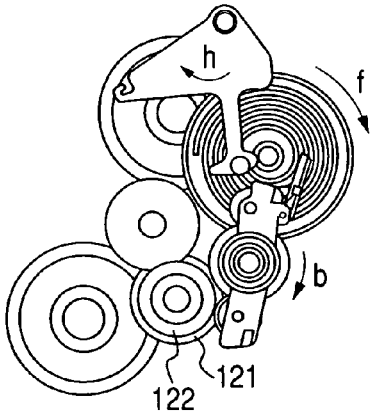
Figure 16E:
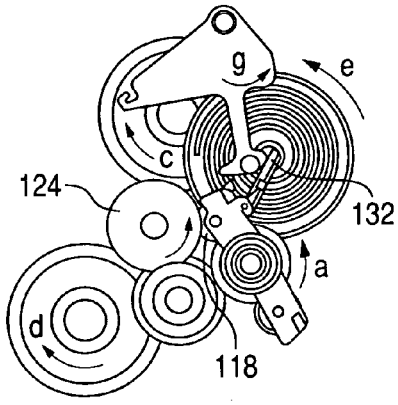
Figure 16C:
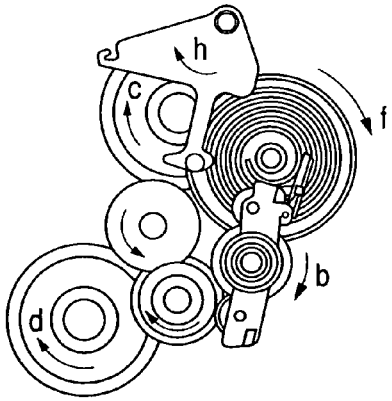
Figure 16F:
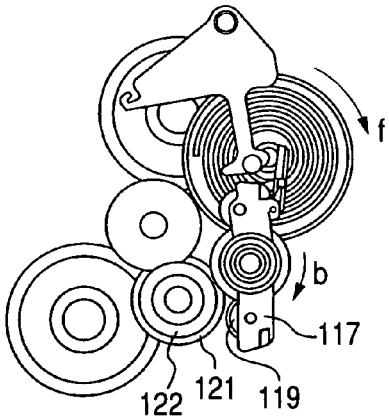

In other words, in the state in which the stop arm 127 is in the endless track on the innermost circumference and the both-side pendulum arm spring 132 is elastically deformed, the LF motor 26 is rotated slightly in the reverse direction as shown in FIG. 16F. Since the rotation in the direction to remove overlapping of the tooth surfaces when the overlapping of the tooth surfaces of the both-side planetary gear A118 and the both-side roller idler gear 124 stop the both-side pendulum arm 117 which is to rotate in the direction of the arrow b in FIG. 15A by the repulsion force of the both-side pendulum arm spring 132, the both-side pendulum arm 117 rotates in the direction of the arrow b in FIG. 15A at a dash.

Once the both-side pendulum arm 117 rotates in the direction of the arrow b in FIG. 15A, the both-side pendulum arm spring 132 elastically deformed returns into the original shape, and therefore the both-side pendulum arm spring 132 interferes with the stop arm 127 even if the LF motor 26 is rotated in the forward direction, and thus the both-side pendulum arm 117 cannot swing up to the position where the both-side planetary gear A118 and the both-side roller idler gear 124 are meshed with each other. Therefore, from this state, the driving force is not transmitted to the both-side pendulum arm 117 and the components therefrom in the automatic both-side unit 2 without going through a predetermined amount of reverse rotation of the LF motor 26. Since drive of the components to the both-side pendulum arm 117 is made only by rotating the gear train, the load exerted on the LF motor 26 is very low, and has approximately no difference from the load in the case without the automatic both-side unit 2.

When the LF motor 26 rotates in the reverse direction from the state in which the stop arm 127 is in the endless track on the innermost circumference, nothing acts on between the both-side pendulum arm spring 132 and the stop arm 127, and therefore driving force can be transmitted to the reverse rotation delay gear A121 as described above. The above is the general explanation of the rollers driving mechanism of the sheet reversing section 2.

Specifically, as is obvious from the above explanation, according to the constitution in FIGS. 15A, 15B, 15C and 15D and FIGS. 16A, 16B, 16C, 16D, 16E and 16F, in the both-side recording apparatus including the sheet feeding roller 21, the recording section N and the sheet reversing section 2, wherein after recording is performed onto the first surface (front side) of the recording medium 4 in the aforesaid recording section, the recording medium is conveyed to the aforesaid sheet reversing section by the aforesaid sheet feeding roller, the recording medium after being reversed is nipped by the aforesaid sheet feeding roller again and recording is performed onto the second surface (back side) of the recording medium; after the recording is performed onto the aforesaid first surface, the aforesaid reversing section roller starts the synchronous rotation with the aforesaid sheet feeding rollers 108 and 109 in a period of time from the start of the drive of the aforesaid sheet feeding roller until the tip end of the aforesaid recording medium is nipped by the reversing section roller 109 of the aforesaid sheet reversing section. The aforesaid reversing section rollers 108 and 109 start the synchronous rotation with the aforesaid sheet feeding roller 21 by the first clutch means which is connected by rotating the aforesaid sheet feeding roller 21 by a predetermined amount in the first rotating direction (the rotation in the reverse direction) in which the recording medium 4 is conveyed to the aforesaid sheet reversing section 2.

Figures 20, 20A:
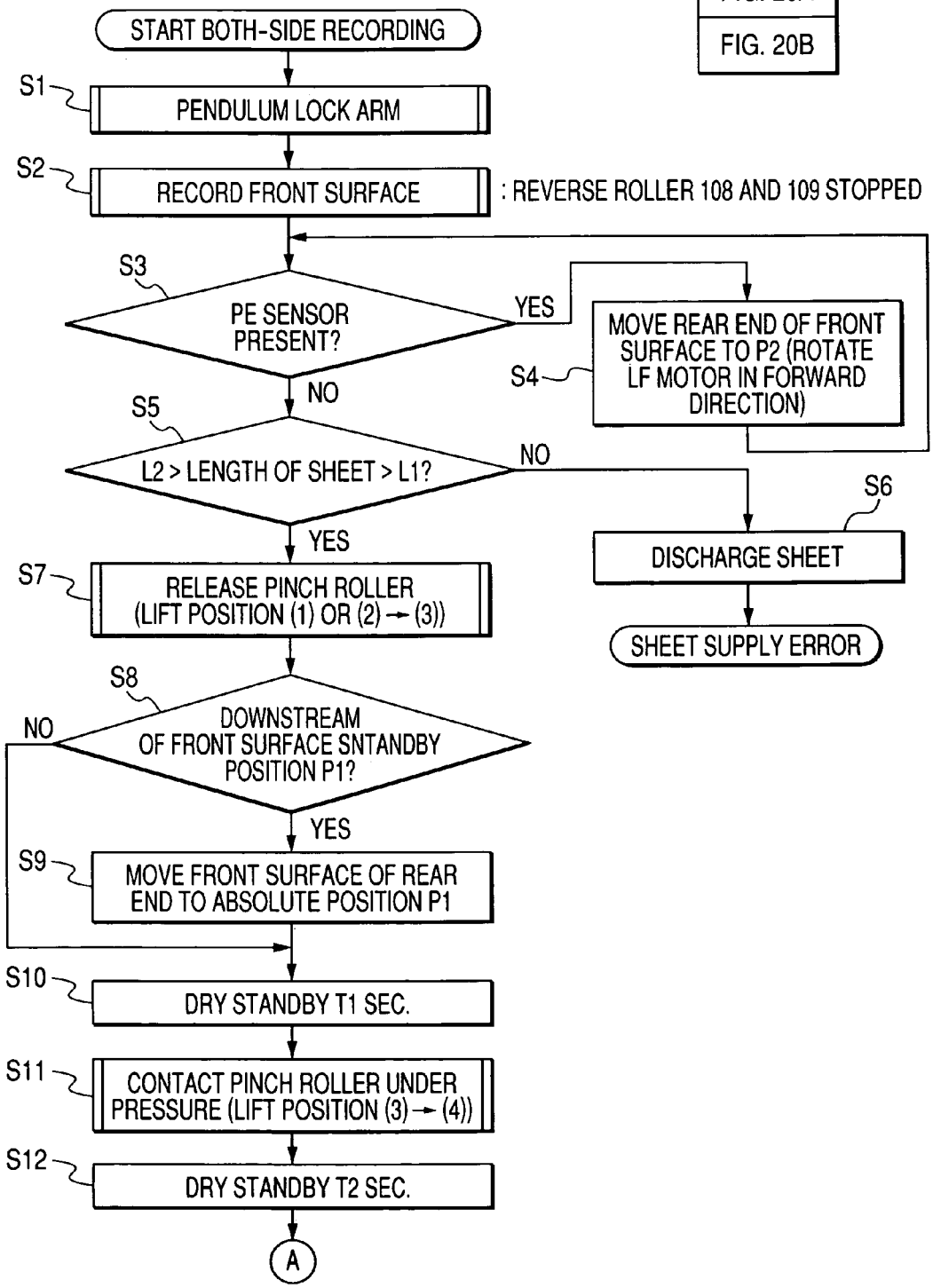
FIG. 20 is comprised of FIGS. 20A and 20B showing flowcharts for a sequence of an automatic both-side recording operation of the both-side recording apparatus according to the one embodiment of the present invention.
Figure 20B:
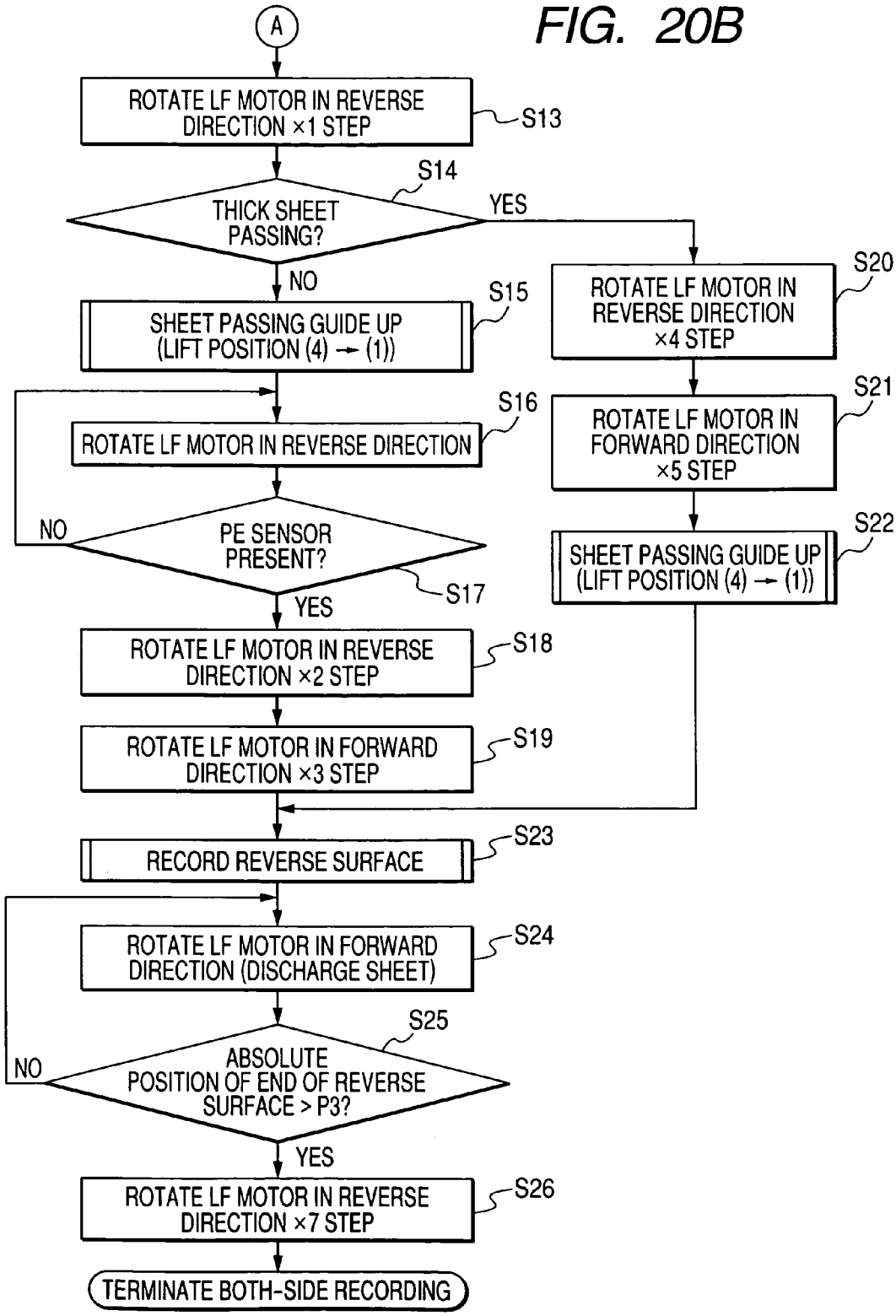

FIGS. 16A, 16B, 16C, 16D, 16E and 16F are schematic sectional side views for explaining the operation of the rollers driving mechanism of the automatic both-side unit 2 in FIG. 15A, and FIGS. 20A and 20B are flowcharts showing an operation sequence of the automatic both-side recording. Next, the details of the operation of the rollers driving mechanism of the automatic both-side unit 2 and the operation of the automatic both-side recording will be explained by using a flowchart in FIGS. 20A and 20B in combination. In FIGS. 16A, 16B, 16C, 16D, 16E and 16F and FIGS. 20A and 20B, the recording medium 4 is supplied in step S1 when the automatic both-side recording is started. For example, the recording sheet 4 is supplied to the sheet feeding roller 21 from the main ASF 37 or the like. Next, recording on the front surface (front side) is performed in step S2. This is the same operation as in the case of one-side recording. The state of the rollers driving mechanism at this time is the state shown in FIG. 16A.

FIG. 16A shows the state in which the LF motor 26 is rotating in the forward direction after the driving mechanism of the automatic both-side unit 2 is initialized. Namely, it shows the state during the operation of front-surface (front side) recording at the time of automatic both-side recording, the state during the operation of ordinary recording without using automatic both-side recording, and the like. In this state, the follower pin 127*a* of the stop arm 127 is in the endless track on the innermost circumference of the spiral groove gear 120, and when the both-side pendulum arm 117 abuts to the stop arm 127 when the both-side pendulum arm (rocker arm) 117 is to swing in the direction of the arrow a in FIG. 15A and FIGS. 16A, 16D and 16E, the both-side pendulum arm 117 cannot turn more than this since its arm spring 132 abuts to the stop arm 127, and therefore the both-side planetary gear A118 cannot engage with the both-side roller idler gear 124. Therefore, the driving force from the LF motor 26 cannot be transmitted to the both-side roller gear A125 and the both-side roller gear B126. In this state, the both-side roller A108 or the both-side roller B109, to which axial loss occurs by receiving the pressure of the both-side pinch roller A112 or the both-side pinch roller B113, does not rotate, and therefore the load exerted on the LF motor 26 is low.

Next, in step S3, it is confirmed whether the rear end of the recording sheet can be detected with the PE sensor 67 or not at the point of time when the front surface recording is finished. At this time, if the PE sensor 67 detects the presence of the recording sheet 4, it means that it cannot detect the rear end of the front surface of the recording sheet 4, and therefore in step S4, the rear end of the front surface of the recording sheet 4 is moved to a position p2 which is a little ahead of the PE sensor lever 66 by rotating the LF motor 26 in the forward direction as it is. Next, in step S5, the length of the recording sheet 4 is calculated from the amount by which the recording sheet 4 is conveyed until the PE sensor 67 detects the rear end of the font surface from the time when the PE sensor 67 detects the tip end of the front surface of the recording sheet 4.

As described above, in the case where the length of the recording sheet 4 is shorter than the predetermined length L1, the roller cannot reach the recording sheet 4 during the conveyance from and to the sheet feeding roller 21 to and from the both-side roller B109 or the both-side roller A108, and therefore it is necessary to exclude the case from the automatic both-side recording operation. In the case where the length of the recording sheet 4 is longer than the predetermined length L2, it is not preferable because the recorded surface crosses each other in the sheet passing path from the sheet feeding roller 21 to the automatic both-side unit 2, and it is necessary to exclude the case from the automatic both-side recording operation. In the case determined to be excluded from the automatic both-side recording operation under this condition, the process proceeds to the step S6, and the recording sheet 4 is discharged as it is by rotating the LF motor 26 in the forward direction. In the case where the conditions are satisfied, the process proceeds to step S7 next, and the lift mechanism is brought into the third position as shown in FIG. 10C to release (separate) the pinch roller 22.

Next, in step S8, it is confirmed whether the rear end of the front surface (front side) of the recording sheet 4 is already conveyed to the downstream side from the position p1 in the vicinity of the pinch roller 22 or not. When it is already conveyed to the downstream side, the recording sheet 4 is fed back by rotating the LF motor 26 in the reverse direction until the rear end of the front surface comes to the p1 in step S9 so that the rear end of the recording sheet 4 is reliably nipped by the sheet feeding roller 21 and the pinch roller 22 when the pinch roller 22 is returned to the pressure contact state. The state of the rollers driving mechanism at this time is the state shown in FIG. 16B. It is desirable that the operation is not stopped as much as possible from step S2 to step S8 and step S9 is carried out before the recording sheet 4 is deformed, as described above. When the rear end of the front surface is at the upstream side from the p1, it is possible to nip the recording sheet reliably if the pinch roller 22 is brought into contact with pressure as it is, and therefore the process proceeds to step S10 as it is.

Figure 15C:
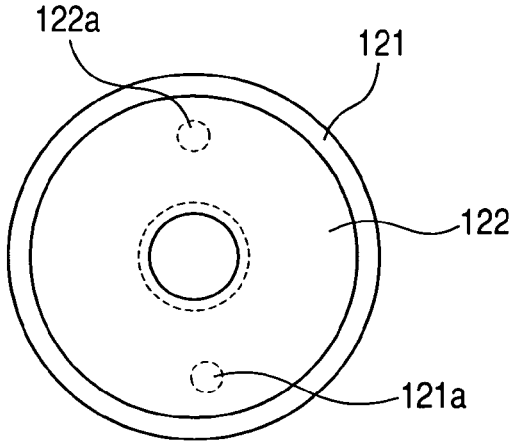

FIG. 16B shows the state immediately after the rotation in the reverse direction of the LF motor 26 starts. Namely, this is immediately after back feed is started after the front surface recording of the automatic both-side recording is finished (the state in FIG. 12B), or the case where the Lf motor 26 is rotated in the reverse direction for adjusting the feeding amount at the start after the sheet is supplied from the main ASF 37 or the like. At this time, nothing interferes with the both-side pendulum arm 117 to swing in the direction of the arrow b in FIG. 15A and FIGS. 16B, 16C and 16F, and therefore the both-side planetary gear B119 engages with the reverse rotation delay gear A121. With this, the reverse rotation delay gear A121 starts rotating with the projection 121*a* in the direction of the arrows in FIG. 15B, but since the projection 121*a* of the reverse rotation delay gear A does not engage with the projection 122*a* of the reverse rotation delay gear B122 as shown in FIG. 15C until the reverse rotation delay gear A121 rotates by approximately one rotation, the driving force is not transmitted to the reverse rotation delay gear B122. Therefore, the both-side roller idler gear 124 does not rotate, and the both-side roller A108 and the both-side roller B109 are not operated.

Accordingly, the LF motor 26 still receives a low load in this state. The reason why such a state is set is that there is some distance from the sheet feeding roller 21 to the both-side roller B109 when the recording sheet 4 is fed back at the time of automatic both-side recording, and therefore it is not necessary for the both-side roller B109 to rotate until the tip end of the recording sheet 4 reaches the both-side roller B109. Another reason is to prevent the both-side roller A108 or the both-side roller B109 from rotating needlessly at the time of adjusting the feeding amount at the start at the time of usual recording and the like as described above.

Next, standby time until the recorded ink on the front surface of the recording sheet 4 is dried is provided in step S10. The required drying time varies due to several factors as described above, and therefore it is possible to set the dry standby time t1 at a variable parameter. Specifically, t1 is determined by considering the conditions such as the kind of the recording sheet, the kind of ink, the overprinting method of the ink, the printing amount of ink per unit area, the ambient temperature, the ambient humidity, the ambient wind velocity and the like. Next, in step S11, the lift mechanism is brought into the fourth position as shown in FIG. 10D. Thereby, the recording sheet 4 is nipped with the sheet feeding roller 21 and the pinch roller 22 again.

Next, in step S12, a dry standby time t2 is provided. This may not be used in the case where the dry standby time t1 is carried out in step S10, and the process can proceed to the next step by setting t2=0. t2 is used since, in the case where the recording operation is not performed for the rear end portion of the recording sheet 4, for example, and a blank space exists, and at this time, even if the control is immediately conducted so that the pinch roller 22 is brought into pressure contact with the blank space with t1=0 in step S10, there is no problem. However, if the recording sheet 4 is fed back immediately as it is and is conveyed, there is the possibility that ink before being dried is transferred to the pinch roller 22, and therefore the dry standby time t2 is used.

Next, in step S13, the LF motor 26 is rotated in the reverse direction, and the recording sheet is fed back by a predetermined amount×1. In this step, the recording sheet 4 is conveyed to the automatic both-side unit 2 and reverses the recording sheet 4 from the front side to the back side. When this step is finished, the tip end of the back surface returns to a position a little back from the sheet feeding roller 21. The state of the rollers driving mechanism up to this, is the state shown in FIG. 16C.

Figure 15D:
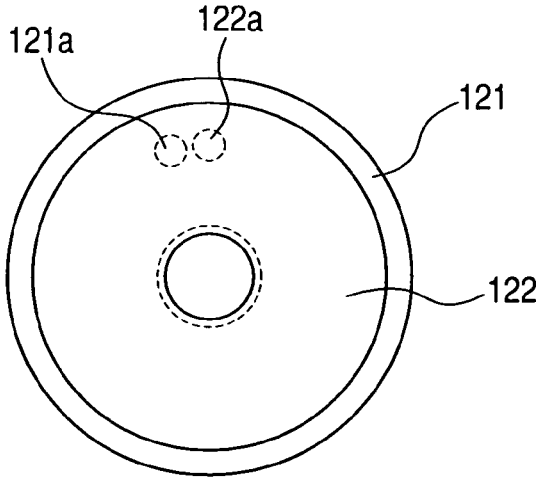

FIG. 16C shows the state in which the LF motor 26 is further continued to rotate in the reverse direction. Namely, this is the state in which the recording sheet 4 is fed back and reversed in the automatic both-side unit 2. From the state in FIG. 16B on, when the reverse rotation delay gear 121 rotates by approximately one rotation, the projection 121*a* projecting in the thrust direction of the reverse rotation delay gear A121 engages with the projection 122*a* of the reverse rotation delay gear B122 provided to be opposed as shown in FIG. 15D, and the reverse rotation delay gear A121 and the reverse rotation delay gear B122 are integrated and start rotating. When the reverse rotation delay gear B122 starts rotating, the both-side roller idler gear 124 and the both-side roller gear A125, and the both-side roller gear B126 rotates since the reverse rotation delay gear B122 is always engaged with the both-side roller idler gear 124. As a result, the both-side roller A108 rotates in the direction of the arrow c in FIG. 15A, and the both-side roller B109 rotates in the direction of the arrow d in FIG. 15A, respectively.

Specifically, in this embodiment, in the both-side recording apparatus including the sheet feeding roller 21, the recording section 11 and the sheet reversing section 2, wherein after recording is performed onto the first surface (front side) of the recording medium 4 in the aforesaid recording section, the recording medium is conveyed to the aforesaid sheet reversing section by the aforesaid sheet feeding roller, the recording medium after being reversed is nipped by the aforesaid sheet feeding roller again and recording is performed onto the second surface (back side) of the recording medium; after the recording is performed onto the aforesaid first surface (front side), the aforesaid reversing section roller 109 starts the synchronous rotation with the aforesaid sheet feeding roller 21 in a period of time from the start of the drive of the aforesaid sheet feeding roller 21 until the tip end of the aforesaid recording medium 4 is nipped by the reversing section roller 109 of the aforesaid sheet reversing section 2.

In the above-described constitution, the aforesaid reversing section roller 109 starts the synchronous rotation with the aforesaid sheet feeding roller 21 by the first clutch means (FIGS. 15A, 15B, 15C and 15D, and FIGS. 16A, 16B, 16C, 16D, 16E and 16F) which is connected by rotating the aforesaid sheet feeding roller 21 by a predetermined amount in the first rotating direction (the rotation in the reverse direction) in which the recording medium 4 is conveyed to the aforesaid sheet reversing section 2. As the aforesaid first clutch means, the one with the construction including the mechanisms 120, 127 and 132 which restrain the rocker arm 117 holding the planetary gears 118 and 119 is adopted.

Alternatively, the construction including a delay clutch having the input rotating element 121 to which the drive is inputted, and the output rotating element 122 which outputs the drive, wherein the rotation of the input rotating element is transmitted to the output rotating element after the input rotating element 121 is rotated by a predetermined angle.

Next, a so-called registration operation when the tip end of the back surface is nipped by the nip portion of the sheet feeding roller 21 and the pinch roller 22 will be explained. First, in step S14, the control is switched depending on whether the recording sheet 4 used at present is thin paper with low rigidity, or thick paper with high rigidity. The determination of the rigidity of the recording sheet 4 may be made according to the kind of the recording sheet set by the user with a printer driver or the like, or may be made by using the detection means for measuring the thickness of the recording sheet. The reason why the control is divided into two is that the behavior when a loop is made by bending the recording sheet 4 differs in accordance with the rigidity of the recording sheet.

Figure 18A:
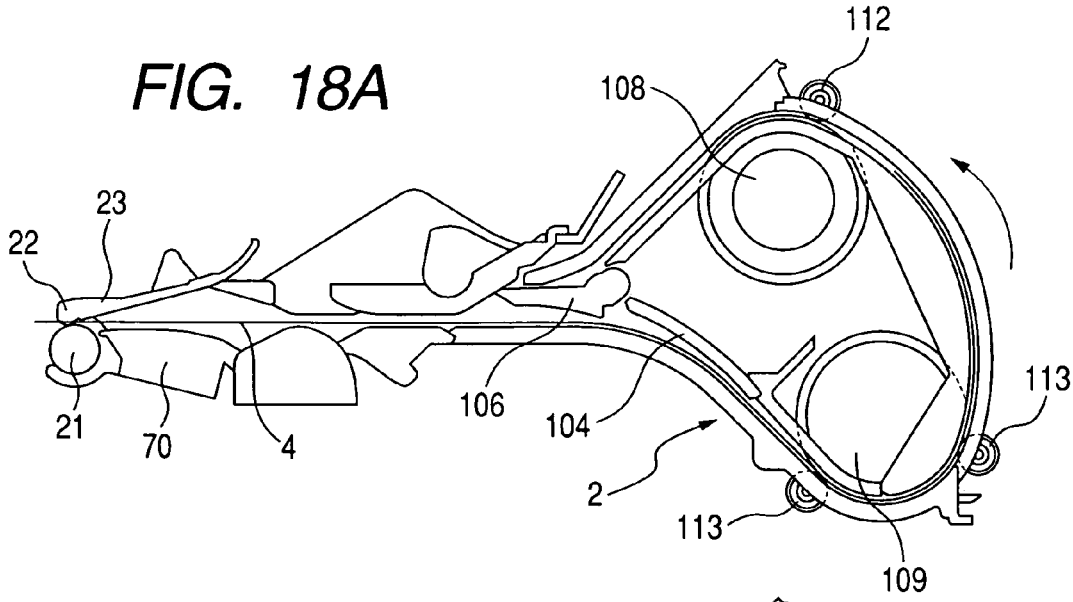
FIGS. 18A, 18B and 18C are schematic sectional side views showing a back surface tip end registration operation in the case of using a thin recording medium in the both-side recording apparatus according to the one embodiment of the present invention.
Figure 18B:
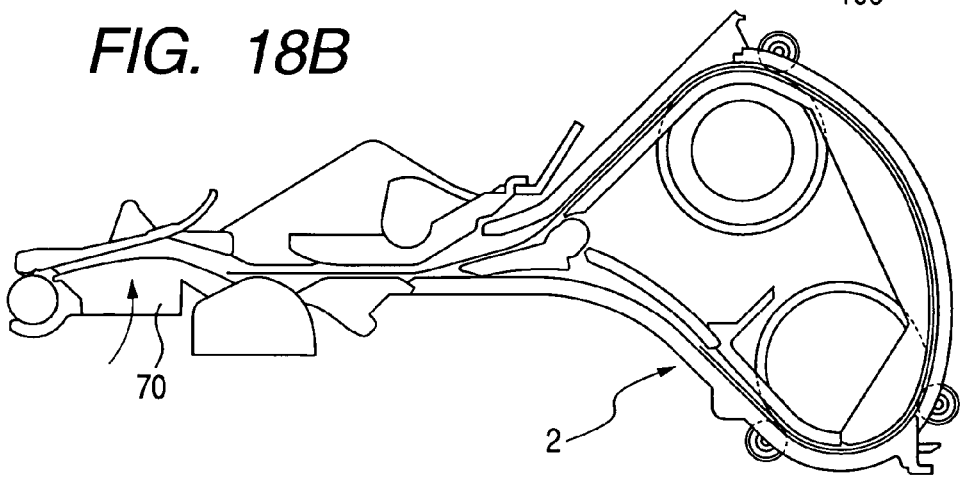
Figure 18C:
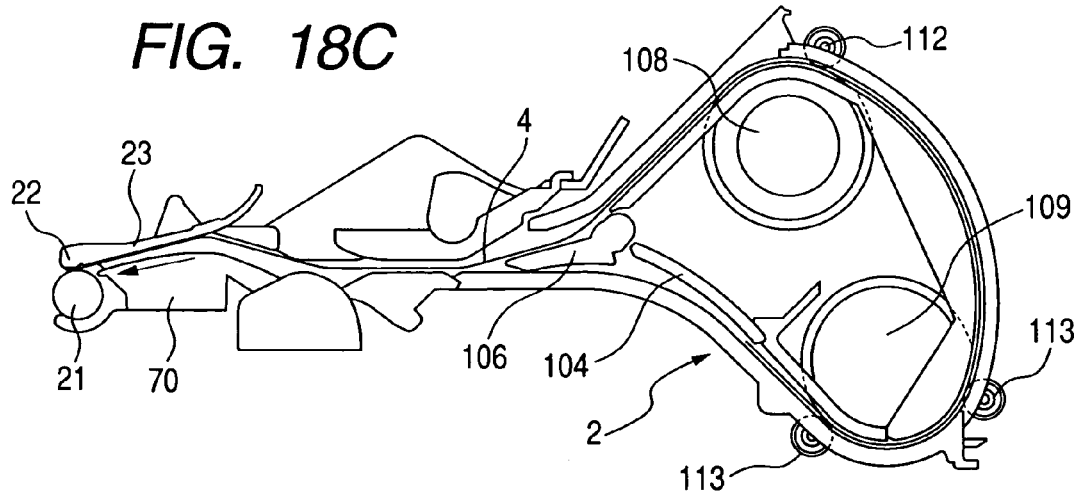

First, the case of a thin recording sheet with comparatively low rigidity will be explained. FIGS. 18A, 18B and 18C are schematic sectional side views showing a registration operation of the back surface tip end when a thin recording sheet is used. In FIGS. 20A and 20B and FIGS. 18A, 18B and 18C, the sheet reversing conveyance in FIG. 18A is performed by the reverse direction rotation of the LF motor 26 in step S13. When step S13 is finished, the tip end of the back surface of the recording sheet returns approximately in the vicinity of the sheet passing guide 70. In the case of the thin recording sheet, the process proceeds to step S15, next. In step S15, the lift mechanism is operated, and shifted into the first position as shown in FIG. 10A. Thereby, the sheet passing guide 70 is raised.

FIG. 18B shows the state in which step S15 finishes. The center of the pinch roller 22 is disposed at the side of the first paper discharging roller 30 with a little offset with respect to the center of the sheet feeding roller 21 as described above, and therefore the nip (portion) of the sheet feeding roller 21 and the pinch roller 22 has a small angle with respect to an approximately horizontal line along which the recording sheet 4 is conveyed. By returning the sheet passing guide 70 into the rising position before the registration operation, it is possible to smoothly guide the tip end of the back surface of the recording sheet 4 to this inclined nip portion. Next, in step S16, the LF motor 26 is rotated in the reverse direction, and the recording sheet 4 is further conveyed toward the sheet feeding roller 21. Next, in step S17, the tip end of the back surface of the recording sheet 4 is detected with the PE sensor 67. When the back surface tip end can be detected, the process proceeds to step S18.

Next, in step S18, the recording sheet 4 is conveyed by the distance, which is longer than the distance to the sheet feeding roller 21 from the back surface tip end detecting position by the PE sensor 67, ×2. As a result, the tip end of the back surface of the recording sheet 4 reaches the nip portion of the sheet feeding roller 21 and the pinch roller 22, and excessive conveyed amount bends the recording sheet 4, whereby the loop is formed. FIG. 18C shows the state in which step S18 finished. As a result that the sheet passing guide 70 is in the rising position, a clearance in the height direction of the sheet passing path reduces, but the loop is easily formed to push the sheet since the rigidity of the recording sheet 4 is comparatively low, and therefore the tip end portion of the back surface of the recording sheet 4 follows the nip portion of the sheet feeding roller 21 continuing reversing and the pinch roller 22 and becomes parallel to the sheet feeding roller 21, whereby a so-called registration operation is completed. Next, in step S19, the rotating direction of the LF motor 26 is changed to the forward rotation, and the tip end of the back surface of the recording sheet 4 is nipped by the nip portion, and conveyed by the predetermined distance×3, whereby preparation of the start of back surface recording is completed.

Figure 19A:
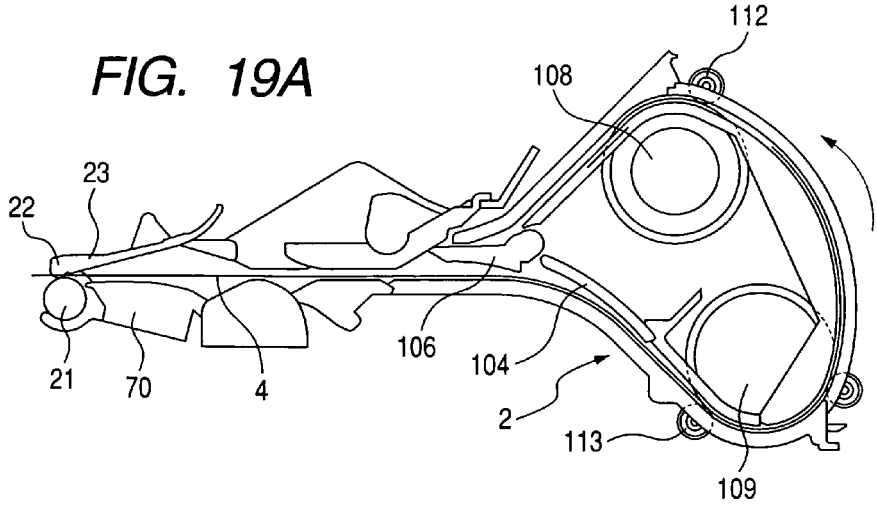
FIGS. 19A, 19B and 19C are schematic sectional side views showing a back surface tip end registration operation in the case of using a thick recording medium in the both-side recording apparatus according to the one embodiment of the present invention.
Figure 19B:
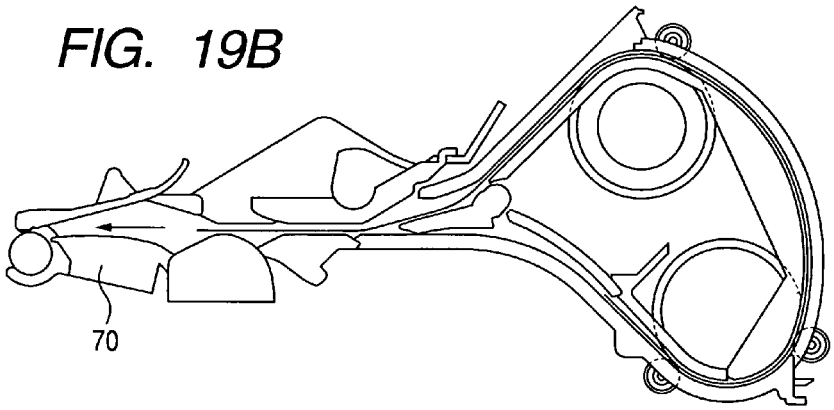
Figure 19C:
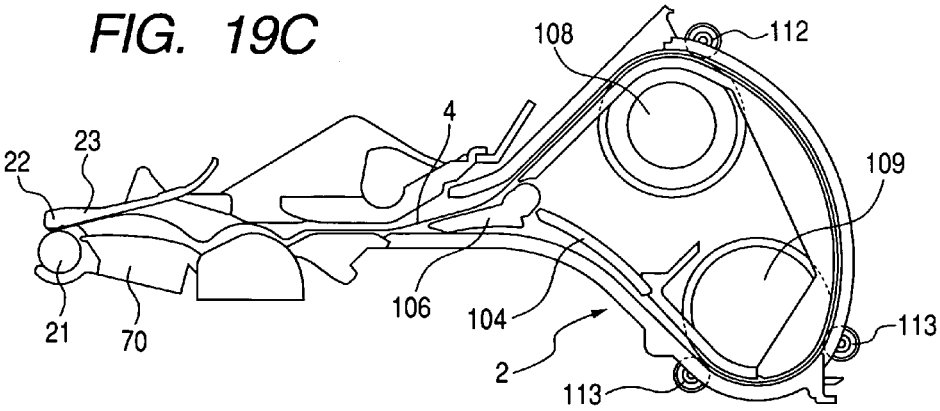

Next, the case of a thick recording medium (recording sheet) with comparatively high rigidity will be explained. FIGS. 19A, 19B and 19C are schematic sectional side views showing a registration operation of the tip end of the back surface when a thick recording sheet is used. FIG. 19A shows the state in the middle of step S13 as in FIG. 18A, and FIG. 19B shows the state in which step S13 finishes. Next, in step S20, the LF motor 26 is rotated in the reverse direction while the sheet passing guide 70 remaining in the lowering position, and the recording sheet 4 is conveyed by the distance, which is a little longer than the distance to the nip of the sheet feeding roller 21 from the tip end of the back surface of the recording sheet 4 at the stopped position in step S13, ×4. As a result, as in the case of the thin recording sheet, the tip end of the back surface of the recording sheet reaches the nip portion of the sheet feeding roller 21 rotating in the reverse direction, and the loop is formed by the amount of the sheet further pushed in. Therefore, the tip end of the back surface of the recording sheet 4 is parallel to the sheet feeding roller 21, and the registration operation is completed. FIG. 19C shows the state in which step S20 finished.

Next, in step S21, the rotating direction of the LF motor 26 is changed to the forward direction, the tip end of the back surface of the recording sheet 4 is nipped and conveyed by the predetermined distance×3, and thereby the start of the back surface recording is prepared. In step S19 or step S21, the LF motor 26 rotated in the reverse direction so far changes the rotating direction to the rotation of the forward direction. At this time, the both-side pendulum arm 117 swings in the direction of the arrow a in FIG. 15A. Then, the engagement of the both-side planetary gear B119 and the reverse rotation delay gear A121 is released. At the time of reverse direction rotation of the LF motor 26, the reverse rotation delay gear A121 and the reverse rotation delay gear B122 are engaged by the projections, and at the same time, the reverse rotation delay gear spring 123 being the torsion coil spring inserted between both of them is in a compressed state, but since the reverse rotation delay gear spring 123 extends as a result that the reverse rotation delay gear A121 is in a free state, the reverse rotation delay gear A121 rotates in the reverse direction by approximately one rotation, and returns to the initial state as shown in FIG. 16F.

Next, in step S22, the lift mechanism is set in the first position as shown in FIG. 10A, and the preparation of the start of the back surface recording is completed. Here, the reason whey the sheet passing guide 70 is in the lowering position while registration operation is performed in the case of using the thick recording sheet will be explained. As in the case of the thin recording sheet, when the loop is to be generated as in FIG. 18C, the recording sheet 4 is conveyed along the pinch roll holder 23 before the recording sheet 4 reaches the nip portion because the rigidity of the recording sheet is high. As a result, when the recording sheet is further conveyed to generate a loop after the recording sheet reaches the nip portion, the loop generation space does not exist already, and the loop is not generated. As a result, there can be the case in which registration is not taken well.

When the loop is not generated, slack (sag) does not occur to the recording sheet nipped between the both-side roller A108 and the sheet feeding roller 21 at the same time. As in this embodiment, when such a mechanism as the both-side pendulum arm 117 is used for the both-side rollers driving mechanism, the time in which the both-side pendulum arm 117 swings is needed during the time from the reverse rotation of the LF motor 26 in step S20 to the forward rotation of the LF motor 26 in step S21, and during that period, the both-side roller A108 and the both-side roller B109 stop.

Since the sheet feeding roller 21 is directly connected to the LF motor 26, it does not have the stopping period, and therefore a contradiction arises in the sheet conveying speed. If there is a slack of the recording sheet, the contradiction in the sheet conveying speed can be absorbed by the amount of the slack taken away during step S21. However, if there is no slack, the contradiction in the sheet conveying speed cannot be absorbed, and the sheet feeding roller 21 is to forcefully convey the recording sheet, but the rear side of the recording sheet 4 is nipped by the both-side roller A108, thus causing the situation in which the recording sheet 4 is not actually conveyed. As a result, the conveying amount of the tip end of the back surface of the recording sheet 4 does not stay in adjustment, and the upper end blank space of the back surface is sometimes shorter than estimated. In order to solve the above-described situation, the clearance in the height direction from the pinch holder 23 is sufficiently taken by locating the sheet passing guide 70 in the lowering position, and the loop generating space is secured. As a result, even when a thick recording sheet with comparatively high rigidity is used, favorable registration operation becomes also possible.

Next, in step S23, recording on the back surface of the recording sheet 4 is performed. At this time, the rear end portion of the back surface of most of the recording sheet 4 is nipped by the both-side roller A108. It is not preferable to stop the rotation of the both-side roller A108 as it is, because the load to pull the recording sheet backward is applied, and there arises the fear that the sheet conveying accuracy is deteriorated. As a result, while at least the rear end portion of the back surface of the recording sheet 4 is nipped by the both-side roller A108, the drive of the both-side roller A108 is continued. The state of the both-side rollers driving mechanism at this time is in the state as shown in FIG. 16D.

FIG. 16D is a schematic sectional side view showing an operation state of the rollers driving mechanism of the automatic both-side unit 2 while the LFR motor 26 is rotating in the forward direction after the reverse rotation operation of the recording sheet. Namely, when the LF motor 26 changes the rotation to the forward rotation from the state of FIG. 16C, the both-side pendulum arm 117 swings in the direction of the arrow a in FIG. 15A. At this time,.the stop arm 127 swings in the direction of the arrow h in FIG. 15A, and even if the both-side pendulum arm 117 swings in the direction of the arrow a in FIG. 15A, the both-side pendulum arm spring 132 does not abut to the stop arm 127. Therefore, the both-side planetary gear A118 engages with the both-side roller idler gear 124 and the driving force is transmitted.

Thereafter, when the forward rotation of the LF motor 26 continues, the follower pin 127*a* is guided by the spiral groove gear 120 and moves toward the inner circumference, and the stop arm 127 slides in the direction of the arrow g in FIG. 15A. On the way to swing, the stop arm 127 abuts to the both-side pendulum arm spring 132, and deforms the both-side pendulum arm spring 132. The force to swing the both-side pendulum arm 117 in the direction of the arrow b in FIG. 15A works on the both-side pendulum arm 117 due to the counter force by deformation of the both-side pendulum arm spring 132, but during driving force transmission between the both-side planetary gear A118 and the both-side roller idler gear 124, the meshing force of the gear tooth surfaces is stronger, and therefore drive is continued without releasing the engagement of the both-side planetary gear A118 and the both-side roller idler gear 124. FIG. 16D shows this state.

As described above, even when intermittent drive accompanied by rotation and stopping is performed, the tooth surfaces of the gears overlay each other, and therefore the engagement of the both-side planetary gear A118 and the both-side roller idler gear 124 is not released. When the recording operation on the back surface of the recording sheet 4 is further continued and the LF motor 26 is rotated in the forward direction, the follower pin 127*a* reaches the innermost circumferential portion of the spiral groove gear 120. The state of the both-side rollers driving mechanism at this time is the state as shown in FIG. 16E. At this time, the both-side pendulum arm spring 132 is in the maximum deformed state, but the load of the both-side pendulum arm sprint 132 is set so that the meshing force of the gear tooth surfaces is larger than the force to swing the both-side pendulum arm 117 even then, and therefore the engagement of the gears is not released as long as the LF motor 26 is rotated in the forward direction. As the recording operation onto the back surface of the recording sheet 4 is thus finished, the process proceeds to step S24.

Next, in step S24, a sheet discharging operation for discharging the recording sheet 4 onto a sheet discharging tray not shown is carried out. The sheet discharging operation is carried out by conveying the recording sheet 4 outside the recording unit body 1 by the second sheet discharging roller 31 by continuing the forward direction rotation of the LF motor 26. Next, in step S25, check of the absolute position of the tip end of the back surface is carried out. This is carried out because the follower pin 127*a* sometimes does not reach the innermost circumference of the spiral groove gear 120 when a short recording sheet is used. In this case, when back surface recording operation of the recording sheet 4 is finished by rotating the LF motor 26 by predetermined length, the follower pin 127*a* is always comes to the innermost circumference of the spiral groove gear 120.

Next, in step S26, initialization of the both-side rollers driving mechanism is carried out. As describe above, the force charged in the both-side pendulum arm spring 132 is held by the engagement of the both-side planetary gear A118 and the both-side roller idler gear 124, and therefore the engagement is release by only rotating the LF motor 26 in the reverse direction by a very small amount. Namely, when the LF motor 26 is rotated in the reverse direction, the both-side pendulum arm 117 is to swing in the direction of the arrow b in FIG. 15A and FIGS. 16B, 16C and 16F, and therefore the engagement of the both-side planetary gear A118 and the both-side roller idler gear 124 is released, and by the charged force of the both-side pendulum arm spring 132 returning to the original state, it swings in the direction of the arrow b in FIG. 15A and FIGS. 16B, 16C and 16F at a dash. The state of the both-side rollers driving mechanism at this time is the state shown in FIG. 16F.

In this state of FIG. 16F, the posture of the both-side pendulum arm spring 132 returns to the original posture, and therefore when the LF motor 26 rotates in the forward direction, the both-side pendulum arm 117 is to swing in the direction of the arrow a in FIG. 15A. However, since the follower pin 127*a* is in the vicinity of the innermost circumference of the spiral groove gear 120, the both-side pendulum arm spring 132 abuts to the stop arm 127, and the both-side planetary gear A118 cannot be engaged with the both-side roller idler gear 124. Further, even if the LF motor 26 is further rotated in the forward direction, the follower pin 127*a* continues to rotate on the innermost circumference of the spiral groove gear 120, and therefore the both-side roller A108 and the both-side roller B109 are not driven.

Specifically, the both-side recording apparatus according to this embodiment is, in the both-side recording apparatus including the sheet feeding roller 21, the recording section 11 and the sheet reversing section 2, wherein after recording is performed onto the first surface (front side) of the recording medium 4 in the aforesaid recording section, the recording medium is conveyed to the aforesaid sheet reversing section by the aforesaid sheet feeding roller, the recording medium after being reversed is nipped by the aforesaid sheet feeding roller again and recording is performed onto the second surface (back side) of the recording medium, constructed so that after the aforesaid recording medium 4 is conveyed from the aforesaid sheet reversing section 2 and the recording medium is nipped by the aforesaid sheet feeding roller 21 again, the aforesaid reversing section roller 108 does not rotate synchronously with the aforesaid sheet feeding roller 21 in a period of time from releasing of the rear end of the recording medium from the aforesaid reversing section roller 108 until the discharge operation of the recording medium is finished.

The above-described construction adopts the construction in which the aforesaid reversing section roller 108 does not rotate synchronously with the aforesaid sheet feeding roller 21 by the second clutch means (FIGS. 15A, 15B, 15C and 15D, and FIGS. 16A, 16B, 16C, 16D, 16E and 16F) which is cut off by rotating the aforesaid sheet feeding roller by a predetermined amount in the aforesaid first rotating direction (the rotation in the reverse direction), after the aforesaid sheet feeding roller is rotated by a predetermined amount in the second rotating direction (the rotation in the forward direction) in which the aforesaid recording medium 4 is conveyed in the direction toward the aforesaid sheet feeding roller 21 from the aforesaid sheet reversing section 2. The aforesaid second clutch means includes the mechanisms 120, 127 and 132 for restraining the rocker arm 117 holding the planetary gears 118 and 119. Further, the second clutch means includes a time difference mechanism by an end surface cam in a spiral shape (spiral groove gear 120) and a cam follower (stop arm 127).

In the above-described construction, as described above, after the recording is performed onto the first surface (front side), the reversing section roller 109 starts the synchronous rotation with the sheet feeding roller 21 in a period of time from the start of the drive of the sheet feeding roller 21 until the tip end of the recording medium 4 is nipped by the reversing section roller 109 of the sheet reversing section 2, and the reversing section roller 109 starts the synchronous rotation with the sheet feeding roller 21 by the first clutch means (FIGS. 15A, 15B, 15C and 15D, and FIGS. 16A, 16B, 16C, 16D, 16E and 16F) which is connected by rotating the sheet feeding roller 21 by a predetermined amount in the first rotating direction (the rotation in the reverse direction) in which the recording medium 4 is conveyed to the sheet reversing section 2.

In the state in FIG. 16F, as described above, the reverse rotation delay gear A121 is initialized in step S19 or in step S21, and therefore initialization of all of the both-side rollers driving mechanism is finished in this step S26. The automatic both-side recording operation is thus finished. When the automatic both-side recording operation is carried out in continuity, the same sequence is repeated. In this embodiment, elastic abutting relation is realized between the both-side pendulum arm 117 and the stop arm 127 by the action of the both-side pendulum arm spring 132 as explained above, but instead of this, it is also possible to adopt the following construction. Specifically, FIGS. 17A, 17B, 17C, 17D and 17E are schematic sectional side views showing an operation state of the rollers driving mechanism of the automatic both-side unit 2 as in FIGS. 16A, 16B, 16C, 16D, 16E and 16F. The both-side pendulum arm 117 in FIGS. 17A, 17B, 17C, 17D and 17E has an arm with less elasticity, and the arm and the stop arm 127 are in the relation capable of abutting. The operation with this construction will be briefly explained hereunder.

Figure 17A:
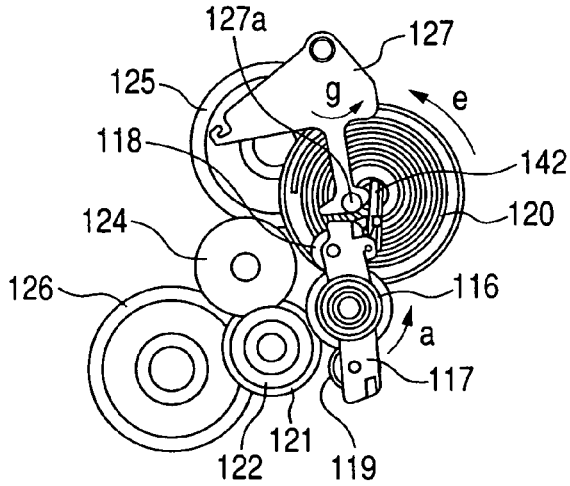
FIGS. 17A, 17B, 17C, 17D and 17E are schematic sectional side views showing another operation state of the driving mechanism (including the clutch means) of the sheet reversing section of the both-side recording apparatus according to the one embodiment of the present invention in sequence.
Figure 17D:
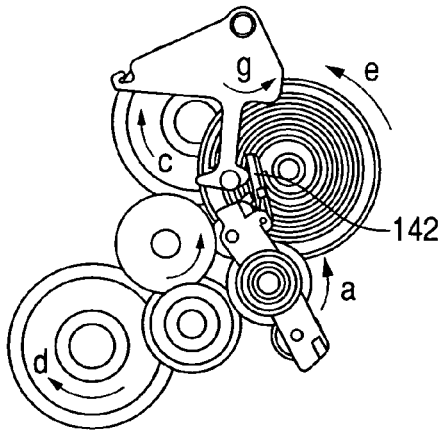
Figure 17B:
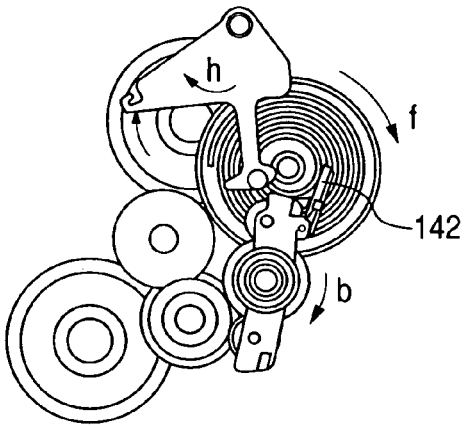
Figure 17E:
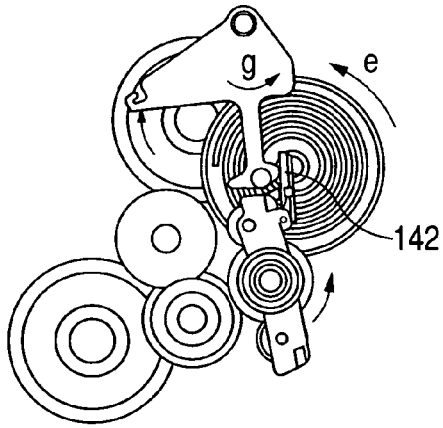
Figure 17C:
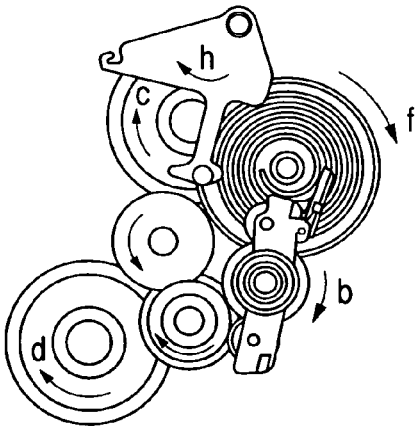

The operation from FIG. 17A to FIG. 17C is the same as the operation from FIG. 16A to FIG. 16C, and therefore the explanation will be omitted here. FIG. 17D shows the state in which the stop arm 127 moves in the direction of the inner circumference of the spiral groove gear 120 and abuts to the arm 142 of the rocker arm (both-side pendulum arm) 117. The arm 142 of the both-side pendulum arm 117 does not have much elasticity, and therefore when the arm is pressed by the stop arm 127, the force to rotate the both-side pendulum arm 117 in the direction of the arrow b in FIG. 15A works. The force works in the direction to release the engagement of the both-side planetary gear A118 and the both side roller idler gear 124.

The force to release the engagement balances with pressure works between the tooth surfaces of the both-side planetary gear A118 and the both-side roller idler gear 124 and elasticity of the tooth surfaces of the gears and sliding force, but the force to release the engagement becomes large as the follower pin 127*a* moves to the inner circumference, and overcomes the force between the tooth surfaces, and forcefully release the engagement of the both-side planetary gear A118 and the both-side roller idler gear 124. At the same time when the engagement is released, the rotations of the reversing section roller (both-side roller) A108 and the reversing section roller (both-side roller). B109 are stopped. FIG. 17E shows this state. As for the timing at which the rotation of the roller is stopped, the roller is stopped in a proper timing after the rear end of the back surface of the recording sheet 4 passes the both-side roller A108 in step S23.

Specifically, in the construction in FIGS. 17A, 17B, 17C, 17D and 17E, the reversing section roller 108 dose not rotate synchronously with the sheet feeding roller 21 by using the third clutch means 120, 127 and 142 which are cut off by rotating the sheet feeding roller 21 by a predetermined amount in the second rotating direction (the rotation in the forward direction) instead of the second clutch means explained in FIGS. 16A, 16B, 16C, 16D, 16E and 16F. The third clutch means in the construction in FIGS. 17A, 17B, 17C, 17D and 17E include the mechanism which forcefully displaces the rocker arm 117 holding the planetary gears 118 and 119, and further include the time difference mechanism by the end surface cam in the spiral shape (spiral groove gear 120) and the cam follower (stop arm 127).

In the both-side recording apparatus having the mechanism in FIGS. 17A, 17B, 17C, 17D and 17E, as described above, after the recording is performed onto the aforesaid first surface (front side), the aforesaid reversing section roller 109 starts the synchronous rotation with the aforesaid sheet feeding roller 21 in a period of time from the start of the drive of the aforesaid sheet feeding roller 21 until the tip end of the aforesaid recording medium 4 is nipped by the reversing section roller 109 of the aforesaid sheet reversing section 2, and further, the aforesaid reversing section roller 109 starts the synchronous rotation with the sheet feeding roller 21 by the first clutch means (FIGS. 15A, 15B, 15C and 15D, and FIGS. 16A, 16B, 16C, 16D, 16E and 16F) which is connected by rotating the aforesaid sheet feeding roller 21 by a predetermined amount in the first rotating direction (the rotation in the reverse direction) in which the recording medium 4 is conveyed to the aforesaid sheet reversing section 2.

After releasing the engagement of the gears as shown in FIG. 17C, the both-side pendulum arm 117 is prevented from swinging in the direction of the arrow a in FIG. 15A by the stop arm 127 even if the LF motor 26 is rotated in the forward direction, and therefore the automatic both-side unit 2 is not driven until the LF motor 26 rotates in the reverse direction by a predetermined amount next. As in the first embodiment, the reverse rotation delay gear A121 are also disengaged in step S19 or step S21, and therefore initialization of the rollers driving mechanism of the automatic both-side unit 2 is completed at this point of time. As a result, the load which rotates the both-side roller A108 and the both-side roller B109 can be eliminated during the recording operation on the back surface, and therefore it becomes possible to reduce the rotating load of the LF motor 26. The above is the explanation including the automatic both-side recording operation along the flowchart showing the operation sequence of the first embodiment of the both-side recording apparatus to which the present invention is applied.

Figure 23:
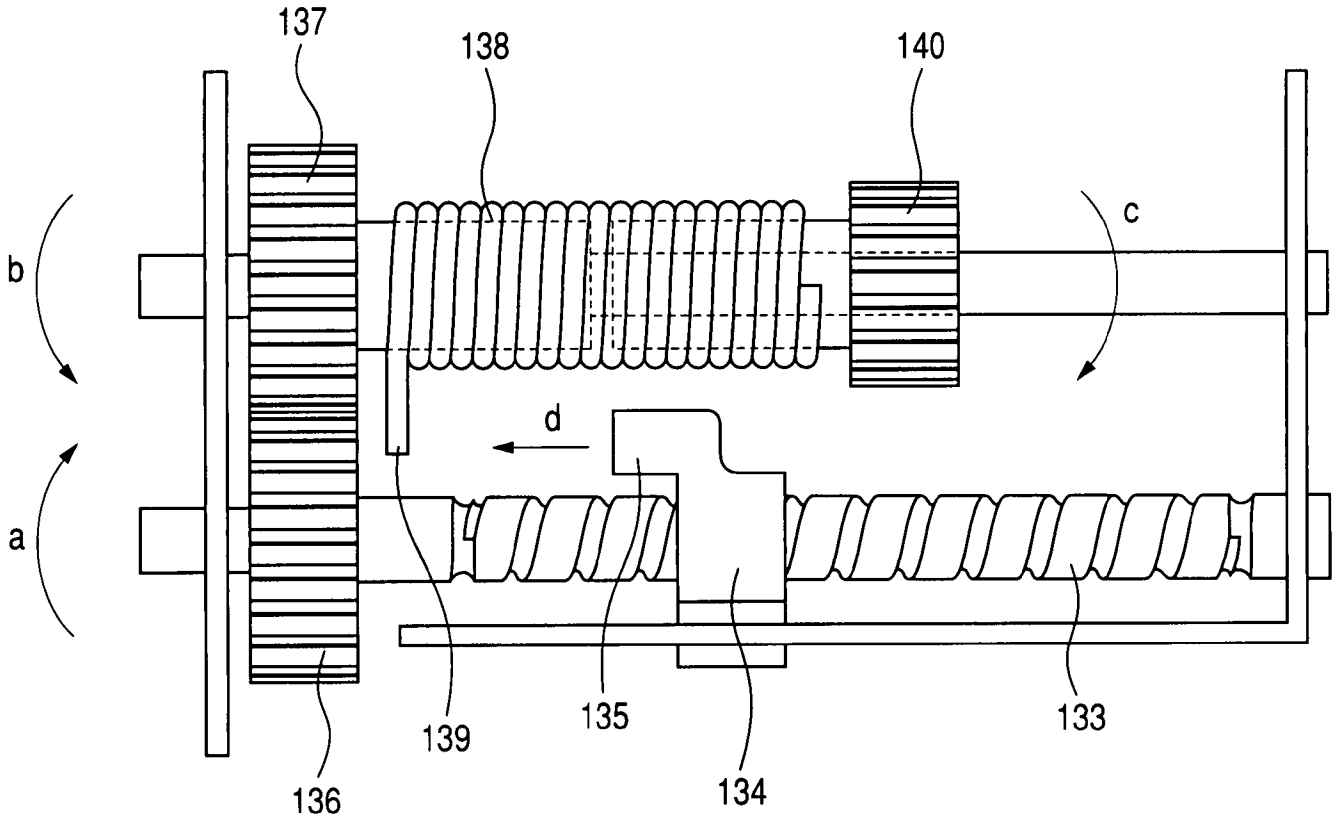
FIG. 23 is a schematic side view showing another construction example of the clutch means in the driving mechanism of the sheet reversing section (the automatic both-side unit) of the both-side recording apparatus according to another embodiment of the present invention.
Figures 20, 20A:
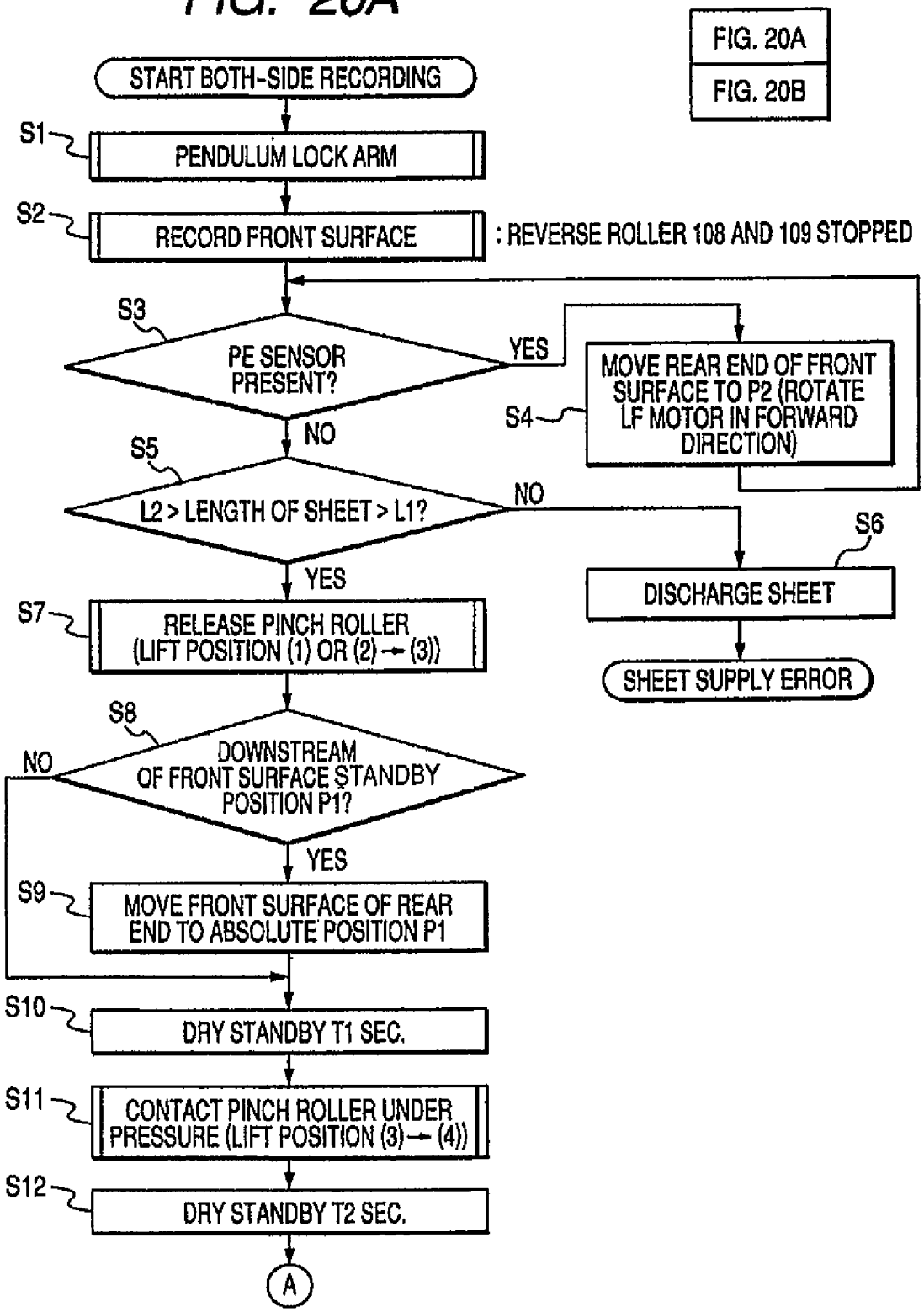

FIG. 23 is a schematic longitudinal sectional view showing a construction of an essential part of a second embodiment of the both-side recording apparatus to which the present invention is applied. In the embodiment explained thus far, the mechanism including the spiral groove gear 120 and the stop arm 127 is used as the clutch mechanism (clutch means) which cuts off the driving force from the LF motor 26 to the both-side roller (reversing section roller) 108 or 109, but instead of this, the following construction can be adopted. In FIG. 23, reference numeral 133 denotes a lead screw provided with a spiral groove on a cylindrical surface, reference numeral 134 denotes a slider which slides to engage in the spiral groove of the lead screw 133 and slides synchronously with the rotation, reference numeral 135 denotes a slider arm portion which is an extension of a part of the slider 134, reference numeral 136 denotes an input gear fixed to the lead screw 133, reference numeral 137 denotes a clutch gear which engages with the input gear 136, reference numeral 138 denotes a clutch spring which is mounted so as to wind around the cylindrical surfaces (shaft) of both of the clutch gear 137 and an output gear 140 to stretch over the both of the cylindrical surfaces, reference numeral 139 denotes a clutch spring arm portion which is an extension of a part of the clutch spring 138, and reference numeral 140 denotes an output gear which is engaged to be rotatable coaxially with the clutch gear 137.

The clutch mechanism shown in FIG. 23 is used by connecting the both-side transmission gear train 115 shown in FIG. 15A to the input gear 136, and connecting the output gear 140 to the both-side roller idler gear 124 (FIG. 15A). This clutch mechanism is assembled so that the input gear 136 is rotated in the direction of the arrow a in FIG. 23 when the LF motor 26 rotates in the forward direction. With only the mechanism in FIG. 23, the power is not transmitted to the output gear 140 when the LF motor 26 rotates in the reverse direction from the arrow a in FIG. 23. Therefore, the rocker arm and the planetary gear not shown are provided at the last gear of the both-side transmission gear train 115 (FIG. 15A) in this embodiment, so that only when the LF motor 26 rotates in the reverse direction, the rocker arm not shown is engaged with the reverse rotation delay gear A121 (FIG. 15A). As a result, the operation in FIGS. 17A to 17C is performed as in the case of the first embodiment. The operation from the FIG. 17D on, namely, the operation when the rotating direction of the LF motor 26 changes from the reverse direction to the forward direction will be explained specifically.

A lead pin which engages in the spiral groove of the lead screw 133 is projected on an inner circumference of the slider 134, and the rotation of the slider 134 is stopped by being guided by a chassis. Therefore, the slider 134 moves in the lateral direction in FIG. 23 following the rotation of the lead screw 133. Grooves with endless tracks are provided at both end portions of the spiral groove of the lead screw 133, and therefore, even if the lead screw 133 continues to be rotated, the slide 134 does not move further than the predetermined positions.

After the LF motor 26 rotates in the reverse direction, the slider 134 is in the state in which the slider 134 is pulled to the opposite direction from the arrow d (in the state in which it is pulled to the right side in the drawing). When the drive is transmitted to the input gear 136 in the direction of the arrow a in FIG. 23 from this state, the slider 134 starts to move slowly in the direction of the arrow d in FIG. 23. At the same time, the drive in the direction of the arrow b in FIG. 23 is transmitted to the clutch gear 137. The shaft portion (cylindrical portion) of the clutch gear 137 and the coil spring (clutch spring) 138 are set to be in the state in which they are engaged at the proper frictional coefficient with proper tightening torque, and therefore the clutch spring 138 starts to rotate following the rotation of the cylindrical portion (shaft portion) of the clutch gear 137 in the direction of the arrow b in FIG. 23.

On the other hand, the other end of the clutch spring 138 engages the cylindrical portion (shaft portion) of the output gear 140 with the same conditions, and therefore the clutch spring 138 receives the torque in the direction to inhibit the rotation from here. As a result, the clutch spring 138 starts to be twisted in the direction in which the inner diameter becomes small. A positive-feedback force acts on the frictional force of the cylindrical portion of the clutch gear 137 and the clutch spring 138, and the frictional force of the cylindrical portion of the output gear 140 and the clutch spring 138, and therefore the larger the load at the side of the output gear 140 is, the larger frictional force works. By this mechanism, the clutch spring (coil spring) 138 plays the role of the clutch which transmits the power between the clutch gear 137 and the output gear 140, and these three parts cooperate to rotate the output gear 140 in the direction of the arrow c in FIG. 23. This is the state corresponding to FIG. 17D.

When the LF motor 26 continues to rotate in the forward direction, the slider 134 moves in the direction of the arrow d in FIG. 23, and after a delay of a predetermined rotation amount which is determined the length of the lead screw 133 and the lead angle from the start of the rotation, the slider arm portion 135 moves to the position where it can abut to the clutch spring arm portion 139. Since the clutch spring 138 rotates with the clutch gear 137, the clutch spring arm portion 139 and the slider arm portion 135 abut to each other in some timing while the clutch gear 137 makes one rotation. Then, the reverse force from the force in the direction to make the inner diameter small which works so far works on the coil spring (clutch spring) 138. The inner diameter of the clutch spring 138 becomes large, and the frictional force between the cylindrical portion (shaft portion) of the clutch gear 137 and the clutch spring 138 is lost abruptly.

As a result, the cylindrical portion of the clutch gear 137 and the clutch spring 138 idle to be brought into the clutch cut-off state, and thus power transmission to the output gear 140 is stopped. As long as the LF motor 26 continues to rotate in the forward direction as it is, the slider 134 stops at the left end in FIG. 23, and therefore power is not transmitted to the output gear 140. This is the state corresponding to FIG. 17E, and in this state, the reversing section rollers (both-side rollers) 108 and 109 of the sheet reversing section 2 remain to be stopped.

Specifically, in the both-side recording apparatus using the clutch means (the third clutch means) explained in FIG. 23, in the both-side recording apparatus including the sheet feeding roller 21, the recording section 11 and the sheet reversing section 2, wherein after recording is performed onto the first surface (front side) of the recording medium 4 in the aforesaid recording section, the recording medium is conveyed to the aforesaid sheet reversing section by the aforesaid sheet feeding roller, the recording medium after being reversed is nipped by the aforesaid sheet feeding roller again and recording is performed onto the second surface (back side) of the recording medium, after the aforesaid recording medium 4 is conveyed from the aforesaid sheet reversing section 2 and the recording medium is nipped by the aforesaid sheet feeding roller 21 again, the aforesaid reversing section roller 108 does not rotate synchronously with the aforesaid sheet feeding roller 21 in a period of time from releasing of the rear end of the recording medium from the aforesaid reversing section roller 108 until the discharge operation of the recording medium is finished.

In the construction in FIG. 23, in place of the second clutch explained in FIGS. 16A to 16F, the third clutch means which is cut off by rotating the sheet feeding roller 21 by a predetermined amount in the second rotating direction (the rotation in the forward direction) is used, whereby the reversing section roller 108 does not rotate synchronously with the sheet feeding roller 21, and the third clutch means in this case includes the mechanism for fixing one end of the coil spring 138 of the clutch mechanism utilizing the winding force of the coil spring 138 around the shaft (cylindrical portion). The third clutch means in FIG. 23 has the construction including the time difference mechanism by the lead screw 133 and the lead pin (pin of the slider 134). As explained thus far, by using the clutch mechanism in FIG. 23, it becomes possible to give the operation (function) completely equal to the mechanism in FIGS. 17A, 17B and 17C to the both-side rollers (reversing section rollers) 108 and 109.

Further, in the both-side recording apparatus including the clutch mechanism in FIG. 23, as described above, after the recording is performed onto the first surface (front side), the reversing section roller 109 starts the synchronous rotation with the sheet feeding roller 21 in a period of time from the start of the drive of the sheet feeding roller 21 until the tip end of the recording medium 4 is nipped by the reversing section roller 109 of the sheet reversing section 2, and the reversing section roller 109 starts the synchronous rotation with the sheet feeding roller 21 by the first clutch means (FIGS. 15A, 15B, 15C and 15D, and FIGS. 16A, 16B, 16C, 16D, 16E and 16F) which is connected by rotating the sheet feeding roller 21 by a predetermined amount in the first rotating direction (the rotation in the reverse direction) in which the recording medium 4 is conveyed to the sheet reversing section 2.

The present invention is not limited to the construction explained above, and it is possible to adopt the control in which the positions of the lift mechanism explained in FIGS. 10A, 10B, 10C and 10D are changed. Namely, the sheet feeding guide 70 is in the up state in the normal standby state in the above, but it is possible to make it in the down state. Specifically, the normal lift mechanism is set at the third position as shown in FIG. 10C, and the control to move the lift mechanism to the first position as shown in FIG. 10A from this third position is added before step S1. The control to move the lift mechanism to the above-described third position from the above-described first position may be added after step S26. In the case of this construction, the pinch roller 22 is in a released state in the standby state, and therefore it is suitable for the time when thick sheet and the like are supplied from the sheet discharging roller side.

In the above-described embodiments, the explanation is made by citing a serial type recording apparatus recording while moving the recording head as the recording means in the main scanning direction as the example, but present invention can be similarly applied to the case of a line method recording apparatus by only auxiliary scanning (sheet feeding) by using line type recording means of the length covering an entire or a part of the width of the recording medium, and the same effect can be attained. The present invention can be freely carried out irrespective of the number of units of recording means, and can be similarly applied to a recording apparatus for color recording using a plurality of recording means using inks of different colors, or a recording apparatus for tone recording using a plurality of recording means using inks of the same color and different densities, and can be applied similarly to the case of a recording apparatus combining them other than the recording apparatus using one recording means, and the same effects can be attained.

Furthermore, when the recording apparatus is an ink jet recording apparatus, the present invention can be similarly applied to any case of the placement construction of the recording head and the ink tank, such as the construction using a replaceable head cartridge with the recording head and the ink tank are integrated, the construction in which the recording head and the link tank are in separate bodies, and they are connected with a tube and the like for supplying ink, and the like, and the same effects can be obtained. In the case where the recording apparatus is an ink jet recording apparatus, the present invention can be similarly provided to an ink jet recording apparatus using an ink jet recording head of a method of discharging ink by using an electromechanical transducer such as, for example, a piezo element, other than a recording apparatus using an ink jet recording head of a method of discharging ink utilizing thermal energy, and the same operations and effects can be attained.

As apparent from the above explanation, according to the both-side recording apparatus according to the present invention, the driving source of the sheet feeding roller and the driving source of the reversing section roller can be made the same driving source (common driving source), and the construction for starting the rotation of the reversing section roller immediately before the recording medium is nipped by the reversing section roller, or for stopping the rotation of the reversing section roller after the recording medium is nipped by the sheet feeding roller and is released from the reversing section roller can be easily realized. Thus, it is made possible to enhance the degree of freedom in the control by bringing the reversing section roller into the state in which it does not start the operation when the operation accompanied by the forward rotation and the reverse rotation of a predetermined amount or less such as the position adjustment of the recording medium of a very small amount before the start of recording. In addition, the driving source of the sheet feeding roller can be constructed to bear the load for driving the reversing section roller only when it is necessary. Therefore, the load on the driving source can be reduced, and reduction in the apparatus size, cost reduction and reduction in the driving electric power can be realized.

Further, since the reversing section roller can be constructed to be rotated only when it is necessary, rotation durability can be ensured without using a special material or a lubricant, and thus cost reduction in this aspect can be realized. Since the reversing section roller can be constructed to rotate only when it is necessary, frequency of the noise occurring from the drive gear train can be reduced, whereby noise reduction can be realized. The circumferential speeds of the sheet feeding roller and the reversing section roller can be easily synchronized, slack of the recording medium and occurrence of unnecessary tension can be prevented, and thus the conveyance accuracy can be enhanced. Further, an exclusive driving source is not always required, the reduction in size of the apparatus and reduction in cost can be realized.

What is claimed is:

1. A both-side recording apparatus comprising a sheet feeding roller, a recording section and a sheet reversing section, said apparatus controlled so that after recording is performed onto a first surface of a recording medium in said recording section, the recording medium is conveyed to said sheet reversing section by said sheet feeding roller, and the recording medium after being reversed is nipped by said sheet feeding roller again to perform recording onto a second surface of the recording medium, wherein said apparatus is further controlled so that after the recording is performed onto the first surface, a reversing section roller starts synchronous rotation with said sheet feeding roller in a period of time from a start of a drive of said sheet feeding roller to convey the recording medium to said sheet reversing section until a tip end of the recording medium is nipped by said reversing section roller of said sheet reversing section.

2. The both-side recording apparatus according to claim 1, wherein said reversing section roller starts the synchronous rotation with said sheet feeding roller by first clutch means which is connected by rotating said sheet feeding roller by a predetermined amount in a first rotating direction in which the recording medium is conveyed to said sheet reversing section.

3. The both-side recording apparatus according to claim 1, wherein after the recording medium is conveyed from said sheet reversing section and the recording medium is nipped by said sheet feeding roller again, said reversing section roller does not rotate synchronously with said sheet feeding roller in a period of time from releasing of a rear end of the recording medium from said reversing section roller until a discharge operation of the recording medium is finished.

4. The both-side recording apparatus according to claim 1, wherein said reversing section roller does not rotate synchronously with said sheet feeding roller by second clutch means which is cut off by rotating said sheet feeding roller by a predetermined amount in said first rotating direction, after said sheet feeding roller is rotated by a predetermined amount in a second rotating direction in which the recording medium is conveyed in a direction toward said sheet feeding roller from said sheet reversing section.

5. A both-side recording apparatus comprising a sheet feeding roller, a recording section and a sheet reversing section, wherein after recording is performed onto a first surface of a recording medium in said recording section, the recording medium is conveyed to said sheet reversing section by said sheet feeding roller, the recording medium after being reversed is nipped by said sheet feeding roller again and recording is performed onto a second surface of the recording medium, wherein after the recording medium is conveyed from said sheet reversing section and the recording medium is nipped by said sheet feeding roller again, said reversing section roller does not rotate synchronously with said sheet feeding roller in a period of time from releasing of a rear end of the recording medium from said reversing section roller until a discharge operation of the recording medium is finished.

6. The both-side recording apparatus according to claim 5, wherein said reversing section roller does not rotate synchronously with said sheet feeding roller by second clutch means which is cut off by rotating said sheet feeding roller by a predetermined amount in said first rotating direction, after said sheet feeding roller is rotated by a predetermined amount in a second rotating direction in which the recording medium is conveyed in a direction toward said sheet feeding roller from said sheet reversing section.

7. The both-side recording apparatus according to claim 6, wherein said second clutch means includes a mechanism for restraining a rocker arm holding planetary gears.

8. The both-side recording apparatus according to claim 5, wherein said reversing section roller does not rotate synchronously with said sheet feeding roller by third clutch means which is cut off by rotating said sheet feeding roller by a predetermined amount in said second rotating direction.

9. The both-side recording apparatus according to claim 8, wherein said third clutch means includes a mechanism for forcefully displacing a rocker arm holding planetary gears.

10. The both-side recording apparatus according to claim 8, wherein said third clutch means includes a mechanism for fixing one end of a coil spring of a clutch mechanism utilizing a winding force of a coil spring around a shaft.

11. The both-side recording apparatus according to any of claims 1 to 6, wherein a driving source of said sheet feeding roller and a driving source of said reversing section roller are the same driving source.

12. The both-side recording apparatus according to any one of claims 6 to 3, wherein said second clutch means or said third clutch means includes a time difference mechanism by an end surface cam in a spiral shape and a cam follower.

13. The both-side recording apparatus according to any one of claims 6 to 3, wherein said second clutch means or said third clutch means includes a time difference mechanism by a lead screw and a lead pin.

14. A sheet conveying device, comprising:

conveying means for conveying a sheet in a first direction and a second direction which is an opposite direction to said first direction;

drive means for driving said conveying means;

a reversing path for guiding the sheet conveyed in the first direction by said conveying means to be reversed from front to back or from back to front, and returning the sheet to said conveying means;

reverse conveying means for conveying the sheet in said reversing path; and drive transmission means for transmitting a drive of said drive means to said reverse conveying means, wherein said drive transmission means has a delay clutch for starting transmission of the drive after a predetermined amount of drive is inputted, when said drive means drives said conveying means in said first direction, the drive of said drive means is transmitted to said reverse conveying means through said delay clutch, and when said drive means drives said conveying means in said second direction, the drive of said drive means is transmitted to said reverse conveying means bypassing said delay clutch.

15. The sheet conveying device according to claim 14, wherein said delay clutch starts transmission of the drive after said drive means starts to drive said conveying means in the first direction and before the sheet reaches said reverse conveying means.

16. The sheet conveying device according to claim 15, wherein said delay clutch comprises an input rotating element to which the drive is inputted, and an output rotating element for outputting the drive, and transmits the drive by engaging an engaging portion provided at the input rotating element with an engaging portion provided at the output rotating element.

17. The sheet conveying device according to claim 16, wherein said drive transmission means has a rotating moving element which moves to a position where it transmits the drive to said input rotating element when said drive means drives said conveying means in said first direction, and moves to a position where it does not transmit the drive to said input rotating element when said drive means drives said conveying means in said second direction.

18. The sheet conveying device according to claim 17, wherein said drive transmission means has a second rotating moving element which is at a position where it does not transmit the drive to said reverse conveying means when said drive means drives said conveying means in said first direction, and moves to a position where it transmits the drive to said reverse conveying means when said drive means drives said conveying means in said second direction.

19. The sheet conveying device according to claim 18, further comprising biasing means for biasing said second rotating moving element in a direction to move to the position where it does not transmit the drive, wherein when said second rotating moving element transmits the drive, an engaging state of said second rotating moving element and a driven rotating element which engages with the second rotating moving element is held by an engaging force, and when said drive means drives said conveying means in said first direction, the engaging force of said second rotating moving element and said driven rotating element is weakened, whereby said biasing means moves said second rotating moving element to the position where it does not transmit the drive.

20. The sheet conveying device according to claim 19, further comprising biasing force increasing means for increasing a biasing force of said biasing means by said second rotating moving element transmitting the drive to said reverse conveying means.

21. The sheet conveying device according to claim 19, further comprising control means for controlling said drive means to drive said conveying means in the first direction, then drives said conveying means in a second direction after the sheet conveyed by said conveying means starts to be conveyed by said reverse conveying means, and drives said conveying means in the first direction so as to move said second rotating moving element to the position where it does not transmit the drive by weakening the engaging force of said second rotating moving element and said driven rotating element after the sheet passes through said reverse conveying means.

* * * * *

UNITED STATES PATENT AND TRADEMARK OFFICE

CERTIFICATE OF CORRECTION

PATENT NO. : 7,055,949 B2
APPLICATION NO. : 10/887955
DATED : June 6, 2006
INVENTOR(S) : Tetsuyo Ohashi It is certified that error appears in the above-identified patent and that said Letters Patent is hereby corrected as shown below:

SHEET NO. 21 of 25:
Figure 20A, "SNTANDBY" should read --STANDBY--. As shown on attached sheet.

COLUMN 1:
Line 53, "above" should read --above- --.

COLUMN 3:
Line 60, "view" should read --views--.

COLUMN 5:
Line 32, "an" should read --a--.

COLUMN 7:
Line 66, "from horizontality." should read --horizontally.--.

COLUMN 9:
Line 18, "to" (first occurrence) should be deleted.

COLUMN 11:
Line 8, "an" should read --a--.
Line 9, "an" should read --a--.

COLUMN 14:
Line 17, "above" should read --above- --.

COLUMN 19:
Line 26, "describe" should read --described--.
Line 41, "13.may" should read --13 may--.

COLUMN 20:
Line 32, "use" should read --used--.
Line 41, "dray" should read --day--.

COLUMN 21:
Line 62, "seciton" should read --section--.

COLUMN 24:
Line 18, "general" should read --common--.
Line 25, "general" should read --common--.

UNITED STATES PATENT AND TRADEMARK OFFICE

CERTIFICATE OF CORRECTION

PATENT NO. : 7,055,949 B2
APPLICATION NO. : 10/887955
DATED : June 6, 2006
INVENTOR(S) : Tetsuyo Ohashi It is certified that error appears in the above-identified patent and that said Letters Patent is hereby corrected as shown below:

COLUMN 34:
Line 61, "S20" should read --S20 is--.

COLUMN 35:
Line 20, "whey" should read --why--.

COLUMN 36:
Line 18, "time,.the" should read --time, the--.

COLUMN 37:
Line 8, "is" should be deleted.
Line 15, "release" should read --released--.

COLUMN 39:
Line 5, "roller)." should read --roller)--.

COLUMN 45:
Line 11, "claims 1 to 6," should read --claims 1, 2, 6 and 7,--.
Line 15, "claims 6 to 3," should read --claims 3, 6 and 8--.
Line 20, "claims 6 to 3," should read --claims 3, 6 and 8--.

Signed and Sealed this

Tenth Day of July, 2007

JON W. DUDAS
*Director of the United States Patent and Trademark Office*